US009872368B2

(12) United States Patent
Ogawa

(10) Patent No.: US 9,872,368 B2
(45) Date of Patent: Jan. 16, 2018

(54) CONTROL METHOD FOR MOBILE DEVICE

(71) Applicant: Panasonic Intellectual Property Corporation of America, Torrance, CA (US)

(72) Inventor: Kento Ogawa, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 313 days.

(21) Appl. No.: 14/578,481

(22) Filed: Dec. 21, 2014

(65) Prior Publication Data

US 2015/0201480 A1 Jul. 16, 2015

(30) Foreign Application Priority Data

Jan. 10, 2014 (JP) ..... 2014-003560

(51) Int. Cl.
*H05B 37/02* (2006.01)

(52) U.S. Cl.
CPC ..... *H05B 37/0272* (2013.01); *H05B 37/029* (2013.01)

(58) Field of Classification Search
CPC ..... H05B 37/0272; H05B 37/029; H05B 33/0845; H05N 5/2354; H04N 5/2354; H04N 5/2256; G06F 3/0485; G06F 3/0482; G06T 3/0485; G06T 3/0482
See application file for complete search history.

(56) References Cited

U.S. PATENT DOCUMENTS

2011/0035029 A1 2/2011 Yianni et al.
2011/0107248 A1 5/2011 Blum et al.
2011/0115815 A1 5/2011 Brackney
2012/0306621 A1* 12/2012 Muthu ..... H05B 37/0272 340/8.1

FOREIGN PATENT DOCUMENTS

JP 2011-519128 6/2011
KR EP 2519081 A2 * 10/2012 ..... H05B 37/029
WO 2012/049656 4/2012

OTHER PUBLICATIONS

The Extended European Search Report dated Oct. 21, 2015 for the related European Patent Application No. 15150079.0

* cited by examiner

*Primary Examiner* — Behrooz Senfi
(74) *Attorney, Agent, or Firm* — Greenblum & Bernstein, P.L.C.

(57) ABSTRACT

A control method for a mobile device that controls one or more illumination devices, the mobile device including a display, a computer, and a memory, the control method causing the computer of the mobile device to execute acquiring a piece of mobile-device location information indicating a location where the mobile device is present, sorting one or more setting screens corresponding to the respective one or more illumination devices using information stored in the memory, the information indicating correspondences between the one or more illumination devices and one or more pieces of illumination-device location information indicating locations where the respective one or more illumination devices are present, displaying the sorted one or more setting screens on the display, and transmitting a control signal in accordance with setting information indicating an illumination state set through the setting screens, to the one or more illumination devices.

20 Claims, 35 Drawing Sheets

| | SCENE NAME | SCENE ICON NAME | SETTING INFORMATION ON ILLUMINATION DEVICES | | | | | | | |
|---|---|---|---|---|---|---|---|---|---|---|
| | | | A | | B | C | D | E | | ··· |
| | | | BRIGHTNESS | COLOR | BRIGHTNESS | BRIGHTNESS | BRIGHTNESS | BRIGHTNESS | COLOR | ··· |
| 1 | PARTY | 00001.jpg | 100 | 5000 K | 100 | 100 | 80 | 0 | 3500 K | ··· |
| 2 | MEAL | 00002.jpg | 30 | 3500 K | 100 | 100 | 10 | 0 | 3500 K | ··· |
| 3 | RELAXING | 00003.jpg | 50 | 2800 K | 10 | 10 | 0 | 0 | 3500 K | ··· |
| 4 | TOGETHERNESS | 00004.jpg | 100 | 5000 K | 0 | 0 | 0 | 0 | 3500 K | ··· |
| 5 | CALM | 00005.jpg | 0 | 3500 K | 0 | 0 | 10 | 30 | 4000 K | ··· |
| 6 | RELAXING HOTEL | 00006.jpg | 0 | 3500 K | 0 | 0 | 10 | 10 | 3500 K | ··· |
| 7 | ENERGY SAVINGS | 00007.jpg | 50 | 4500 K | 50 | 30 | 30 | 0 | 3500 K | ··· |
| 8 | SLEEP | 00008.jpg | 0 | 3500 K | 10 | 10 | 10 | 10 | 2800 K | ··· |
| 9 | READING BEFORE SLEEP | 00009.jpg | 0 | 3500 K | 0 | 0 | 10 | 40 | 4500 K | ··· |
| 10 | DEEP SLEEP | 00010.jpg | 0 | 3500 K | 0 | 0 | 0 | 0 | 3500 K | ··· |
| ⋮ | ⋮ | ⋮ | ⋮ | ⋮ | ⋮ | ⋮ | ⋮ | ⋮ | ⋮ | |

FIG. 2

| | SCENE NAME | SCENE ICON NAME | SETTING INFORMATION ON ILLUMINATION DEVICES | | | | | | | |
|---|---|---|---|---|---|---|---|---|---|---|
| | | | A | | B | C | D | E | | ··· |
| | | | BRIGHTNESS | COLOR | BRIGHTNESS | BRIGHTNESS | BRIGHTNESS | BRIGHTNESS | COLOR | ··· |
| 1 | PARTY | 00001.jpg | 100 | 5000 K | 100 | 100 | 80 | 0 | 3500 K | ··· |
| 2 | MEAL | 00002.jpg | 30 | 3500 K | 100 | 100 | 10 | 0 | 3500 K | ··· |
| 3 | RELAXING | 00003.jpg | 50 | 2800 K | 10 | 10 | 0 | 0 | 3500 K | ··· |
| 4 | TOGETHERNESS | 00004.jpg | 100 | 5000 K | 0 | 0 | 0 | 0 | 3500 K | ··· |
| 5 | CALM | 00005.jpg | 0 | 3500 K | 0 | 0 | 10 | 30 | 4000 K | ··· |
| 6 | RELAXING HOTEL | 00006.jpg | 0 | 3500 K | 0 | 0 | 10 | 10 | 3500 K | ··· |
| 7 | ENERGY SAVINGS | 00007.jpg | 50 | 4500 K | 50 | 30 | 30 | 0 | 3500 K | ··· |
| 8 | SLEEP | 00008.jpg | 0 | 3500 K | 10 | 10 | 10 | 10 | 2800 K | ··· |
| 9 | READING BEFORE SLEEP | 00009.jpg | 0 | 3500 K | 0 | 0 | 10 | 40 | 4500 K | ··· |
| 10 | DEEP SLEEP | 00010.jpg | 0 | 3500 K | 0 | 0 | 0 | 0 | 3500 K | ··· |
| ⋮ | ⋮ | ⋮ | ⋮ | ⋮ | ⋮ | ⋮ | ⋮ | ⋮ | ⋮ | |

FIG. 4

| | PRODUCT NUMBER | ILLUMINATION DEVICE NAME | ILLUMINATION DEVICE LOCATION | SETTING PARAMETER | |
|---|---|---|---|---|---|
| A | P00001 | LIVING-ROOM CEILING LIGHT | LIVING ROOM | BRIGHTNESS ADJUSTMENT | COLOR ADJUSTMENT |
| B | P00002 | DINING-ROOM LIGHT | LIVING ROOM | BRIGHTNESS ADJUSTMENT | — |
| C | P00003 | KITCHEN DOWNLIGHT | LIVING ROOM | BRIGHTNESS ADJUSTMENT | — |
| D | P00004 | HALLWAY DOWNLIGHTT | HALLWAY | BRIGHTNESS ADJUSTMENT | — |
| E | P00005 | BEDROOM CEILING LIGHT | BEDROOM | BRIGHTNESS ADJUSTMENT | COLOR ADJUSTMENT |
| F | P00006 | DOWNLIGHT ABOVE BED | BEDROOM | BRIGHTNESS ADJUSTMENT | — |
| G | P00007 | BEDSIDE WALL DOWNLIGHT | BEDROOM | BRIGHTNESS ADJUSTMENT | — |
| H | P00008 | WALL DOWNLIGHT NEAR FLOOR | BEDROOM | BRIGHTNESS ADJUSTMENT | — |
| ⋮ | ⋮ | ⋮ | ⋮ | ⋮ | ⋮ |

CONTROL METHOD FOR MOBILE DEVICE

BACKGROUND

1. Technical Field

The present disclosure relates to a control method for a mobile device that controls an illumination device that illuminates a space, and the like.

2. Description of the Related Art

Hitherto, there has been disclosed an illumination system controller that controls illumination devices in accordance with illumination scenes created by adjusting, using sliders, the brightness and color of light emitted by illumination devices (see Japanese Unexamined Patent Application Publication (Translation of PCT Application) No. 2011-519128).

SUMMARY

However, the above-described conventional illumination system controller has a problem in that a user may not be able to easily adjust the illumination states created by the illumination devices.

For the above-described conventional illumination system controller, a predetermined screen is displayed for adjusting each illumination state regardless of situation under which the illumination state created by illumination devices is adjusted. Thus, every time a situation changes under which an illumination state is adjusted, it is necessary to search for illumination devices corresponding to the situation and the user is made to do an onerous operation.

Hence, the present disclosure provides a control method for a mobile device, the control method for a mobile device allowing a user to easily adjust an illumination state created by one or more illumination devices.

In one general aspect, the techniques disclosed here feature a control method for a mobile device. The mobile device includes a display, a computer, and a memory. The control method causing the computer of the mobile device to execute acquiring a piece of mobile-device location information indicating a location where the mobile device is present, sorting one or more setting screens corresponding to the respective one or more illumination devices using information stored in the memory, the information indicating correspondences between the one or more illumination devices and one or more pieces of illumination-device location information indicating one or more locations where the respective one or more illumination devices are present, displaying the one or more sorted setting screens on the display, and transmitting a control signal for controlling the one or more illumination devices in accordance with setting information indicating an illumination state set through a user's operation performed through the setting screens, to the one or more illumination devices.

These general and specific aspects may be implemented using a system, a method, and a computer program, and any combination of systems, methods, and computer programs.

According to a control method for a mobile device according to the present disclosure, a user may easily adjust an illumination state created by one or more illumination devices.

BRIEF DESCRIPTION OF THE DRAWINGS

FIG. 2 is a diagram illustrating an example of scene information according to the embodiment.

FIG. 4 is a diagram illustrating an example of operation target illumination information according to the embodiment.

Figure 1:
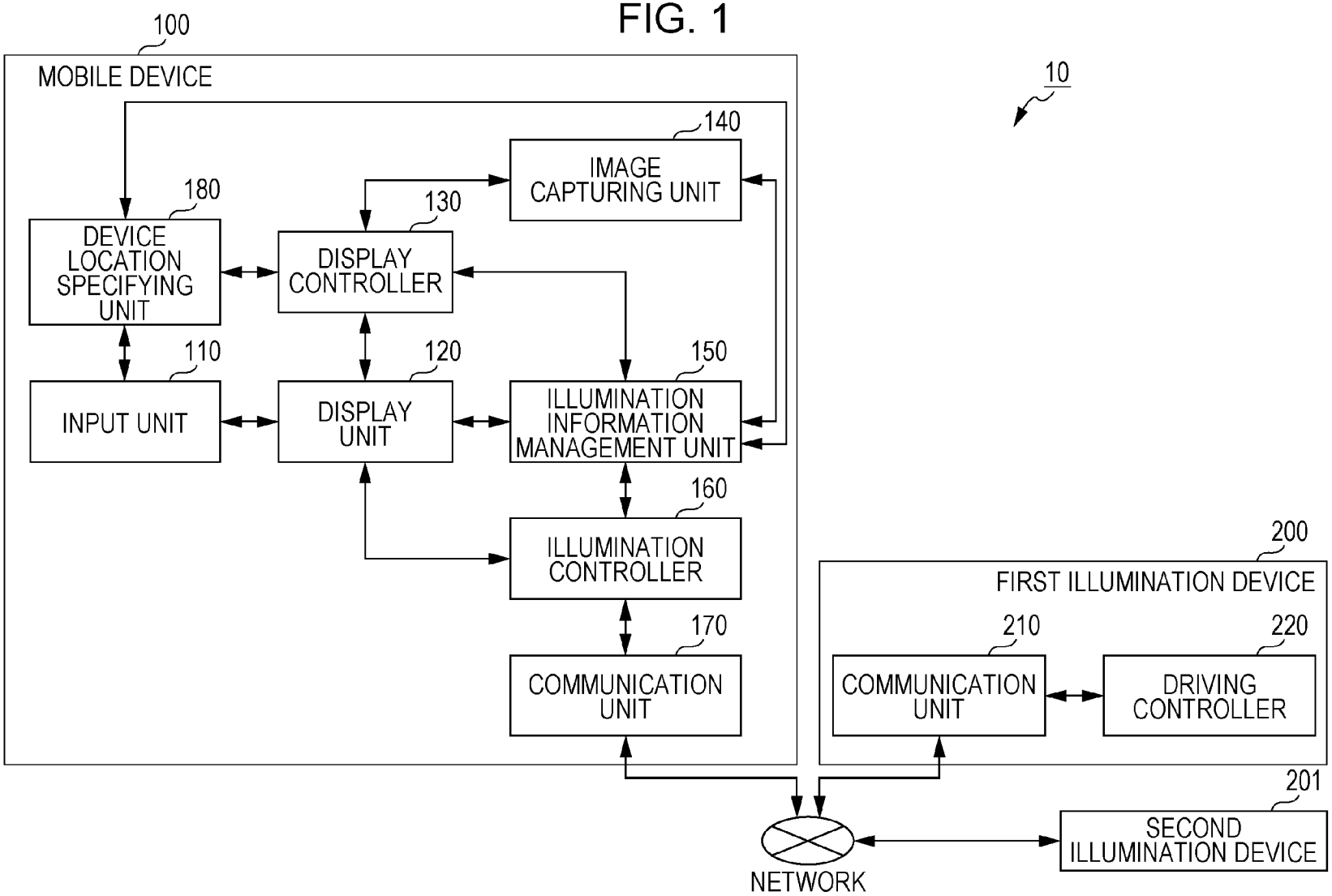
FIG. 1 is a block diagram illustrating an example of an illumination system according to an embodiment.

DETAILED DESCRIPTION (Underlying Knowledge Forming Basis of the Present Disclosure)

The inventor has found out that the illumination system controller described in the section of Background Art has the following problem.

The color or brightness of a plurality of illumination devices may be adjusted using the above-described conventional illumination system controller when a user operates a slider displayed on the conventional illumination system controller. In addition, an adjusted illumination state created by the plurality of illumination devices may be treated as a scene and saved together with a scene name.

However, the greater the number of illumination devices, which are operation targets, the more onerous operation the user is made to do since he or she needs to search for a desired illumination device among many illumination devices. For example, in the case where there is a limit to the number of illumination devices that may be displayed on a setting screen on one screen, an operation for changing screens is necessary to find a desired illumination device.

For example, in the case where a user is in "living room" with a mobile device and tries to adjust an illumination state created by illumination devices present in the "living room", it is preferable that setting screens for the illumination devices present in the "living room" be displayed. In this case, even though setting screens for illumination devices present in "bedroom" are displayed, there is a high probability that the user does not operate the setting screens for illumination devices present in the "bedroom" and the user needs to search for the setting screens for illumination devices present in the "living room".

In addition, it may be considered to display many setting screens on one screen in order to avoid changing of screens. However, in this case, each setting screen is made small and it becomes difficult to adjust an illumination state.

Thus, techniques are desired that allow a user to easily adjust an illumination state created by illumination devices, in accordance with a state in which the illumination state created by the illumination devices is adjusted.

In order to solve such a program, a control method for a mobile device according to an embodiment of the present disclosure is a control method for a mobile device that controls one or more illumination devices. The mobile device includes a display, a computer, and a memory. The control method causing the computer of the mobile device to execute acquiring a piece of mobile-device location information indicating a location where the mobile device is present, sorting one or more setting screens corresponding to the respective one or more illumination devices using information stored in the memory, the information indicating correspondences between the one or more illumination devices and one or more pieces of illumination-device location information indicating one or more locations where the respective one or more illumination devices are present, and displaying the sorted one or more setting screens on the display, and transmitting a control signal for controlling the one or more illumination devices in accordance with setting information indicating an illumination state set through a user's operation performed through the setting screens, to the one or more illumination devices.

As a result, since one or more setting screens are sorted in accordance with a piece of mobile-device location information and one or more pieces of illumination-device location information and are displayed, an operation screen appropriate for a location where a mobile device is present may be created. Thus, such an operation screen may allow a user to easily adjust an illumination state created by one or more illumination devices.

In addition, for example, the control method for a mobile device may further include displaying a scene selection screen including one or more scene icons and a scene setting button on the display, the one or more scene icons corresponding to one or more scenes indicating one or more illumination states created by the one or more illumination devices, transmitting, to the one or more illumination devices, the control signal for controlling the one or more illumination devices so as to provide illumination, in a case where a scene icon has been selected among the one or more scene icons, in an illumination state indicated by a scene corresponding to the selected scene icon, sorting the one or more setting screens in a case where the scene setting button has been selected, displaying the sorted one or more setting screens together with a setting complete button on the display, and storing the setting information obtained when the setting complete button is selected, as setting information on a new scene, in the memory.

As a result, when a scene is set, since one or more setting screens are sorted in accordance with a piece of mobile-device location information and one or more pieces of illumination-device location information and are displayed, a scene setting screen appropriate for a location where a mobile device is present may be created. Thus, such a scene setting screen may allow a user to easily set an illumination state to be created by one or more illumination devices.

In addition, for example, the mobile-device location information may be information specifying a room or an area where the mobile device is present, and each of the illumination-device location information may be information specifying a room or an area where a corresponding one of the one or more illumination devices is present.

As a result, an operation screen appropriate for a room or an area where a mobile device is present may be created.

Thus, the control method works more effectively in, for example, homes or commercial facilities and such an operation screen may allow a user to easily adjust an illumination state.

In addition, for example, the one or more setting screens may be sorted such that a setting screen corresponding to a piece of illumination-device location information among the one or more pieces of illumination-device location information is prioritized, the piece of illumination-device location information matching the room or the area specified by the piece of mobile-device location information, the sorted setting screens may be displayed on the display.

As a result, for example, when a user is in "living room" with a mobile device, a setting screen corresponding to "living room" may be caused to be displayed, and when in "bedroom", a setting screen corresponding to "bedroom" may be caused to be displayed. Thus, such a setting screen may allow a user to easily adjust an illumination state.

In addition, for example, the control method for a mobile device may further include displaying a location input button on the display, and displaying, in a case where the location input button has been selected, a first input screen on the display for causing the user to input the piece of mobile-device location information.

As a result, since a user may input a piece of mobile-device location information, a screen desired by the user may be caused to be displayed at a timing desired by the user. For example, a user present in a certain room may check or adjust an illumination state of another room. Thus, the convenience of operation may be improved.

In addition, for example, the control method for a mobile device may further include displaying a second input screen on the display for causing the user to input the one or more pieces of illumination-device location information.

As a result, since a user may input a piece of illumination-device location information, an illumination device may be registered at a location desired by the user. For example, a user present in a certain room may register an illumination device of another room. Thus, the convenience of operation may be improved.

In addition, for example, the mobile-device location information may be information specifying a latitude, a longitude, and a floor number of the location where the mobile device is present, and each of the illumination-device location information may be information specifying a latitude, a longitude, and a floor number of a location where a corresponding one of the one or more illumination devices is present.

As a result, since the location where a mobile device is present may be specified by numerical values, setting screens may be sorted with high accuracy. Thus, an illumination state may be caused to be more easily adjusted.

In addition, for example, the one or more setting screens corresponding to the one or more pieces of illumination-device location information may be sorted in ascending order of one or more distances from the mobile device to one or more positions determined by one or more latitudes, longitudes, and floor numbers specified by the one or more pieces of illumination-device location information, and the sorted one or more setting screens may be displayed on the display.

As a result, since setting screens for illumination devices may be displayed such that the closer to a mobile device an illumination device is, the more prioritized the setting screen for the illumination device is. Thus, an illumination state may be caused to be more easily selected.

In addition, for example, the mobile device is capable of communicating with a wireless LAN device, and the piece of mobile-device location information may be acquired by specifying the location where the mobile device is present in accordance with an identifier unique to the wireless LAN device and included in wireless signal information transmitted by the wireless LAN device.

As a result, since a piece of mobile-device location information may be automatically acquired using a wireless LAN function, an operational burden may be reduced and the convenience of operation for users may be improved.

In addition, for example, the mobile device is capable of communicating with a BLUETOOTH communication device, and the piece of mobile-device location information may be acquired by specifying the location where the mobile device is present in accordance with an identifier unique to the BLUETOOTH communication device and included in wireless signal information transmitted by the BLUETOOTH communication device.

As a result, since a piece of mobile-device location information may be automatically acquired using a BLUETOOTH communication function, an operational burden may be reduced and the convenience of operation for users may be improved.

In addition, for example, the mobile device may further include a sensor that receives a visible-frequency electromagnetic wave, and the piece of mobile-device location information may be acquired by specifying the location where the mobile device is present in accordance with an identifier unique to a visible light communication device that transmits a visible-frequency electromagnetic wave and included in a visible-frequency electromagnetic wave received by the sensor.

As a result, since a piece of mobile-device location information may be automatically acquired using a visible light communication function, an operational burden may be reduced and the convenience of operation for users may be improved.

In addition, for example, the mobile device may further include a microphone that receives an ultrasonic wave, and the piece of mobile-device location information may be acquired by specifying the location where the mobile device is present in accordance with an identifier unique to a speaker that transmits an ultrasonic wave and included in an ultrasonic wave received by the microphone.

As a result, since a piece of mobile-device location information may be automatically acquired using an ultrasonic wave, an operational burden may be reduced and the convenience of operation for users may be improved.

In addition, for example, the mobile device may further include an indoor messaging system receiver, and the piece of mobile-device location information may be acquired by specifying the location where the mobile device is present in accordance with information indicating a latitude, a longitude, and a floor number included in wireless signal information received by the indoor messaging system receiver, the wireless signal information being transmitted by an indoor messaging system transmitter that communicates with the mobile device.

As a result, since a piece of mobile-device location information may be automatically and precisely acquired using an ultrasonic wave, an operational burden may be reduced and the convenience of operation for users may be improved.

In addition, for example, the control signal may be transmitted via one or more communication devices, each of the one or more illumination devices may belong to any one of the one or more communication devices, and the one or more pieces of illumination-device location information may be one or more pieces of communication-device location information indicating one or more locations where respective one or more communication devices are present to which the one or more illumination devices corresponding to the one or more pieces of illumination-device location information belong.

As a result, for example, since an illumination system may be configured using a communication device such as a bridge, for example, an additional illumination device may be more easily registered.

In addition, for example, each of the one or more pieces of communication-device location information may be a piece of information acquired by a communication device corresponding to the piece of communication-device location information.

As a result, since a communication device may specify the location where the communication device itself is present, a mobile device has only to acquire a piece of communication-device location information from a communication device.

In addition, for example, each of the one or more communication devices is capable of communicating with a wireless LAN device corresponding to the communication device, and the communication device may acquire the piece of communication-device location information by specifying a location where the communication device is present in accordance with an identifier unique to the wireless LAN device and included in wireless signal information transmitted by the wireless LAN device.

As a result, since a piece of communication-device location information may be automatically acquired using a wireless LAN function, an operational burden may be reduced and the convenience of operation for users may be improved.

In addition, for example, each of the one or more communication devices is capable of communicating with a BLUETOOTH communication device corresponding to the communication device, and the communication device may acquire the piece of communication-device location information by specifying a location where the communication device is present in accordance with an identifier unique to the BLUETOOTH communication device and included in wireless signal information transmitted by the BLUETOOTH communication device.

As a result, since a piece of communication-device location information may be automatically acquired using a BLUETOOTH communication function, an operational burden may be reduced and the convenience of operation for users may be improved.

In addition, for example, each of the one or more communication devices may include a sensor that receives a visible-frequency electromagnetic wave transmitted from a visible light communication device corresponding to the communication device, and the communication device may acquire the piece of communication-device location information by specifying a location where the communication device is present in accordance with an identifier unique to the visible light communication device and included in an electromagnetic wave received by the sensor.

As a result, since a piece of communication-device location information may be automatically acquired using a visible light communication function, an operational burden may be reduced and the convenience of operation for users may be improved.

In addition, for example, each of the one or more communication devices may include a microphone that receives an ultrasonic wave transmitted from a speaker corresponding to the communication device, and the communication device may acquire the piece of communication-device location information by specifying a location where the communication device is present in accordance with an identifier unique to the speaker and included in an ultrasonic wave received by the microphone.

As a result, since a piece of communication-device location information may be automatically acquired using an ultrasonic wave, an operational burden may be reduced and the convenience of operation for users may be improved.

In addition, for example, each of the one or more communication devices may include an indoor messaging system receiver, and the communication device may acquire the piece of communication-device location information by specifying a location where the communication device is present in accordance with information indicating a latitude, a longitude, and a floor number included in wireless signal information received by the indoor messaging system receiver, the wireless signal information being transmitted by an indoor messaging system transmitter that communicates with the communication device.

As a result, since a piece of communication-device location information may be automatically acquired using an IMES, an operational burden may be reduced and the convenience of operation for users may be improved.

In addition, for example, the control method for a mobile device may further include displaying a third input screen on the display for causing the user to input the one or more pieces of communication-device location information.

As a result, since a user may input a piece of communication-device location information, a communication device may be registered at a location desired by the user. For example, a user present in a certain room may register a communication device of another room. Thus, the convenience of operation may be improved.

Note that these complete or specific embodiments may also be realized by a system, an apparatus, an integrated circuit, a computer program, or a recording medium such as a computer-readable CD-ROM, and may also be realized by an arbitrary combination of some or all of systems, apparatuses, integrated circuits, computer programs, and recording mediums.

In the following, embodiments will be specifically described with reference to the drawings.

Note that any of the embodiments to be described in the following illustrates a complete or specific example. Numerical values, shapes, materials, structural elements, arrangement positions and connection states of the structural elements, steps, the order of steps, and the like are examples and do not intend to limit the present disclosure. In addition, among the structural elements of the following embodiments, structural elements that are not described in independent claims representing the broadest concept will be described as arbitrary structural elements.

(Embodiment)

First, a functional configuration of an illumination system according to a present embodiment will be described using FIG. 1. FIG. 1 is a block diagram illustrating an illumination system 10 according to the present embodiment.

As illustrated in FIG. 1, the illumination system 10 includes a mobile device 100, a first illumination device 200, and a second illumination device 201. The mobile device 100 is connected to the first illumination device 200 and the second illumination device 201 via a network.

Next, the configuration of the mobile device 100 will be described.

The mobile device 100 is an example of a device that controls one or more illumination devices that illuminate one or more spaces. Specifically, the mobile device 100 controls, for example, turning on, turning off, brightness adjustment, and color adjustment of one or more illumination devices (in an example illustrated in FIG. 1, the first illumination device 200 and the second illumination device 201).

The mobile device 100 has a display and a camera function. For example, the mobile device 100 may be a mobile information device such as a smartphone, a mobile phone, a tablet device, or a personal digital assistant (PDA).

As illustrated in FIG. 1, the mobile device 100 includes an input unit 110, a display unit 120, a display controller 130, an image capturing unit 140, an illumination information management unit 150, an illumination controller 160, a communication unit 170, and a device location specifying unit 180.

The input unit 110 receives an operation input performed by a user. For example, the input unit 110 receives an operation input performed by a user to adjust an illumination state. In addition, the input unit 110 receives an operation input performed by a user to select a scene, a setting, and the like. Specifically, the input unit 110 receives an operation performed through a Graphical User Interface (GUI) component (widget) displayed on the display unit 120. The input unit 110 outputs information based on an operation performed by a user to the display controller 130, the illumination information management unit 150, the illumination controller 160, the device location specifying unit 180, and the like.

For example, the input unit 110 detects a push-button being pressed by a user, the push-button being displayed on the display unit 120. In addition, the input unit 110 acquires a setting value set when a user operates a slider displayed on the display unit 120. In addition, the input unit 110 acquires text input by a user into a text box displayed on the display unit 120.

For example, the input unit 110 includes various types of sensors such as a capacitance sensor of a touch screen (a touch panel). That is, the input unit 110 realizes the input function of the touch screen. Specifically, the input unit 110 receives a user's operation performed through a GUI component displayed on the touch screen. More specifically, the input unit 110 detects a push-button being pressed, the push-button being displayed on the touch screen, or an operation performed on the slider, or acquires text or the like input via a software keyboard. Note that the input unit 110 may also be a physical button provided on the mobile device 100.

The display unit 120 displays a screen (an image) created by the display controller 130. For example, the display unit 120 displays a remote-control operation screen, a scene selection screen, a scene setting screen, a scene-name input screen, an image-capturing confirmation screen, and the like. Each screen includes a GUI component that may be operated by a user. Note that specific examples of screens displayed on the display unit 120 will be described later.

For example, the display unit 120 is a liquid crystal display or an organic Electro-Luminescence (OEL) display. Specifically, the display unit 120 realizes the display function of the touch screen (the touch panel).

The display controller 130 creates a screen for performing display on the display unit 120. Specifically, the display controller 130 creates a remote-control operation screen, a scene selection screen, a scene setting screen, a scene-name input screen, an image-capturing confirmation screen, and the like. The display controller 130 causes the display unit 120 to display each of the created screens.

Specifically, the display controller 130 creates a scene selection screen in accordance with scene information managed by the illumination information management unit 150. In addition, the display controller 130 creates a remote-control operation screen and a scene setting screen in accordance with operation target illumination information managed by the illumination information management unit 150 and a piece of mobile-device location information acquired by the device location specifying unit 180.

For example, the display controller 130 includes a central processing unit (CPU), a read-only memory (ROM), a random-access memory (RAM), and the like.

The image capturing unit 140 realizes a camera function for acquiring captured images. Specifically, the image capturing unit 140 is started up after a setting complete button of a new scene has been selected. An image acquired by the image capturing unit 140 is managed as a scene icon by the illumination information management unit 150.

For example, the image capturing unit 140 is a camera unit. Specifically, the image capturing unit 140 includes an optical lens, an image sensor, and the like. The image capturing unit 140 converts, using the image sensor, light entered through the optical lens into an image signal and outputs the image signal.

Note that startup of the image capturing unit 140 indicates that a state is entered in which it is possible to capture an image using the image capturing unit 140. For example, startup indicates that a state is entered in which an image may be acquired by pressing the shutter button. Specifically, startup indicates startup of an application software program for acquiring images. For example, startup indicates that a live view image and the shutter button are displayed on the display unit 120.

The illumination information management unit 150 manages scene information and operation target illumination information. Scene information is information indicating one or more scenes. Operation target illumination information is information including information on one or more illumination devices that may be controlled by the mobile device 100 and one or more pieces of illumination-device location information indicating one or more locations where the respective one or more illumination devices are present. Scene information and operation target illumination information will be described later using FIGS. 2 and 4.

For example, the illumination information management unit 150 is a memory such as a RAM or a non-volatile memory. Note that the illumination information management unit 150 may also be a memory removable from the mobile device 100.

The illumination controller 160 creates a control signal for controlling one or more illumination devices (the first illumination device 200 and the second illumination device 201). The illumination controller 160 transmits the created control signal to the one or more illumination devices via the communication unit 170. For example, the illumination controller 160 includes a CPU, a ROM, a RAM, and the like.

A control signal is created, for example, on a per-illumination-device basis and includes a setting parameter corresponding to a function of a corresponding one of illumination devices and a setting value of the setting parameter. Specifically, a control signal includes information indicating a setting value of a brightness adjustment function (a dimming ratio), a setting value of a color adjustment function (a color temperature), or the like.

The communication unit 170 transmits a control signal created by the illumination controller 160 to one or more illumination devices connected via a network.

For example, the communication unit 170 is a communication interface such as a wireless local-area network (LAN) module, a BLUETOOTH module, a near field communication (NFC) module, or the like. Note that the communication unit 170 may also be a LAN terminal for wired communication.

The device location specifying unit 180 acquires a piece of mobile-device location information indicating the location where the mobile device 100 is present. For example, the device location specifying unit 180 acquires information indicating the current position of the mobile device 100 as a piece of mobile-device location information. Specifically, a piece of mobile-device location information is information specifying a room where the mobile device 100 is present. For example, the device location specifying unit 180 includes a CPU, a ROM, a RAM, and the like.

In addition, when an illumination device is registered, the device location specifying unit 180 acquires a piece of location information indicating the location where the mobile device 100 is present. The acquired piece of location information is treated as a piece of illumination-device location information, associated with an illumination device to be registered, and managed by the illumination information management unit 150.

Next, one or more illumination devices controlled by the mobile device 100 will be described.

The first illumination device 200 and the second illumination device 201 are an example of one or more illumination devices. The first illumination device 200 and the second illumination device 201 have, for example, at least one of a brightness adjustment function and a color adjustment function. Note that the first illumination device 200 and the second illumination device 201 may also be illumination devices of different kinds or the same kind.

The first illumination device 200 and the second illumination device 201 are arranged, for example, at different positions in one or more spaces, the position of the first illumination device 200 being different from that of the second illumination device 201. The first illumination device 200 and the second illumination device 201 are arranged such that the one or more spaces are illuminated from different directions.

Here, the one or more spaces are, for example, "living room", "dining room", and a space constituted by "hallway". That is, a space is a room or a space including one or more rooms partitioned by a door and the like. For example, the first illumination device 200 is "living-room ceiling light" that mainly illuminates "living room", and the second illumination device 201 is "dining-room light" that mainly illuminates "dining room".

Note that the first illumination device 200 and the second illumination device 201 may also be arranged in different spaces, the space where the first illumination device 200 is arranged being different from the space where the second illumination device 201 is arranged. That is, the one or more illumination devices may also include illumination devices that illuminate different spaces. For example, the first illumination device 200 is "living-room ceiling light" arranged in "living room", and the second illumination device 201 may also be "bedroom Ceiling Light" arranged in "bedroom".

Note that, in the following, examples will be described in which illumination devices present in a home are controlled; however, examples are not limited to these examples. For example, one or more illumination devices may also be controlled that are arranged in commercial facilities such as a shopping center, an office building, and a supermarket or a public space. Here, a piece of mobile-device location information is information specifying, for example, an area where the mobile device 100 is present.

An area is a predetermined area and is not necessarily a region defined by walls or partition walls. Examples of such an area are, specifically, "shop", "corridor", "elevator hall", and the like in a shopping center or in an office building, or "cashier", "seafood section", "vegetable section", and the like in a supermarket.

As illustrated in FIG. 1, the first illumination device 200 includes a communication unit 210 and a driving controller 220. Note that, although not illustrated, the second illumination device 201 also includes a communication unit 210 and a driving controller 220.

The communication unit 210 receives a control signal transmitted from the mobile device 100. Note that the communication unit 210 may also receive a control signal transmitted from the communication unit 170 of the mobile device 100 via a communication device such as a bridge or a router.

For example, the communication unit 210 is a communication interface such as a wireless LAN module, a BLUETOOTH module, an NFC module, or the like. Note that the communication unit 210 may also be a LAN terminal for wired communication.

The driving controller 220 performs dimming and adjusts the color of light of the first illumination device 200 in accordance with a control signal received by the communication unit 210. For example, the driving controller 220 performs dimming and adjusts the color of light such that the brightness and color of light emitted by the first illumination device 200 have values equal to setting values included in the control signal.

As described above, in the illumination system 10 according to the present embodiment, the first illumination device 200 and the second illumination device 201 are adjusted in accordance with a control signal transmitted from the mobile device 100 in terms of brightness of light, color of light, and the like. In this manner, in the present embodiment, the mobile device 100 may adjust an illumination state of one or more spaces by controlling one or more illumination devices.

Next, a screen displayed on the display unit 120 will be described using FIGS. 2 to 9B, the screen being created by the display controller 130.

Figure 3:
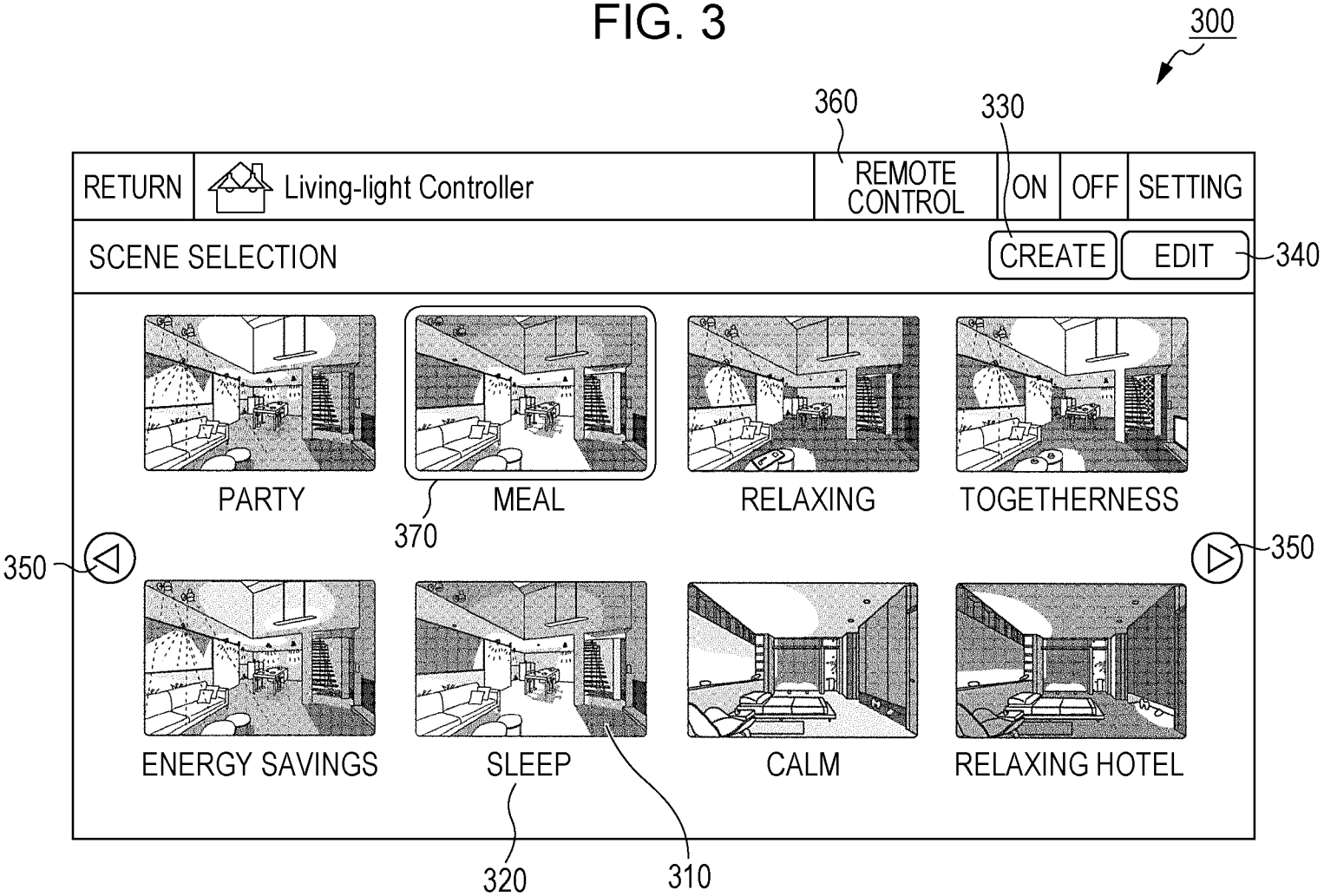
FIG. 3 is a diagram illustrating an example of a scene selection screen according to the embodiment.

First, scene information managed by the illumination information management unit 150 and a scene selection screen created in accordance with scene information will be described using FIGS. 2 and 3. FIG. 2 is a diagram illustrating an example of scene information according to the present embodiment. FIG. 3 is a diagram illustrating a scene selection screen 300 according to the present embodiment.

Scene information is information indicating one or more scenes. One or more scenes indicate one or more illumination states created by one or more illumination devices, the one or more illumination states being one or more illumination states of one or more spaces. One scene is associated with one illumination state.

As illustrated in FIG. 2, the scene information includes scene names, scene icon names, and setting information on illumination devices. Each scene is associated with a scene name, a scene icon name, and setting information on illumination devices. That is, the illumination information management unit 150 associates, for each scene, a scene name, a scene icon name, and setting information on illumination devices with one another and performs management on a per-scene basis.

Scene names are names set by a user to distinguish scenes. Specifically, scene names are text input by a user via a scene-name input screen, which will be described later. As illustrated in FIG. 2, since a user may set, as a scene name, a name with which the user may easily picture a certain illumination state such as "party", "meal", or the like, the atmosphere of the scene may be easily predicted.

Scene icons are images acquired by the image capturing unit 140. For example, such an image is an image acquired by capturing a space illuminated by one or more illumination devices. In an example illustrated in FIG. 2, scenes and scene icons are associated with each other on a one-to-one basis. Note that, as a scene icon, there may also be the case where a predetermined default image is registered instead of an image acquired by the image capturing unit 140.

Setting information is information indicating illumination states set by a user through a scene setting screen, which will be described later. Specifically, setting information is information, for one or more illumination devices, indicating setting parameters of each illumination device and setting values of the setting parameters of the illumination device. For example, since illumination devices have at least one of the brightness adjustment function and the color adjustment function, setting information includes, for each of the one or more illumination devices, at least one of brightness adjustment setting information and color adjustment setting information.

The brightness adjustment function is a function for adjusting the brightness of light emitted from an illumination device. A setting value of the brightness adjustment function (a dimming ratio) is, for example, set to a value of from "0 to 100". The greater the dimming ratio, the brighter the light emitted from the illumination device. A dimming ratio of "0" indicates that the illumination device is turned off. A dimming ratio of "100" indicates that the illumination device is turned on with maximum power.

The color adjustment function is a function for changing the color of light emitted from an illumination device. Specifically, the color adjustment function is a function for adjusting the color temperature of light. A setting value of the color adjustment function (a color temperature) is set to, for example, a value of from "2100 K to 5000 K". The lower the color temperature, the warmer the color. The higher the color temperature, the colder the color. For example, "lamp" has a color temperature of about "2800 K", "warm white" a color temperature of about "3500 K", and "daylight" a color temperature of about "5000 K".

Note that one or more illumination devices may also include an illumination device that has only the turn-on function and the turn-off function. In this case, the illumination device may be treated as an illumination device for which a dimming ratio may be set only to "0" and "100".

In the case where a scene has been set that is new and different from existing scenes, the scene is registered as a new scene in the scene information. In the case where a new scene has been newly created, a scene name and a scene icon of and setting information on the new scene are added and registered in the scene information. Details of creation of a new scene will be described later using FIGS. 18A and 18B.

In contrast, in the case where a new scene is set by editing an existing scene, a scene name and a scene icon of and setting information on the new scene are registered instead of the scene name and the scene icon of and the setting information on the existing scene. Details of editing of a new scene will be described later using FIGS. 20A and 20B.

In accordance with scene information as described above, a scene selection screen is created. Specifically, the display controller 130 creates the scene selection screen 300 illustrated in FIG. 3 in accordance with the scene information illustrated in FIG. 2 and causes the display unit 120 to display the scene selection screen 300.

The scene selection screen 300 is a screen for causing a user to select one scene from among one or more scenes. In addition, the scene selection screen 300 includes a scene setting button for setting a new scene.

As illustrated in FIG. 3, the scene selection screen 300 includes one or more scene icons 310, scene names 320, a creation button 330, an edit button 340, scroll buttons 350, and a remote-control button 360.

The one or more scene icons 310 correspond to one or more scenes on a one-to-one basis. The scene icons 310 are images acquired by the image capturing unit 140. Specifically, each of the scene icons 310 is an image acquired by capturing an image of a space illuminated in an illumination state indicated by a scene corresponding to the scene icon 310.

The scene icons 310 may be selected by a user. That is, a scene icon 310 may be selected from among the scene icons 310 by a finger of a user that touches the touch screen. In the case where the input unit 110 detects that a scene icon 310 has been selected, the input unit 110 notifies the display controller 130 and the illumination controller 160 of information indicating the selected scene icon 310.

For example, as illustrated in FIG. 3, a scene icon 310 representing "meal" is surrounded by a certain frame 370. This indicates that the scene icon 310 representing "meal" is currently selected and a space is illuminated in an illumination state corresponding to the scene icon 310 representing "meal".

Note that a method for indicating that a scene icon 310 has been selected is not limited to this example. For example, a selected scene icon 310 may also be displayed in a highlighted manner or in a blinking manner. Alternatively, a scene name 320 corresponding to a selected scene icon 310 may also be displayed in a bold manner.

Scene names 320 are displayed under corresponding scene icons 310. Note that the scene names 320 have only to be displayed near the corresponding scene icons 310. For example, a scene name 320 may also be displayed to the right, left, or above of a corresponding scene icon 310. In addition, the scene names 320 may also be displayed on corresponding scene icons 310 in a superimposition manner.

Note that the scene names 320 do not have to be displayed. In addition, in the case where the scene names 320 are displayed, not only the scene icons 310 but also the scene names 320 may be selected.

The creation button 330 and the edit button 340 are examples of a scene setting button. The creation button 330 is a button for creating a new scene, and the edit button 340 is a button for editing an existing scene.

The creation button 330 and the edit button 340 are examples of a GUI component, and are, for example, push-buttons. In the case where the creation button 330 or the edit button 340 has been selected by a user, a scene creation screen or a scene edit screen, which will be described later, is displayed on the display unit 120. Specifically, in the case where the input unit 110 detects the creation button 330 or the edit button 340 being pressed, the display controller 130 creates a scene creation screen or a scene edit screen and causes the display unit 120 to display the scene creation screen or the scene edit screen. Such a scene creation screen will be described later using FIG. 6A, and such a scene edit screen will be described later using FIG. 6B.

The scroll buttons 350 are buttons for changing scene icons 310 being displayed. That is, the scroll buttons 350 are buttons for switching display from scene icons 310 to other scene icons 310. For example, in the case where scenes the number of which is greater than the maximum number of scenes that may be displayed on the scene selection screen 300 have already been set, a user may cause the scene selection screen 300 to display scene icons of other scenes by selecting one of the scroll buttons 350 and may select a scene icon.

The scroll buttons 350 are an example of a GUI component, and are, for example, push-buttons. Note that the scroll buttons 350 may also be a scroll bar instead of push-buttons.

In an example illustrated in FIG. 3, eight scene icons 310 are displayed on the scene selection screen 300. Here, in the case where ten scenes have already been set, when the input unit 110 detects one of the scroll buttons 350 being pressed, the display controller 130 creates a scene selection screen 300 including scene icons corresponding to the remaining two scenes and causes the scene selection screen 300 to be displayed.

Specifically, the scroll buttons 350 are buttons for changing pages. For example, in the case where one of the scroll buttons 350 has been selected, the display controller 130 changes a screen displaying eight scene icons to a screen displaying two scene icons.

Alternatively, in the case where one of the scroll buttons 350 has been selected, the display controller 130 may perform display by changing scene icons in units of a predetermined number of scene icons, the predetermined number being one or greater. For example, in the case where the scroll button 350 on the right side has been selected, the display controller 130 may delete the scene icon of "party", move and rearrange the remaining seven scene icons, and then display another scene icon.

The remote-control button 360 is a button for displaying a remote-control operation screen used to control one or more illumination devices. The remote-control button 360 is an example of a GUI component, and is, for example, a push-button. In the case where the remote-control button 360 has been selected by a user, a remote-control operation screen, which will be described later, is displayed on the display unit 120. Specifically, in the case where the input unit 110 detects the remote-control button 360 being pressed, the display controller 130 creates a remote-control operation screen and causes the display unit 120 to display the remote-control operation screen.

Figure 5A:
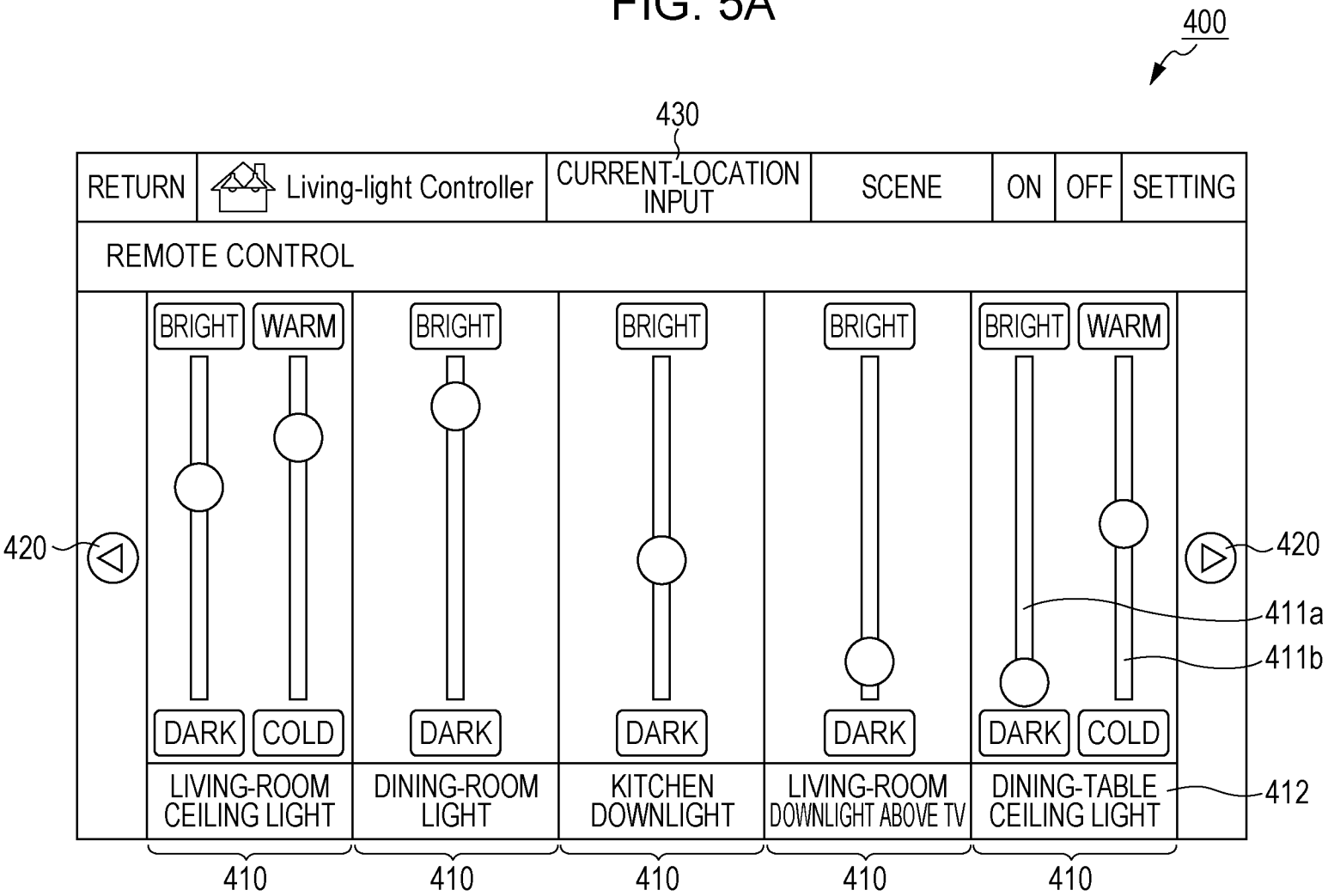
FIG. 5A is a diagram illustrating an example of a remote-control operation screen according to the embodiment.
Figure 5B:
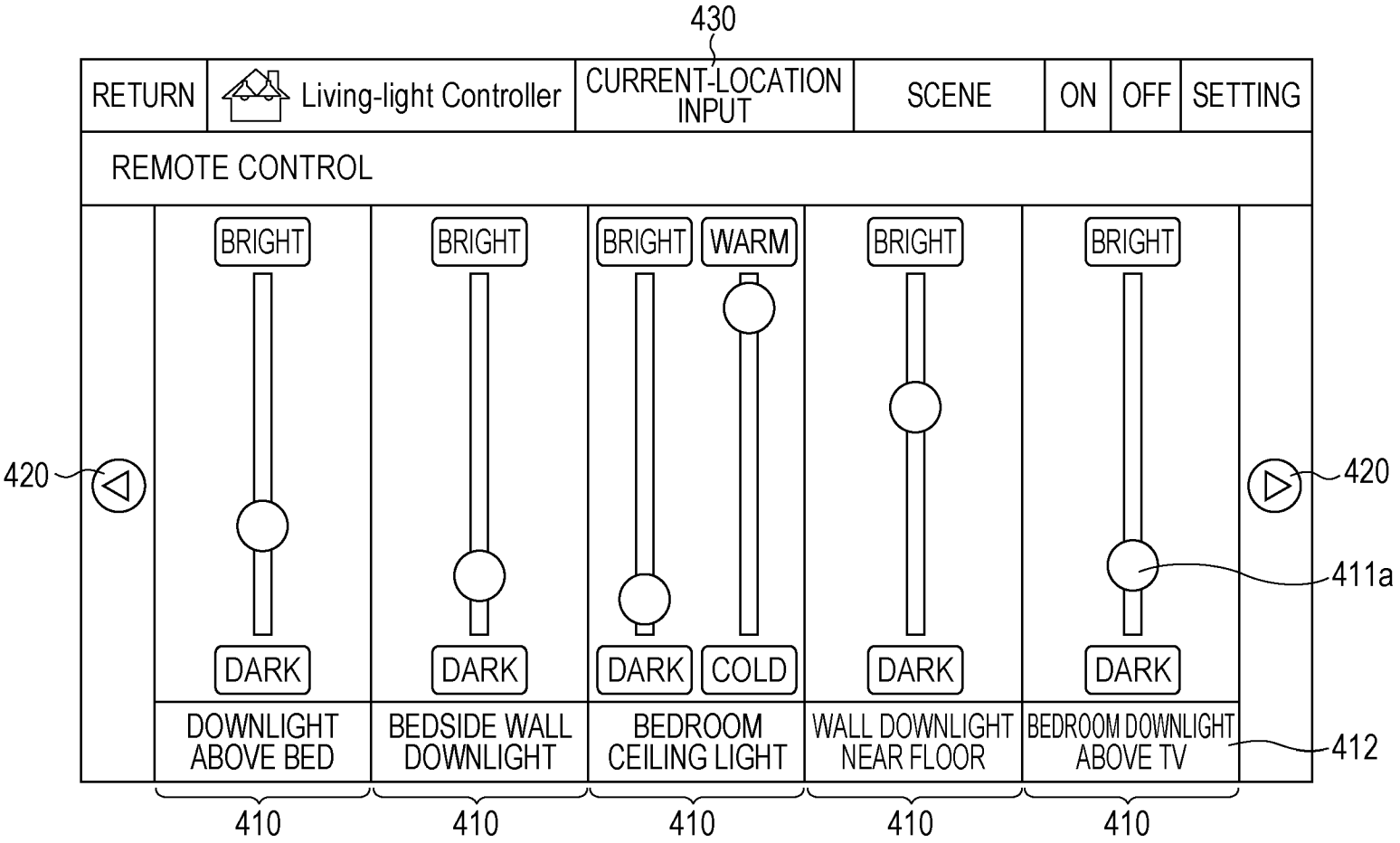
FIG. 5B is a diagram illustrating another example of a remote-control operation screen according to the embodiment.

Next, operation target illumination information managed by the illumination information management unit 150 and a remote-control operation screen created in accordance with operation target illumination information will be described using FIGS. 4 to 5B. FIG. 4 is a diagram illustrating an example of operation target illumination information according to the present embodiment. FIGS. 5A and 5B are diagrams illustrating remote-control operation screens 400 and 401 according to the present embodiment.

Operation target illumination information is information indicating one or more illumination devices that may be controlled by the mobile device 100.

As illustrated in FIG. 4, operation target illumination information includes product numbers (model numbers), illumination device names, illumination device locations (pieces of illumination-device location information) and setting parameters. For each illumination device, a product number, an illumination device name, a piece of illumination-device location information, and setting parameters are associated with the illumination device. That is, the illumination information management unit 150 associates product numbers, illumination device names, pieces of illumination-device location information, and setting parameters with one another on a per-illumination-device basis and performs management.

Product numbers (model numbers) are information indicating the type of illumination device. Specifically, a product number is an identification code defined on the basis of the power consumption, shape, function, and the like of an illumination device.

Illumination device names are names set by a user in order to identify illumination devices. As illustrated in FIG. 4, a user may set names that are easily distinguishable for the user such as "living-room ceiling light", "dining-room light" and the like. Thus, which illumination device needs to be adjusted may easily be determined.

Pieces of illumination-device location information are information indicating locations where respective illumination devices are present. For example, a piece of illumination-device location information is information specifying the room or the area where an illumination device is present such as "living room", "bedroom", or the like.

Setting parameters are information indicating adjustable functions of an illumination device. Specifically, a setting parameter is information indicating the brightness adjustment function, the color adjustment function, or the like. As illustrated in FIG. 4, functions differ from illumination device to illumination device.

Operation target illumination information is information created by a user or the like in advance. In addition, information on a new illumination device may also be added to the operation target illumination information.

For example, in the case where a new illumination device is registered as an operation target, the mobile device 100 causes a user to input a product number of an illumination device to be registered. Specifically, the mobile device 100 displays a screen for inputting a product number of an illumination device and acquires text input through the screen as the product number of the illumination device.

Here, pieces of illumination-device location information are acquired automatically or manually using the device location specifying unit 180. A specific method will be described later using FIGS. 12 to 17.

The mobile device 100 may acquire a setting parameter of an illumination device, which is a target, by verifying the input product number against a predetermined database. Note that the predetermined database is a database in which a plurality of product numbers are associated with setting parameters, and is stored in, for example, a server to which the mobile device 100 may be connected via a network, a memory of the mobile device 100, or the like.

Furthermore, the mobile device 100 causes a user to input a product name of an illumination device to be registered. Specifically, the mobile device 100 displays a screen for causing a user to input a product name of an illumination device and acquires text input through the screen as the product name of the illumination device.

In accordance with such operation target illumination information as described above, a remote-control operation screen is created. For example, the display controller 130 sorts one or more setting screens corresponding to respective one or more illumination devices in accordance with a piece of mobile-device location information and one or more pieces of illumination-device location information, and causes the display unit 120 to display the sorted one or more setting screens. Specifically, the display controller 130 sorts one or more setting screens such that a setting screen corresponding to a piece of illumination-device location information matching the room or the area specified by a piece of mobile-device location information is prioritized among one or more pieces of illumination-device location information and causes the display unit 120 to display the sorted one or more setting screens.

For example, the display controller 130 creates the remote-control operation screen 400 or 401 illustrated in FIG. 5A or 5B in accordance with the operation target illumination information illustrated in FIG. 4 and a piece of mobile-device location information acquired by the device location specifying unit 180 and causes the display unit 120 to display the remote-control operation screen 400 or 401.

The remote-control operation screen 400 or 401 is an operation screen for controlling one or more illumination devices. The remote-control operation screen 400 or 401 is displayed in the case where the remote-control button 360 of the scene selection screen 300 illustrated in FIG. 3 has been selected.

As illustrated in FIG. 5A or 5B, the remote-control operation screen 400 or 401 includes one or more setting screens 410, scroll buttons 420, and a current-location input button 430.

The one or more setting screens 410 are one or more setting screens corresponding to respective one or more illumination devices. Each of the setting screens 410 is a screen for receiving an operation from a user in order to perform setting of a corresponding illumination device such as brightness adjustment, color adjustment, and the like.

As illustrated in FIG. 5A or 5B, the setting screen 410 includes a brightness adjustment slider 411*a*, a color adjustment slider 411*b*, and an illumination device name 412. Note that the brightness adjustment slider 411*a* and the color adjustment slider 411*b* are examples of a slider for setting. As a slider for setting, for example, at least one of the brightness adjustment slider 411*a* and the color adjustment slider 411*b* is displayed in accordance with setting parameters corresponding to an illumination device with reference to operation target illumination information.

The brightness adjustment slider 411*a* is an example of a GUI component, and is a slider for setting a setting value of the brightness adjustment function (a dimming ratio). That is, by operating the brightness adjustment slider 411*a*, a user may adjust the brightness of light emitted from a corresponding illumination device.

For example, the brightness adjustment slider 411*a* may set a dimming ratio to a value of from "0 to 100". In an example illustrated in FIG. 5A or 5B, the more the brightness adjustment slider 411*a* approaches "bright", the more the dimming ratio approaches "100", and light emitted from a corresponding illumination device becomes brighter. In addition, the more the brightness adjustment slider 411*a* approaches "dark", the more the dimming ratio approaches "0", and light emitted from the corresponding illumination device becomes darker.

Note that, for example, in the case of an illumination device having only the turn-on function and the turn-off function, a corresponding brightness adjustment slider 411*a* may have a dimming ratio of only two values, "0" and "100".

The color adjustment slider 411*b* is an example of a GUI component, and is a slider for setting a setting value of the color adjustment function (a color temperature). That is, by operating the color adjustment slider 411*b*, a user may adjust the color of light emitted from a corresponding illumination device.

For example, the color adjustment slider 411*b* may set a color temperature to a value of from "2100 K to 5000 K". In the example illustrated in FIG. 5A or 5B, the more the color adjustment slider 411*b* approaches "warm", the lower the color temperature, and the color of light emitted from a corresponding illumination device becomes warmer. In addition, the more the color adjustment slider 411*b* approaches "cold", the higher the color temperature, and the color of light emitted from the corresponding illumination device becomes colder.

Note that in the case of an illumination device having no color adjustment function, the color adjustment slider 411*b* is not displayed. That is, which illumination device is to display which slider is determined in accordance with setting parameters in the operation target illumination information.

The illumination device name 412 is displayed near a corresponding brightness adjustment slider 411*a* and a corresponding color adjustment slider 411*b*. In the example illustrated in FIG. 5A or 5B, the illumination device name 412 is displayed under a certain slider; however, the illumination device name 412 may also be displayed to the left, right, or above of the slider. In addition, the illumination device name 412 may also be displayed on the slider in a superimposition manner.

The scroll buttons 420 are buttons for changing setting screens 410 for illumination devices, the setting screens 410 being displayed. That is, the scroll buttons 420 are buttons for changing setting targets (operation targets), illumination devices. For example, in the case where illumination devices may be operated the number of which is greater than the maximum number of illumination devices that may be displayed on the remote-control operation screen 400, a user may cause the setting screens 410 of other illumination devices to be displayed by selecting one of the scroll buttons 420 and may perform an operation.

The scroll buttons 420 are an example of a GUI component, and are, for example, push-buttons. Note that the scroll buttons 420 may also be a scroll bar instead of push-buttons.

In the example illustrated in FIG. 5A or 5B, five setting screens 410 are displayed on the remote-control operation screen 400. Here, in the case where seven illumination devices are operation targets, when the input unit 110 detects one of the scroll buttons 420 being pressed, the display controller 130 creates two setting screens 410 corresponding to the remaining two illumination devices and causes the two setting screens 410 to be displayed.

Specifically, the scroll buttons 420 are buttons for changing pages. For example, in the case where one of the scroll buttons 420 has been selected, the display controller 130 changes display of the five setting screens 410 such that only the remaining two setting screens 410 are displayed.

Alternatively, in the case where one of the scroll buttons 420 has been selected, the display controller 130 may perform display by changing setting screens 410 in units of a predetermined number of setting screens 410, the predetermined number being one or greater. For example, in the case where the scroll button 420 on the right side has been selected, the display controller 130 may delete the setting screen 410 for "living-room ceiling light", move and rearrange the remaining four setting screens 410 toward the left, and then display the setting screen 410 for another illumination device.

The current-location input button 430 is an example of a location input button, and is a button for causing a user to input a piece of mobile-device location information. The current-location input button 430 is an example of a GUI component, and is, for example, a push-button.

In the case where the current-location input button 430 has been selected by a user, a current-location selection screen, which will be described later, is displayed for specifying a piece of mobile-device location information. Specifically, in the case where the input unit 110 detects the current-location input button 430 being pressed, the display controller 130 creates a current-location selection screen and causes the display unit 120 to display the current-location selection screen.

Here, by comparing the remote-control operation screen 400 illustrated in FIG. 5A with the remote-control operation screen 401 illustrated in FIG. 5B, a process will be described in which setting screens are sorted in accordance with a piece of mobile-device location information and one or more pieces of illumination-device location information.

The remote-control operation screen 400 illustrated in FIG. 5A is a remote-control operation screen displayed when the location where the mobile device 100 is present is "living room". For example, in the case where a piece of mobile-device location information is information specifying "living room", the display controller 130 assigns a higher display priority to illumination devices present in the "living room" than to other illumination devices. Then, the display controller 130 creates the remote-control operation screen 400 in accordance with assigned display priorities, and causes the display unit 120 to display the remote-control operation screen 400.

Thus, as illustrated in FIG. 5A, setting screens corresponding to the illumination devices present in the "living room" among a plurality of illumination devices are displayed in a prioritized manner. Specifically, setting screens 410 corresponding to illumination devices such as "living-room ceiling light", "dining-room light", "kitchen downlight", and the like present in the "living room" are displayed.

In contrast, the remote-control operation screen 401 illustrated in FIG. 5B is a remote-control operation screen displayed when the location where the mobile device 100 is present is "bedroom". For example, in the case where a piece of mobile-device location information is information specifying "bedroom", the display controller 130 assigns a higher display priority to illumination devices present in the "bedroom" than to other illumination devices. Then, the display controller 130 creates the remote-control operation screen 401 in accordance with assigned display priorities, and causes the display unit 120 to display the remote-control operation screen 401.

Thus, as illustrated in FIG. 5B, setting screens corresponding to the illumination devices present in the "bedroom" among a plurality of illumination devices are displayed in a prioritized manner. Specifically, setting screens 410 corresponding to illumination devices such as "downlight above bed", "bedside wall downlight", "bedroom ceiling light", and the like present in the "bedroom" are displayed.

As described above, the display controller 130 sorts, in a prioritized manner, setting screens corresponding to illumination devices with higher display priorities such that a remote-control operation screen displayed on the display unit 120 differs in accordance with the location where the mobile device 100 is present, and displays the setting screens. Note that a specific example of a process will be described later using FIG. 11 in which display priorities are assigned to a plurality of respective illumination devices.

For example, in the case where the number of setting screens that may be displayed on one screen is N (N is a natural number), the display controller 130 creates the remote-control operation screen 400 or 401 including setting screens 410 corresponding to N illumination devices having the highest to Nth highest display priorities.

Note that in the case where the scroll buttons 420 are buttons for changing pages, when one of the scroll buttons 420 is selected, setting screens corresponding to N illumination devices having the N+1th highest to 2Nth highest display priorities are displayed. In contrast, in the case where the scroll buttons 420 are buttons for changing setting screens, for example, one by one, when one of the scroll buttons 420 is selected, a setting screen corresponding to the illumination device having the N+1th highest display priority is displayed instead of a setting screen corresponding to the illumination device having the highest display priority.

Note that, in FIG. 5A or 5B, a text box may also be displayed instead of the brightness adjustment slider 411*a* and the color adjustment slider 411*b*. The input unit 110 may also acquire a numerical value input into the text box as a dimming ratio or a color temperature.

Alternatively, for example, in the case of a dimming ratio, radio buttons, check boxes, a drop-down list box, or a list box having choices of "0", "20", "40", "60", "80", "100", and the like may also be displayed. Additionally, various GUI components may be used for performing setting of brightness adjustment and color adjustment.

Note that an initial position of each slider when the remote-control operation screen 400 or 401 is displayed may also be a position corresponding to a predetermined default value, or may also be a position corresponding to a setting value indicating an illumination state of a current space. For example, default values include a dimming ratio of "0", "50", "100", and the like and a color temperature of "2100 K", "3500 K", "5000 K", and the like.

Figure 6A:
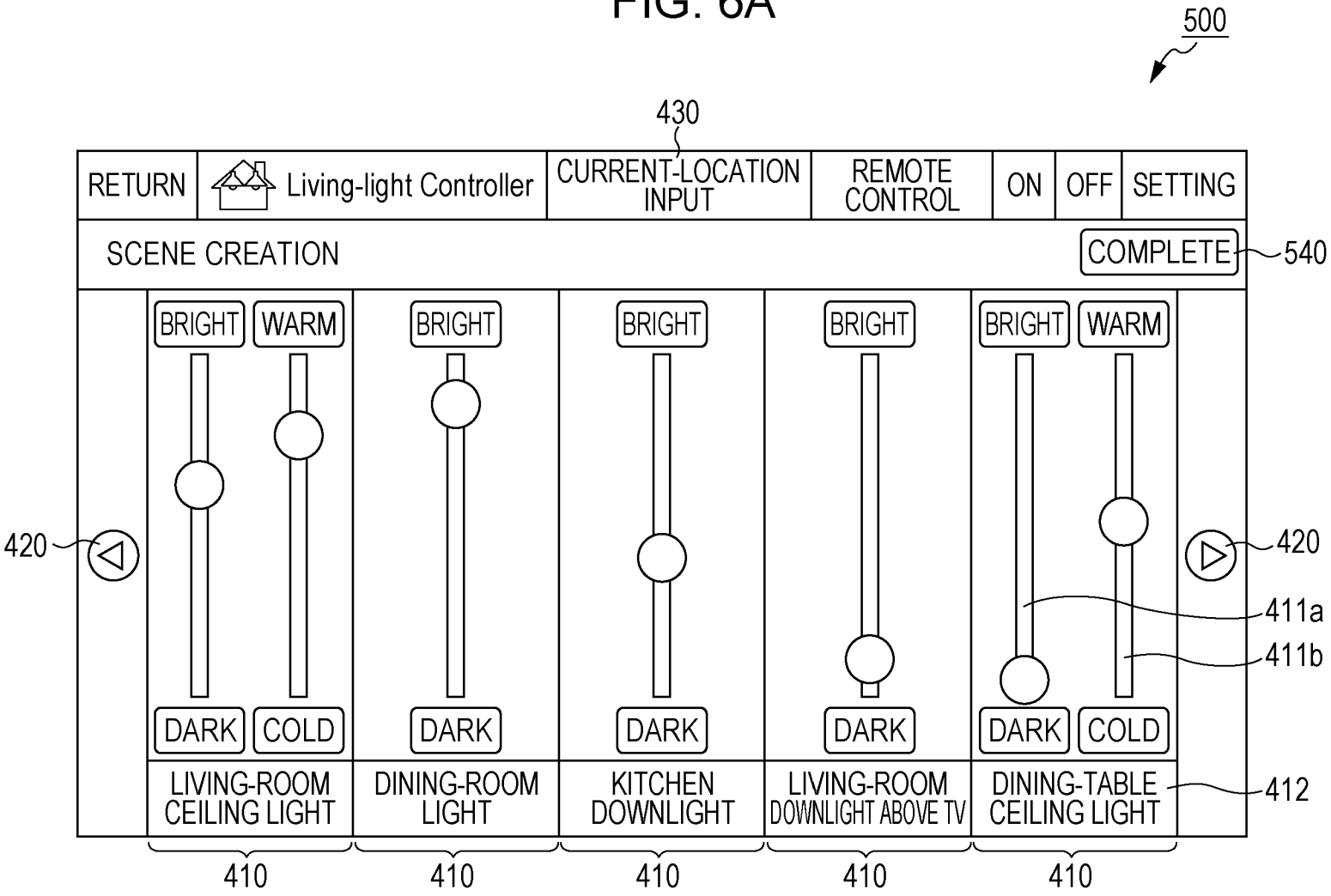
FIG. 6A is a diagram illustrating an example of a scene creation screen according to the embodiment.

Next, a scene creation screen created by the display controller 130 will be described using FIG. 6A. FIG. 6A is a diagram illustrating a scene creation screen 500 according to the present embodiment.

The scene creation screen 500 is an example of a scene setting screen, and a screen for creating a new scene different from existing scenes. The scene creation screen 500 is displayed in the case where the creation button 330 of the scene selection screen 300 illustrated in FIG. 3 has been selected.

As illustrated in FIG. 6A, the scene creation screen 500 includes one or more setting screens 410, the scroll buttons 420, the current-location input button 430, and a complete button 540. Note that, here, description of points the same as those of the remote-control operation screen 400 or 401 illustrated in FIG. 5A or 5B is omitted and points different from those of the remote-control operation screen 400 or 401 will be mainly described.

The complete button 540 is an example of a setting complete button, and a button for completing setting of one or more illumination devices. That is, the complete button 540 is a button for completing setting of an illumination state created by one or more illumination devices. Specifically, the complete button 540 is a button for completing setting of a dimming ratio and a color temperature.

The complete button 540 is an example of a GUI component, and is, for example, a push-button. In the case where the complete button 540 has been selected by a user, setting of brightness adjustment and color adjustment is completed for one or more illumination devices. For example, in the case where the input unit 110 detects the complete button 540 being pressed, the display controller 130 creates a scene-name input screen and causes the display unit 120 to display the scene-name input screen.

Figure 6B:
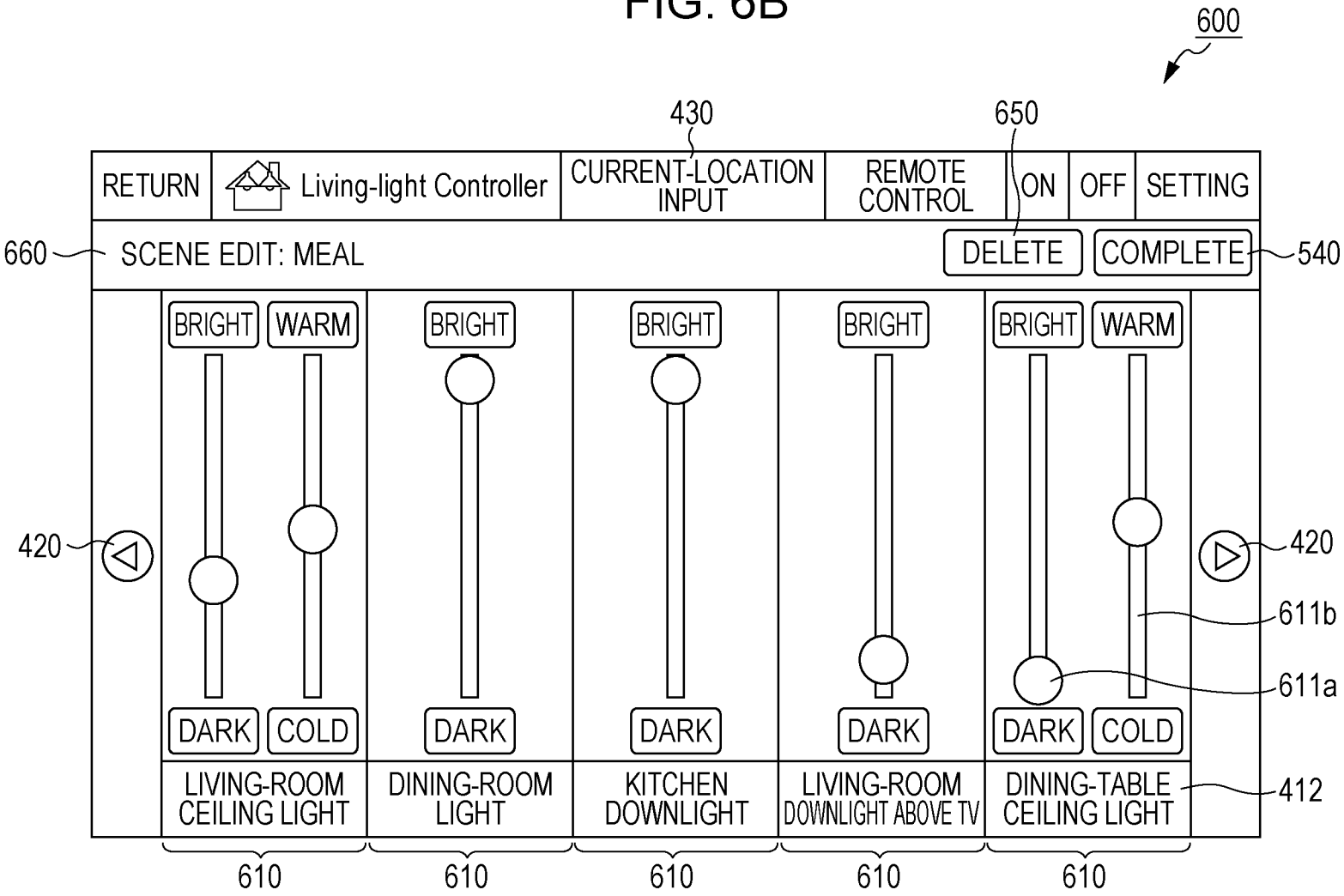
FIG. 6B is a diagram illustrating an example of a scene edit screen according to the embodiment.

Next, a scene edit screen created by the display controller 130 will be described using FIG. 6B. FIG. 6B is a diagram illustrating a scene edit screen 600 according to the present embodiment.

The scene edit screen 600 is an example of a scene setting screen, and a screen for setting a new scene by editing an existing scene. The scene edit screen 600 is displayed in the case where the edit button 340 has been selected in a state in which one scene icon 310 has been selected on the scene selection screen 300 illustrated in FIG. 3.

As illustrated in FIG. 6B, the scene edit screen 600 includes setting screens 610, the scroll buttons 420, the current-location input button 430, the complete button 540, a delete button 650, and a scene name 660.

One or more setting screens 610 are screens for setting a new scene indicating a new illumination state created by one or more illumination devices, the new illumination state being set by editing a scene corresponding to a selected scene. Specifically, the one or more setting screens 610 are screens for setting a new scene by editing an existing scene. As illustrated in FIG. 6B, the setting screens 610 include brightness adjustment sliders 611*a*, color adjustment sliders 611*b*, and the illumination device names 412.

In the case where the brightness adjustment sliders 611*a* and the color adjustment sliders 611*b* are compared with the brightness adjustment sliders 411*a* and the color adjustment sliders 411*b* illustrated in FIG. 6A, respectively, initial positions are different at the point in time when the scene edit screen 600 is displayed. Other points are the same for the brightness adjustment sliders 611*a* and the brightness adjustment sliders 411*a* and for the color adjustment slider 611*b* and the color adjustment sliders 411*b*.

The initial positions of the brightness adjustment sliders 611*a* and the color adjustment sliders 611*b* are determined in accordance with setting information corresponding to a selected scene. That is, an illumination state set through the setting screens 610 before a user performs an operation is an illumination state indicated by a scene corresponding to a selected scene icon.

For example, in the case where the "meal" scene has been selected as illustrated in FIG. 6B, the initial positions of the brightness adjustment sliders 611*a* and the color adjustment sliders 611*b* are determined in accordance with setting information on illumination devices corresponding to the "meal" scene, using the scene information illustrated in FIG. 2. Specifically, for "living-room ceiling light", since an initial value of the dimming ratio is "30" and an initial value of the color temperature is "3500 K", the brightness adjustment slider 611*a* and the color adjustment slider 611*b* are displayed such that initial positions are positions corresponding to "30" and "3500 K", respectively.

The delete button 650 is a button for deleting a selected scene. The delete button 650 is an example of a GUI component and is, for example, a push-button. In the case where the delete button 650 has been selected by a user, a scene name, a scene icon, and setting information corresponding to a selected scene are deleted from the scene information.

A scene name 660 is information indicating a scene, which is an edit target. For example, a scene name 660 corresponds to a scene name 320 corresponding to the scene icon 310 selected on the scene selection screen 300 illustrated in FIG. 3. Since a scene name 660 is displayed, a user may check what scene is being edited currently.

Figure 7:
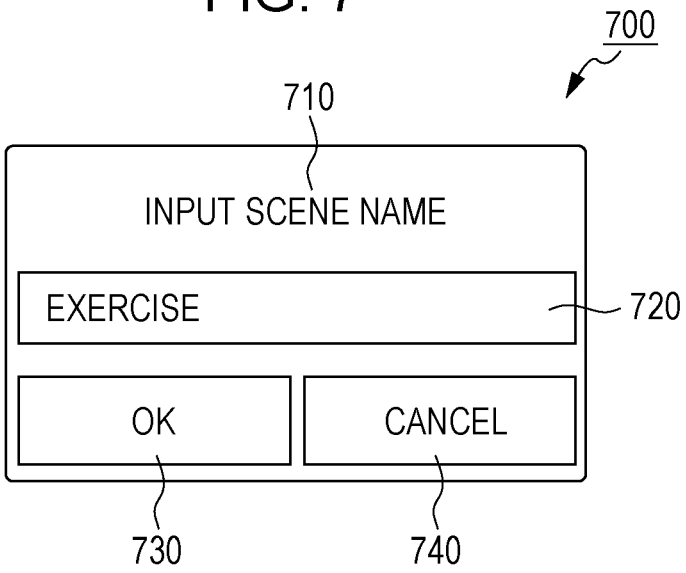
FIG. 7 is a diagram illustrating an example of a scene-name input screen according to the embodiment.

Next, a scene-name input screen created by the display controller 130 will be described using FIG. 7. FIG. 7 is a diagram illustrating a scene-name input screen 700 according to the present embodiment.

The scene-name input screen 700 is a screen for causing a user to input a scene name. The scene-name input screen 700 is displayed after setting of one or more illumination devices has been completed. Specifically, the scene-name input screen 700 is displayed in the case where the complete button 540 of the scene creation screen 500 illustrated in FIG. 6A or of the scene edit screen 600 illustrated in FIG. 6B has been selected.

As illustrated in FIG. 7, the scene-name input screen 700 includes a comment 710, a text box 720, a confirmation button 730, and a cancel button 740.

The comment 710 is text for presenting an operation that a user should perform. Specifically, the comment 710 is text for prompting a user to input a scene name. For example, the comment 710, which is "Input scene name", is displayed as illustrated in FIG. 7. Note that, instead of by the comment 710, a user may also be prompted by voice to input a scene name.

The text box 720 is an example of a GUI component, and is an interface for a user to input text. In the text box 720, text input by a user is displayed. For example, in the case where a user has input "exercise", "exercise" is displayed in the text box 720 as illustrated in FIG. 7.

Specifically, the input unit 110 acquires text input by a user. Then, the display controller 130 creates the scene-name input screen 700 such that the text acquired by the input unit 110 is displayed in the text box 720, and causes the display unit 120 to display the scene-name input screen 700.

The confirmation button 730 is an example of a GUI component, and is, for example, a push-button. The confirmation button 730 is a button for causing a user to confirm that scene name input has been completed.

In the case where the confirmation button 730 has been selected, the text input into the text box 720 is stored as a scene name in a memory. Specifically, in the case where the input unit 110 detects the confirmation button 730 being pressed, the illumination information management unit 150 manages the text input into the text box 720 as a scene name.

The cancel button 740 is an example of a GUI component, and is, for example, a push-button. The cancel button 740 is a button for causing a user to confirm that scene name input is to be terminated.

In the case where the cancel button 740 has been selected, scene name input is terminated, for example, the scene creation screen 500 or the scene edit screen 600 is displayed on the display unit 120, and setting of illumination devices may be performed again. Note that, in the case where the cancel button 740 has been selected, a scene creation process or a scene edit process may also be terminated. That is, in the case where the cancel button 740 has been selected, the scene selection screen 300 may also be displayed.

Note that, although an example has been described in which the scene-name input screen 700 is displayed in the case where the complete button 540 has been selected, examples are not limited to this example. For example, the scene-name input screen 700 may also be displayed before setting of one or more illumination devices is completed. Specifically, the scene-name input screen 700 may also be displayed in the case where the creation button 330 or the edit button 340 of the scene selection screen 300 illustrated in FIG. 3 has been selected. Alternatively, when the scene creation screen 500 or the scene edit screen 600 is displayed, the text box 720 may also be displayed simultaneously with the scene creation screen 500 or the scene edit screen 600.

Figure 8:
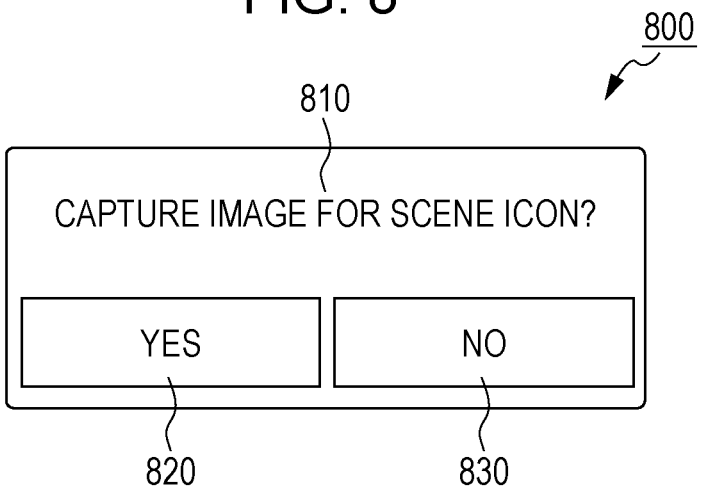
FIG. 8 is a diagram illustrating an example of an image-capturing confirmation screen according to the embodiment.

Next, an image-capturing confirmation screen created by the display controller 130 will be described using FIG. 8. FIG. 8 is a diagram illustrating an image-capturing confirmation screen 800 according to the present embodiment.

The image-capturing confirmation screen 800 is a screen for requesting confirmation as to whether or not an image for a scene icon is to be captured from a user. In other words, the image-capturing confirmation screen 800 is a screen for confirming whether or not image capturing is to be performed by the image capturing unit 140.

The image-capturing confirmation screen 800 is displayed after setting of one or more illumination devices is completed. For example, the image-capturing confirmation screen 800 is displayed after the complete button 540 of the scene creation screen 500 or of the scene edit screen 600 has been selected. Specifically, the image-capturing confirmation screen 800 is displayed in the case where the confirmation button 730 of the scene-name input screen 700 has been selected.

As illustrated in FIG. 8, the image-capturing confirmation screen 800 includes a comment 810, an agree button 820, and a disagree button 830.

The comment 810 is text for presenting an operation that a user should perform. Specifically, the comment 810 is text for requesting a confirmation as to whether or not image capturing is to be performed by the image capturing unit 140 from a user. For example, the comment 810, which is "Capture image for scene icon?", is displayed as illustrated in FIG. 8. Note that, instead of by the comment 810, such a confirmation may also be requested by voice from a user.

The agree button 820 is an example of a GUI component, and is, for example, a push-button. The agree button 820 is an example of a startup button for starting up the image capturing unit 140, and is a button for expressing agreement for the comment 810.

In the case where the agree button 820 has been selected, the image capturing unit 140 is started up. Specifically, in the case where the input unit 110 detects the agree button 820 being pressed, the image capturing unit 140 enters a state in which image capturing is possible.

The disagree button 830 is an example of a GUI component, and is, for example, a push-button. The disagree button 830 is an example of a non-startup button for causing the image capturing unit 140 not to start up, and is a button for expressing disagreement for the comment 810.

In the case where the disagree button 830 has been selected, the image capturing unit 140 is not started up. That is, in the case where the disagree button 830 has been selected, the image capturing unit 140 is not started up and a default image is stored instead of a captured image as a scene icon in the memory. Specifically, in the case where the input unit 110 detects the disagree button 830 being pressed, the illumination information management unit 150 manages a predetermined default image as a scene icon.

Note that, although an example has been described in which the image-capturing confirmation screen 800 is displayed in the case where the confirmation button 730 of the scene-name input screen 700 has been selected, examples are not limited to this example. For example, the image-capturing confirmation screen 800 may also be displayed when the complete button 540 of the scene creation screen 500 or of the scene edit screen 600 has been selected.

Figure 9A:
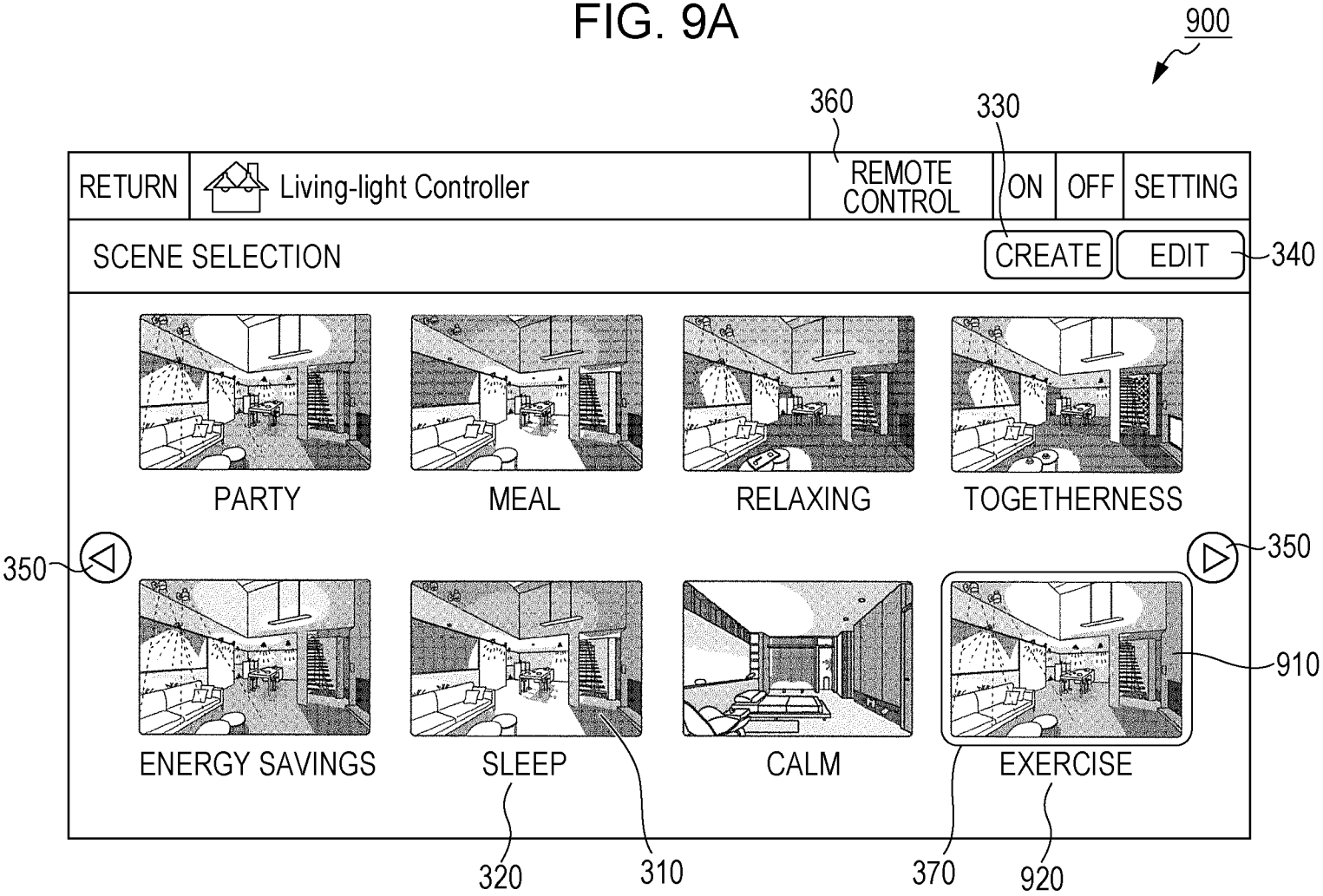
FIG. 9A is a diagram illustrating an example of a new scene selection screen according to the embodiment.

Next, a new scene selection screen created by the display controller 130 will be described using FIG. 9A. FIG. 9A is a diagram illustrating a new scene selection screen 900 according to the present embodiment.

The new scene selection screen 900 is a scene selection screen displayed after setting of a new scene is completed. Specifically, the new scene selection screen 900 is a screen in which a scene icon of a new scene has been added to an existing scene selection screen.

The new scene selection screen 900 includes one or more scene icons 310, scene names 320, a scene icon 910 of the new scene, and a scene name 920 of the new scene. For example, the new scene selection screen 900 is displayed in the case where image capturing performed by the image capturing unit 140 is completed.

The scene icon 910 is a scene icon of the new scene added to an existing scene selection screen (for example, the scene selection screen 300 illustrated in FIG. 3). Specifically, the scene icon 910 is an image acquired by the image capturing unit 140. For example, the scene icon 910 is an image acquired by capturing an image of a space illuminated in a certain illumination state indicated by the new scene. Specifically, the scene icon 910 is an image acquired by the image capturing unit 140 in the case where the agree button 820 of the image-capturing confirmation screen 800 illustrated in FIG. 8 has been selected.

The scene name 920 is the scene name of the new scene. Specifically, the scene name 920 is text input into the text box 720 of the scene-name input screen 700 illustrated in FIG. 7.

Note that the scene icon 910 of the new scene is displayed on the new scene selection screen 900, in a state in which the new scene is selected. Specifically, as illustrated in FIG. 9A, the scene icon 910 of the new scene is surrounded by a frame 370. Here, one or more illumination devices illuminate a space in a certain illumination state indicated by the new scene.

Figure 9B:
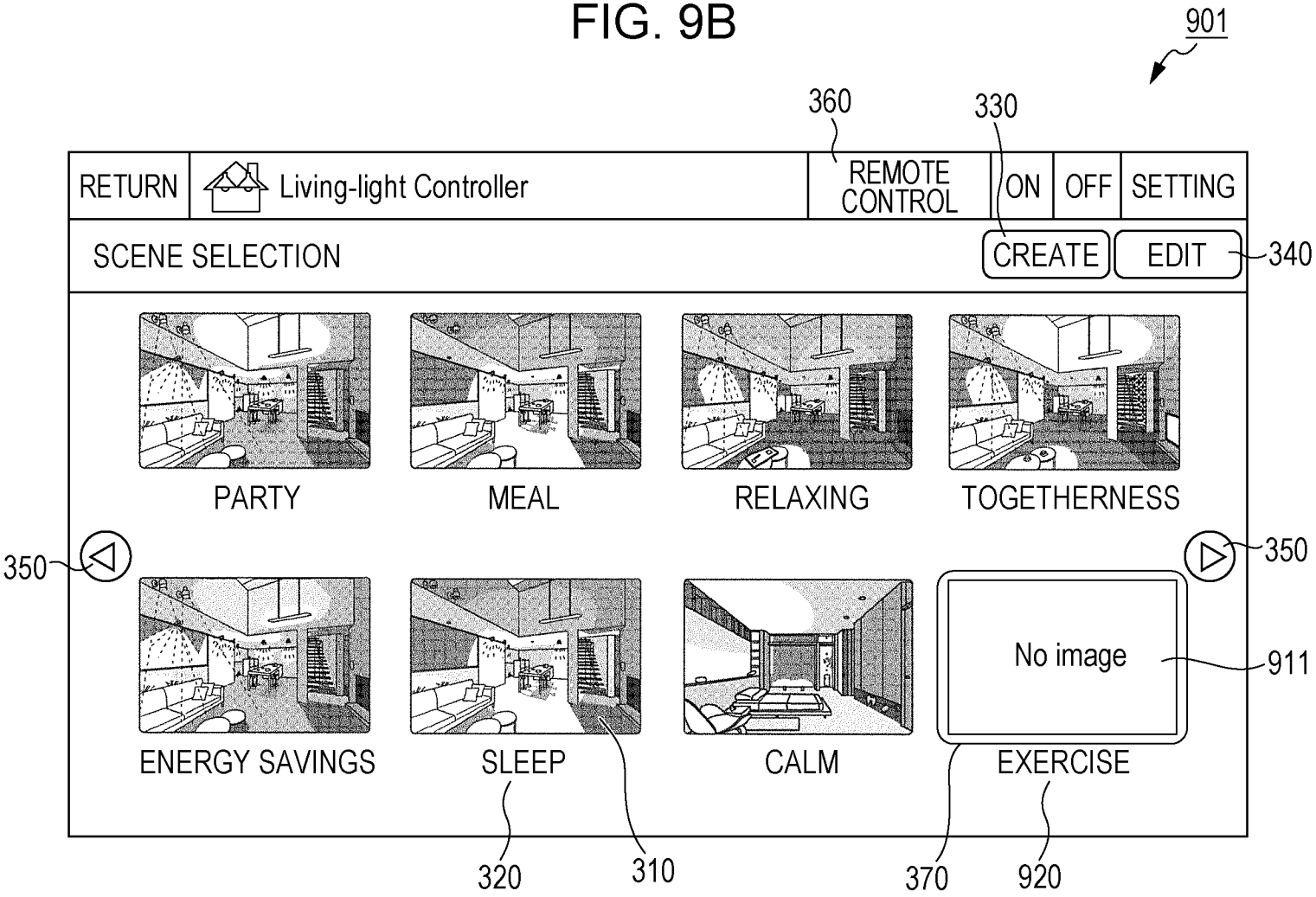
FIG. 9B is a diagram illustrating another example of a new scene selection screen according to the embodiment.

Here, another example of a new scene selection screen created by the display controller 130 will be described using FIG. 9B. FIG. 9B is a diagram illustrating a new scene selection screen 901 according to an embodiment.

The new scene selection screen 901 is a scene selection screen displayed after setting of a new scene is completed. Specifically, the new scene selection screen 901 is a screen obtained by adding a scene icon of a new scene to an existing scene selection screen.

The new scene selection screen 901 includes a scene icon 911 of the new scene and the scene name 920. For example, the new scene selection screen 901 is displayed in the case where the disagree button 830 of the image-capturing confirmation screen 800 illustrated in FIG. 8 has been selected.

The scene icon 911 is a scene icon of the new scene added to an existing scene selection screen (for example, the scene selection screen 300 illustrated in FIG. 3). Specifically, the scene icon 911 is a default image.

In this manner, in the case where image capturing has not been performed by the image capturing unit 140, the default image is displayed as the scene icon 911 of the new scene.

Note that the scene icon 911 of the new scene is displayed on the new scene selection screen 901, in a state in which the scene icon 911 of the new scene is selected. Specifically, as illustrated in FIG. 9B, the scene icon 911 of the new scene is surrounded by the frame 370. Here, one or more illumination devices illuminate a space with a certain illumination state indicated by the new scene.

Figure 10:
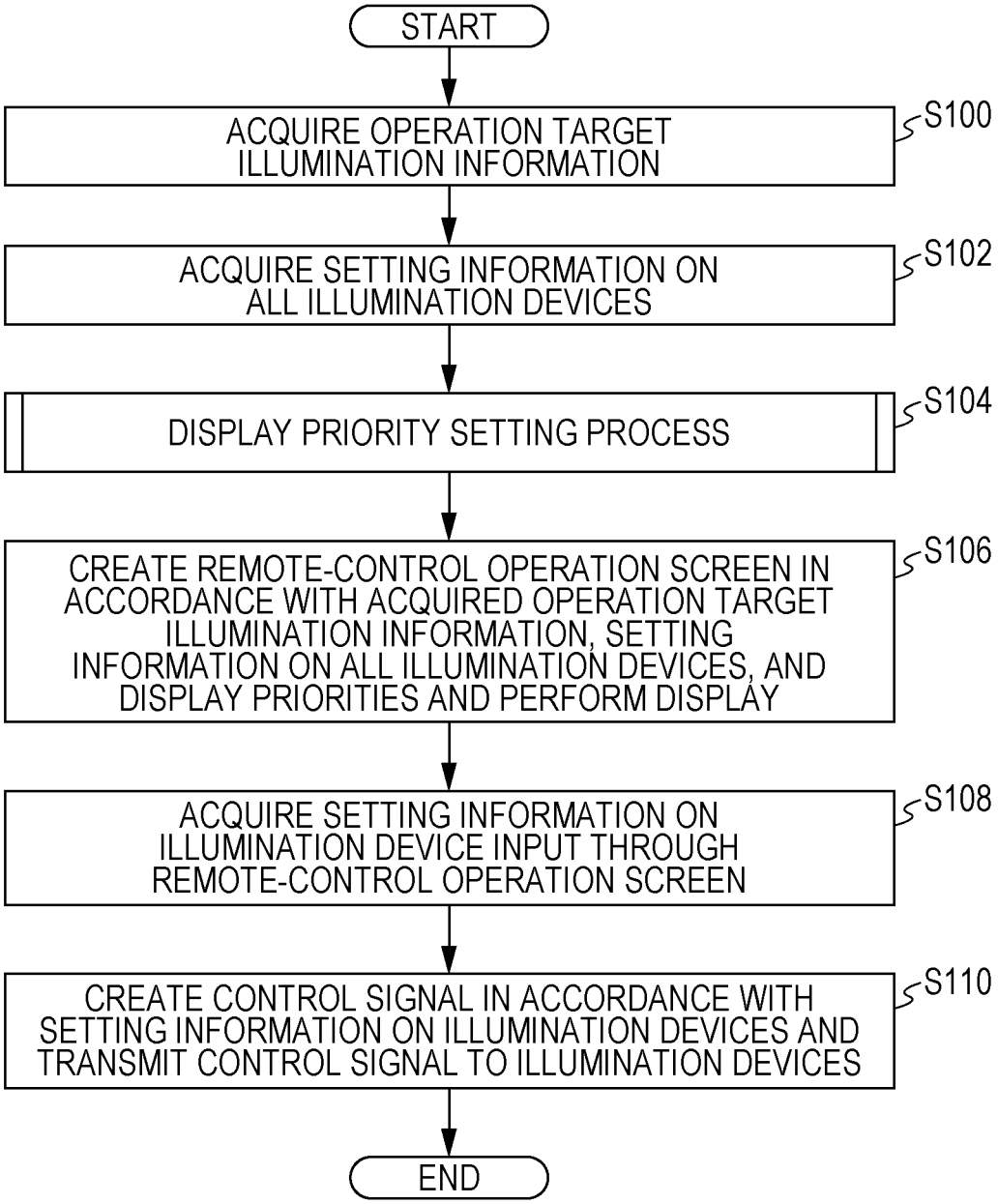
FIG. 10 is a flowchart illustrating an example of a control method for an illumination device according to the embodiment.
Figure 11:
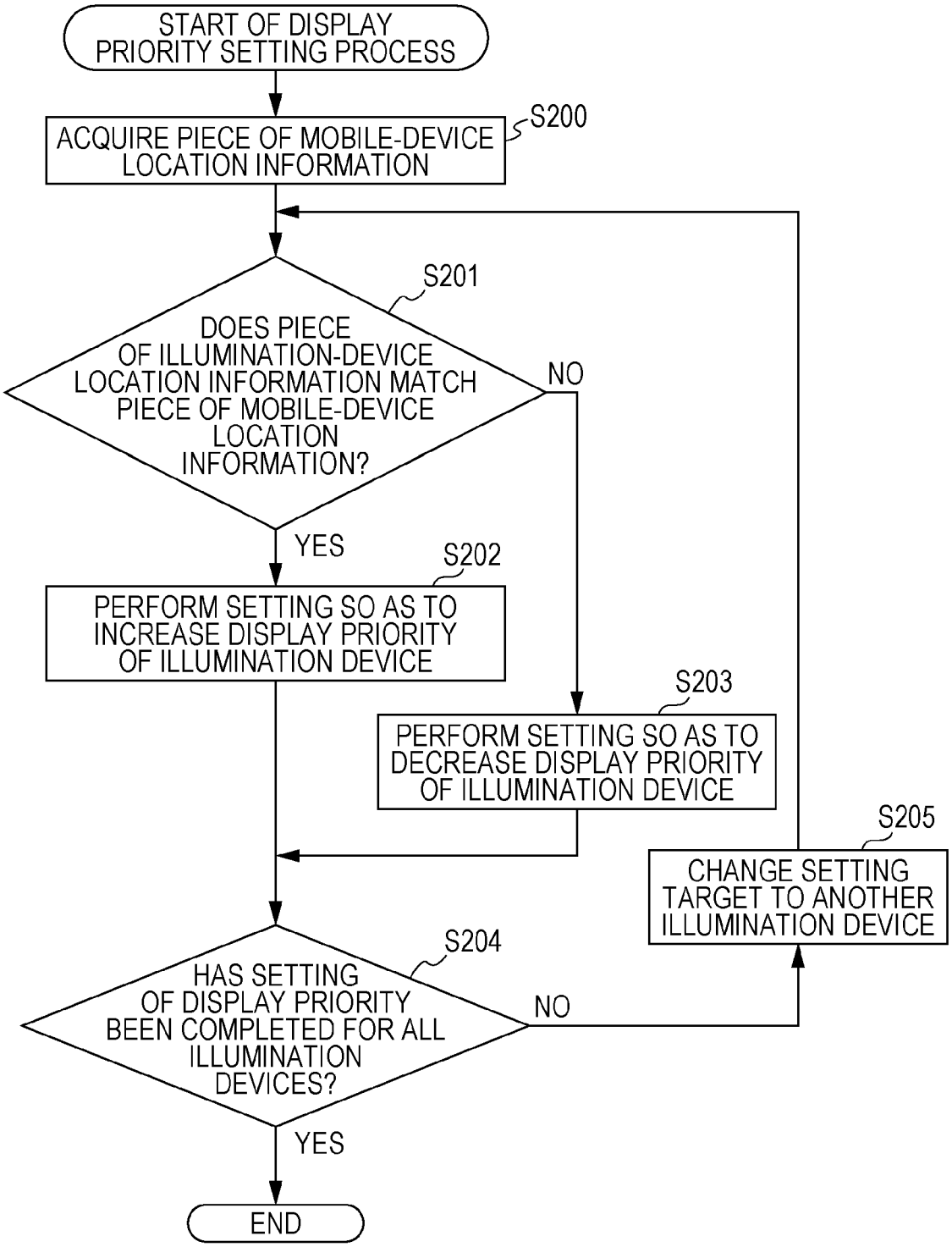
FIG. 11 is a flowchart illustrating an example of a setting method for display priorities according to the embodiment.

Next, a control method for an illumination device according to the present embodiment will be described using FIGS. 10 and 11, the control method being performed by the mobile device 100. FIG. 10 is a flowchart illustrating an example of a control method for an illumination device according to the present embodiment. FIG. 11 is a flowchart illustrating an example of a setting method for display priorities according to the present embodiment.

For example, a control method for an illumination device according to the present embodiment is realized by an application software program or the like for controlling one or more illumination devices, the control method being performed by the mobile device 100. For example, the control method for an illumination device according to the present embodiment is started by starting the application software program. Alternatively, the control method according to the present embodiment may also be started when the remote-control button 360 is selected on the scene selection screen 300 illustrated in FIG. 3.

First, as illustrated in FIG. 10, the display controller 130 acquires the operation target illumination information (S100). Specifically, the display controller 130 reads and acquires the operation target illumination information stored in the illumination information management unit 150. The operation target illumination information is information indicating one or more illumination devices that have already been registered, for example, as illustrated in FIG. 4.

Next, the display controller 130 acquires setting information on all the illumination devices (S102). Specifically, the display controller 130 acquires a setting value of the brightness adjustment function (a dimming ratio), a setting value of the color adjustment function (a color temperature), and the like of all the illumination devices individually from the illumination devices via the communication unit 170. That is, the display controller 130 acquires all the illumination states created by the illumination devices as of this point in time.

Next, the display controller 130 performs a display priority setting process in accordance with the acquired operation target illumination information (S104). A detailed process will be described using FIG. 11.

As illustrated in FIG. 11, first, the device location specifying unit 180 acquires a piece of mobile-device location information indicating the location where the mobile device 100 is present (S200). That is, the device location specifying unit 180 acquires information for specifying the current location of the mobile device 100 as a piece of mobile-device location information. An acquisition method for a piece of mobile-device location information will be described later using FIGS. 12 to 17, the acquisition method being performed by the device location specifying unit 180.

Next, the display controller 130 determines whether or not a piece of illumination-device location information matches the piece of mobile-device location information (S201). Specifically, the display controller 130 determines whether or not one of one or more pieces of illumination-device location information included in the operation target illumination information matches the piece of mobile-device location information acquired using the device location specifying unit 180. For example, the display controller 130 determines whether or not the room or the area specified by a piece of illumination-device location information matches the room or the area specified by the piece of mobile-device location information.

In the case where a piece of illumination-device location information matches the piece of mobile-device location information (Yes in S201), the display controller 130 performs setting so as to increase the display priority of an illumination device corresponding to the piece of illumination-device location information (S202). Specifically, the display controller 130 sets the display priority such that a display priority is set that is relatively higher than that in the case where the piece of illumination-device location information does not match the piece of mobile-device location information.

In contrast, in the case where the piece of illumination-device location information does not match the piece of mobile-device location information (No in S201), the display controller 130 performs setting so as to decrease the display priority of the illumination device corresponding to the piece of illumination-device location information (S203). Note that the illumination information management unit 150 temporarily manages the set display priority by associating, for example, the set display priority with the illumination device.

Next, the display controller 130 determines whether or not setting of a display priority has been completed for all the illumination devices (S204). In the case where setting of display priorities has not been completed (No in S204), the display controller 130 changes a setting target to another illumination device for which a display priority has not been set (S205), makes a location information comparison (S201), and performs setting of a display priority (S202 or S203).

In the case where setting of a display priority has been completed for all the illumination devices included in the operation target illumination information (Yes in S204), the display priority setting process is completed.

In accordance with the above-described operation, for example, the piece of mobile-device location information is information specifying "living room", the display controller 130 performs setting so as to increase the display priorities of illumination devices present in the "living room". In contrast, the display controller 130 sets display priorities of illumination devices present in other locations such as "bedroom" and the like, such that the display priorities lower than those of the illumination devices present in the "living room" are set.

Next, as illustrated in FIG. 10, the display controller 130 creates a remote-control operation screen in accordance with the operation target illumination information, the setting information on all the illumination devices, and the display priorities, and causes the display unit 120 to display the remote-control operation screen (S106). For example, the display controller 130 creates a remote-control operation screen by sorting setting screens of one or more illumination devices in descending order of display priority and causes the display unit 120 to display the remote-control operation screen.

As a result, for example, in the case where the piece of mobile-device location information is information specifying "living room", the remote-control operation screen 400 is displayed on the display unit 120 as illustrated in FIG. 5A, the remote-control operation screen 400 displaying the setting screens for the illumination devices present in the "living room" in a prioritized manner. In addition, for example, in the case where the piece of mobile-device location information is information specifying "bedroom", the remote-control operation screen 401 is displayed on the display unit 120 as illustrated in FIG. 5B, the remote-control operation screen 401 displaying the setting screens for the illumination devices present in the "bedroom" in a prioritized manner.

Note that, here, a setting value of the brightness adjustment slider 411*a* and a setting value of the color adjustment slider 411*b* of each setting screen 410 are determined in accordance with the setting information on all the illumination devices. That is, the display controller 130 creates the remote-control operation screen 400 or 401 such that each of the sliders is displayed using a position corresponding to the current illumination state as an initial position in accordance with the setting information on illumination devices acquired via the input unit 110.

Next, the illumination controller 160 acquires the setting information on an illumination device input by a user through the remote-control operation screen 400 or 401 (S108). The user may set a setting value of the brightness adjustment function or the color adjustment function of each of the one or more illumination devices through the remote-control operation screen 400 or 401. The illumination controller 160 acquires, for example, a setting value indicated by the brightness adjustment slider 411*a* or the color adjustment slider 411*b* via the input unit 110, the brightness adjustment slider 411*a* or the color adjustment slider 411*b* having been operated by the user.

Then, the illumination controller 160 creates a control signal for controlling the one or more illumination devices in accordance with setting information indicated by an illumination state set through the user's operation performed through the setting screens 410 and transmits the control signal to the one or more illumination devices (S110). Specifically, the illumination controller 160 transmits the created control signal to the one or more illumination devices via the communication unit 170 and a network. As a result, the illumination state created by the one or more illumination devices is changed as needed in synchronization with the user's operation.

For example, in the case where the user has operated the brightness adjustment slider 411*a* of "living-room ceiling light" among the one or more illumination devices, an actual brightness of the "living-room ceiling light" is changed in accordance with the user's operation. For example, in the case where the user has operated the brightness adjustment slider 411*a* such that a dimming ratio of the "living-room ceiling light" is set to "100", the "living-room ceiling light" becomes brightest and illuminates the space.

As described above, according to the control method for an illumination device according to the present embodiment, the control method being performed by the mobile device 100, one or more setting screens are sorted in accordance with a piece of mobile-device location information and one or more pieces of illumination-device location information and are displayed. Thus, a remote-control operation screen appropriate for the location where the mobile device 100 is present may be created. Thus, such a remote-control operation screen may allow the user to easily adjust an illumination state created by one or more illumination devices.

Next, a specific configuration for specifying the location of a mobile device will be described using FIGS. 12 to 17. First, a configuration for automatically acquiring location information specifying the location of a mobile device will be described using FIGS. 12 to 15. FIGS. 12 to 15 are block diagrams illustrating examples of a configuration for acquiring a piece of mobile-device location information according to the present embodiment.

Note that FIGS. 12 to 15 illustrate configurations for automatically acquiring location information using different means. The mobile device 100 according to the present embodiment has only to use, for example, any one of the means illustrated in FIGS. 12 to 15, or may also use a means different from the means illustrated in FIGS. 12 to 15.

Note that location information on the mobile device 100 is information specifying the location where the mobile device 100 is present. Both a piece of mobile-device location information and pieces of illumination-device location information are information based on location information on the mobile device 100. Specifically, the piece of mobile-device location information is information for specifying the location where the mobile device 100 is currently present, and the pieces of illumination-device location information are information for specifying the location where the mobile device 100 is present when illumination devices are registered. The piece of mobile-device location information and the pieces of illumination-device location information are information based on location information acquired by the same means, which is, for example, any of the means illustrated in FIGS. 12 to 15.

First, the case where a wireless LAN function is used will be described using FIG. 12.

Figure 12:
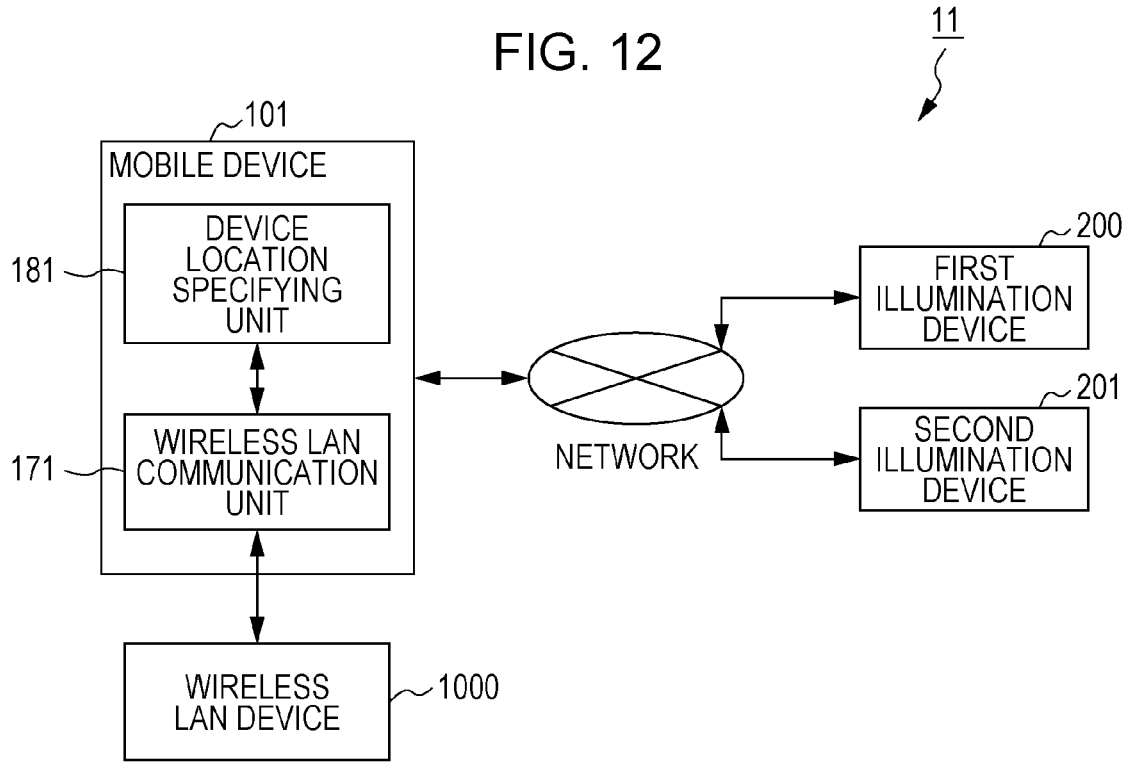
FIG. 12 is a block diagram illustrating an example of a configuration for acquiring location information on a mobile device according to the embodiment.

An illumination system 11 illustrated in FIG. 12 is an example of the illumination system 10 illustrated in FIG. 1, and includes a mobile device 101, the first illumination device 200, the second illumination device 201, and a wireless LAN device 1000.

Note that, in FIG. 12, although only one wireless LAN device 1000 is illustrated, the illumination system 11 includes a plurality of wireless LAN devices 1000. The plurality of wireless LAN devices 1000 are arranged in, for example, respective rooms or areas.

The wireless LAN device 1000 performs communication based on the wireless LAN standard. A unique identifier is set for the wireless LAN device 1000. For example, a Service Set Identifier (SSID) is set for the wireless LAN device 1000. The wireless LAN device 1000 periodically transmits wireless signal information including the SSID.

The mobile device 101 is an example of the mobile device 100 illustrated in FIG. 1, and specifies the location where the mobile device 101 itself is present using the wireless LAN function. The mobile device 101 includes a wireless LAN communication unit 171 and a device location specifying unit 181.

The wireless LAN communication unit 171 may communicate with the wireless LAN device 1000. The wireless LAN communication unit 171 acquires wireless signal information transmitted from the wireless LAN device 1000.

Note that the wireless LAN communication unit 171 may also be the same as the communication unit 170 illustrated in FIG. 1. That is, the mobile device 101 may also be capable of communicating with the first illumination device 200 and the second illumination device 201 via the wireless LAN communication unit 171 and the wireless LAN device 1000.

The device location specifying unit 181 is an example of the device location specifying unit 180 illustrated in FIG. 1, and specifies the location where the mobile device 101 is present in accordance with the identifier unique to the wireless LAN device 1000 and included in wireless signal information transmitted by the wireless LAN device 1000. For example, the device location specifying unit 181 specifies the location where the mobile device 101 is present using the SSID included in wireless signal information received by the wireless LAN communication unit 171.

For example, the location where the wireless LAN device 1000 is present is registered in advance in association with an SSID in the wireless LAN device 1000 or the mobile device 101. As a result, the device location specifying unit 181 specifies the location where the mobile device 101 is present by acquiring the SSID.

In this manner, the location of a mobile device may be automatically specified using wireless LAN communication and location information may be acquired. As a result, the display controller 130 may acquire a piece of mobile-device location information and pieces of illumination-device location information.

Next, the case where a BLUETOOTH communication function is used will be described using FIG. 13.

Figure 13:
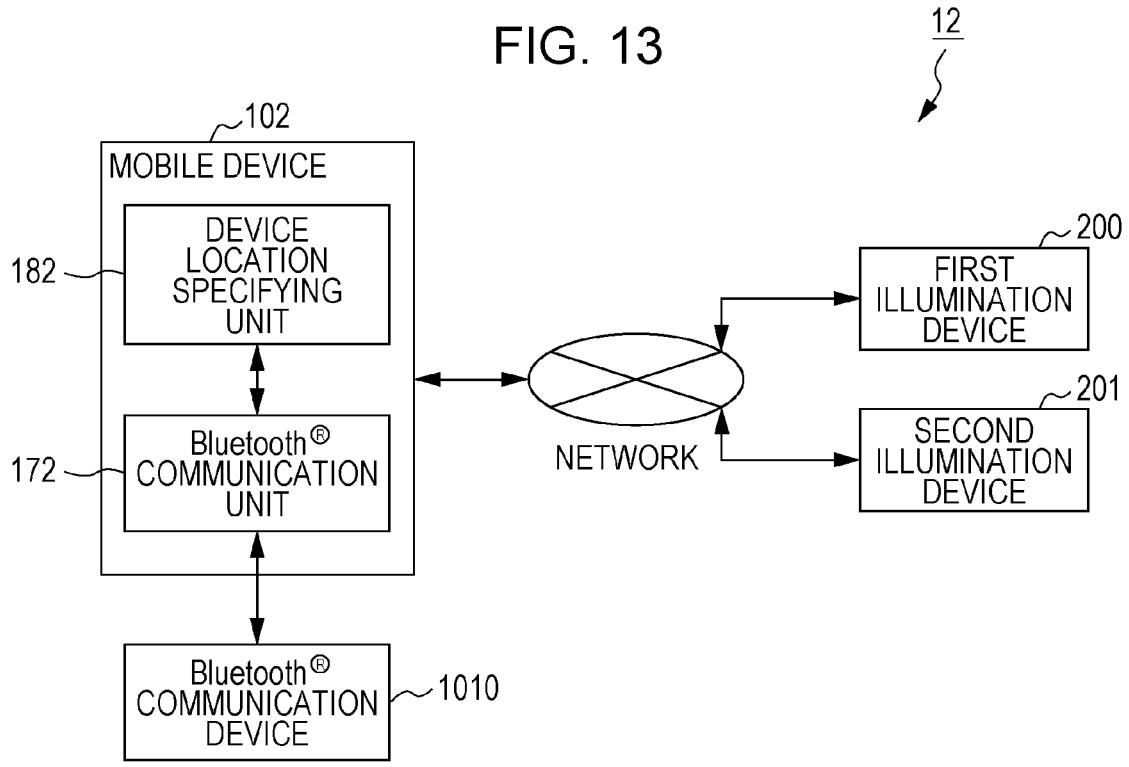
FIG. 13 is a block diagram illustrating another example of a configuration for acquiring location information on a mobile device according to the embodiment.

An illumination system 12 illustrated in FIG. 13 is an example of the illumination system 10 illustrated in FIG. 1, and includes a mobile device 102, the first illumination device 200, the second illumination device 201, and a BLUETOOTH communication device 1010.

Note that, in FIG. 13, although only one BLUETOOTH communication device 1010 is illustrated, the illumination system 12 includes a plurality of BLUETOOTH communication devices 1010. The plurality of BLUETOOTH communication devices 1010 are arranged in, for example, respective rooms or areas.

The BLUETOOTH communication device 1010 performs communication based on the BLUETOOTH standard. A unique identifier is set for the BLUETOOTH communication device 1010. The BLUETOOTH communication device 1010 periodically transmits wireless signal information including the unique identifier.

The mobile device 102 is an example of the mobile device 100 illustrated in FIG. 1, and specifies the location where the mobile device 102 itself is present using the BLUETOOTH communication function. The mobile device 102 includes a BLUETOOTH communication unit 172 and a device location specifying unit 182.

The BLUETOOTH communication unit 172 may communicate with the BLUETOOTH communication device 1010. The BLUETOOTH communication unit 172 acquires wireless signal information transmitted from the BLUETOOTH communication device 1010.

Note that the BLUETOOTH communication unit 172 may also be the same as the communication unit 170 illustrated in FIG. 1. That is, the mobile device 102 may also communicate with the first illumination device 200 and the second illumination device 201 via the BLUETOOTH communication unit 172 and the BLUETOOTH communication device 1010.

The device location specifying unit 182 is an example of the device location specifying unit 180 illustrated in FIG. 1, and specifies the location where the mobile device 102 is present in accordance with the identifier unique to the BLUETOOTH communication device 1010 and included in wireless signal information transmitted by the BLUETOOTH communication device 1010. For example, the device location specifying unit 182 specifies the location where the mobile device 102 is present using the identifier included in wireless signal information received by the BLUETOOTH communication unit 172.

For example, the location where the BLUETOOTH communication device 1010 is present is registered in advance in association with a predetermined identifier in the BLUETOOTH communication device 1010 or the mobile device 102. As a result, the device location specifying unit 182 specifies the location where the mobile device 102 is present by acquiring the identifier.

In this manner, the location of a mobile device may be automatically specified using BLUETOOTH communication and location information may be acquired. As a result, the display controller 130 may acquire a piece of mobile-device location information and pieces of illumination-device location information.

Next, the case where a visible light communication function is used will be described using FIG. 14.

Figure 14:
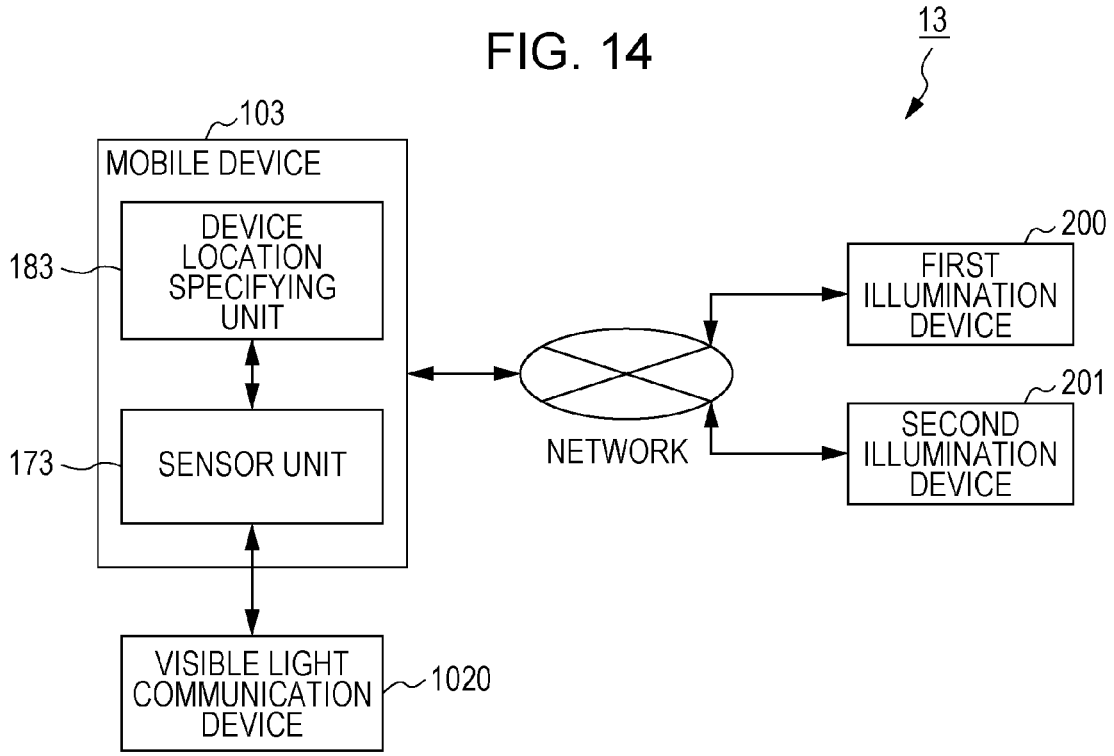
FIG. 14 is a block diagram illustrating another example of a configuration for acquiring location information on a mobile device according to the embodiment.

An illumination system 13 illustrated in FIG. 14 is an example of the illumination system 10 illustrated in FIG. 1, and includes a mobile device 103, the first illumination device 200, the second illumination device 201, and a visible light communication device 1020.

Note that, in FIG. 14, although only one visible light communication device 1020 is illustrated, the illumination system 13 includes a plurality of visible light communication devices 1020. The plurality of visible light communication devices 1020 are arranged in, for example, respective rooms or areas.

The visible light communication device 1020 performs communication using a visible-frequency electromagnetic wave. A unique identifier is set for the visible light communication device 1020. The visible light communication device 1020 periodically transmits an electromagnetic wave including the unique identifier.

Note that the visible light communication device 1020 may be any one of the first illumination device 200 and the second illumination device 201. That is, the visible light communication device 1020 may also be an illumination device controlled by the mobile device 103.

The mobile device 103 is an example of the mobile device 100 illustrated in FIG. 1, and specifies the location where the mobile device 103 itself is present using a visible-frequency electromagnetic wave. The mobile device 103 includes a sensor unit 173 and a device location specifying unit 183.

The sensor unit 173 receives a visible-frequency electromagnetic wave. Specifically, the sensor unit 173 receives a visible-frequency electromagnetic wave transmitted from the visible light communication device 1020.

The device location specifying unit 183 is an example of the device location specifying unit 180 illustrated in FIG. 1, and specifies the location where the mobile device 103 is present in accordance with the identifier unique to the visible light communication device 1020 and included in a visible-frequency electromagnetic wave transmitted by the visible light communication device 1020. For example, the device location specifying unit 183 specifies the location where the mobile device 103 is present using the identifier included in a visible-frequency electromagnetic wave received by the sensor unit 173.

For example, the location where the visible light communication device 1020 is present is registered in advance in association with a predetermined identifier in the visible light communication device 1020 or the mobile device 103. As a result, the device location specifying unit 183 specifies the location where the mobile device 103 is present by acquiring the identifier.

In this manner, the location of a mobile device may be automatically specified using visible light communication and location information may be acquired. As a result, the display controller 130 may acquire a piece of mobile-device location information and pieces of illumination-device location information.

Next, the case where an ultrasonic wave is used will be described using FIG. 15.

Figure 15:
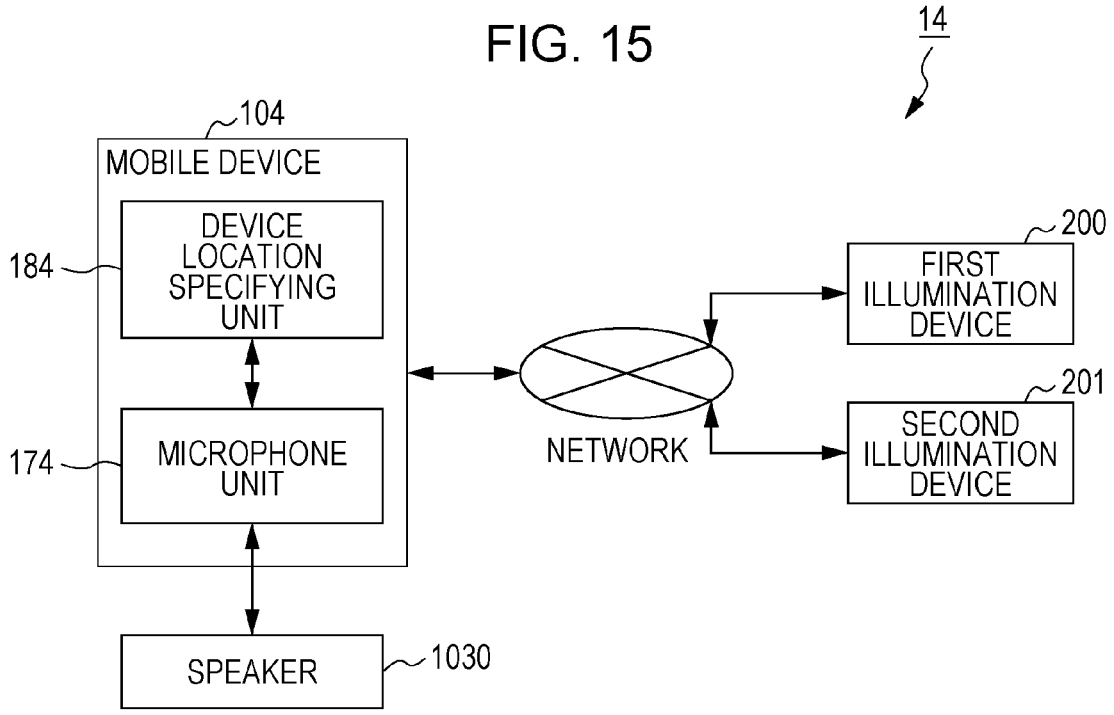
FIG. 15 is a block diagram illustrating another example of a configuration for acquiring location information on a mobile device according to the embodiment.

An illumination system 14 illustrated in FIG. 15 is an example of the illumination system 10 illustrated in FIG. 1, and includes a mobile device 104, the first illumination device 200, the second illumination device 201, and a speaker 1030.

Note that, in FIG. 15, although only one speaker 1030 is illustrated, the illumination system 14 includes a plurality of speakers 1030. The plurality of speakers 1030 are arranged in, for example, respective rooms or areas.

The speaker 1030 performs communication using an ultrasonic wave. A unique identifier is set for the speaker 1030. The speaker 1030 periodically transmits an ultrasonic wave including the unique identifier.

The mobile device 104 is an example of the mobile device 100 illustrated in FIG. 1, and specifies the location where the mobile device 104 itself is present using an ultrasonic wave. The mobile device 104 includes a microphone unit 174 and a device location specifying unit 184.

The microphone unit 174 receives an ultrasonic wave. Specifically, the microphone unit 174 receives an ultrasonic wave transmitted from the speaker 1030.

The device location specifying unit 184 is an example of the device location specifying unit 180 illustrated in FIG. 1, and specifies the location where the mobile device 104 is present in accordance with the identifier unique to the speaker 1030 and included in an ultrasonic wave transmitted by the speaker 1030. For example, the device location specifying unit 184 specifies the location where the mobile device 104 is present using the identifier included in an ultrasonic wave received by the microphone unit 174.

For example, the location where the speaker 1030 is present is registered in advance in association with a predetermined identifier in the speaker 1030 or the mobile device 104. As a result, the device location specifying unit 184 specifies the location where the mobile device 104 is present by acquiring the identifier.

In this manner, the location of a mobile device may be automatically specified using an ultrasonic wave and location information may be acquired. As a result, the display controller 130 may acquire a piece of mobile-device location information and pieces of illumination-device location information.

As described above, the mobile devices illustrated in FIGS. 12 to 15 may automatically acquire a piece of mobile-device location information. That is, for each of the above-described mobile devices 101 to 104, when an illumination device is registered, the location where the mobile device is present may be automatically set as a piece of illumination-device location information.

In contrast to this, a piece of mobile-device location information may also be acquired in accordance with a user's command. That is, the location of a mobile device may also be manually specified.

Figure 16:
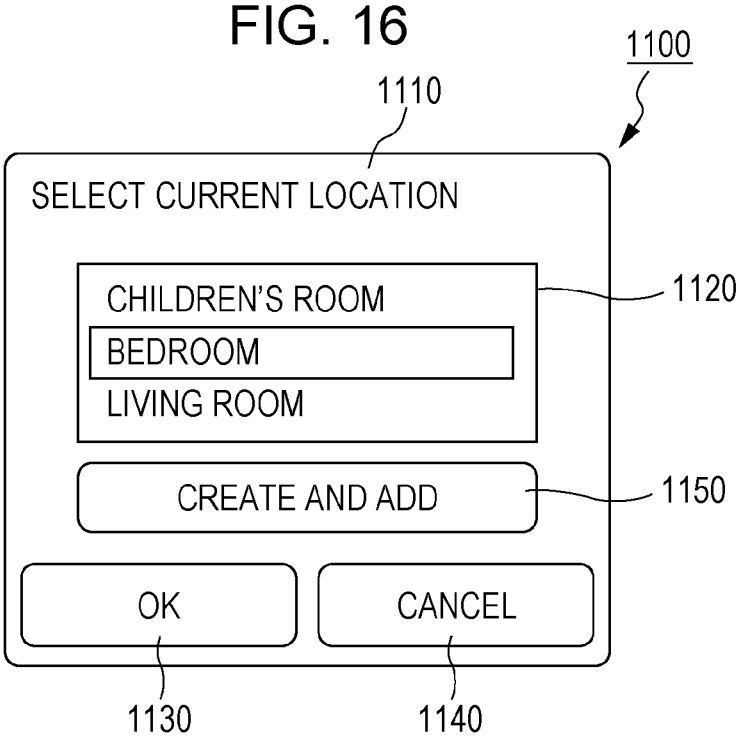
FIG. 16 is a diagram illustrating an example of a current-location selection screen according to the embodiment.
Figure 17:
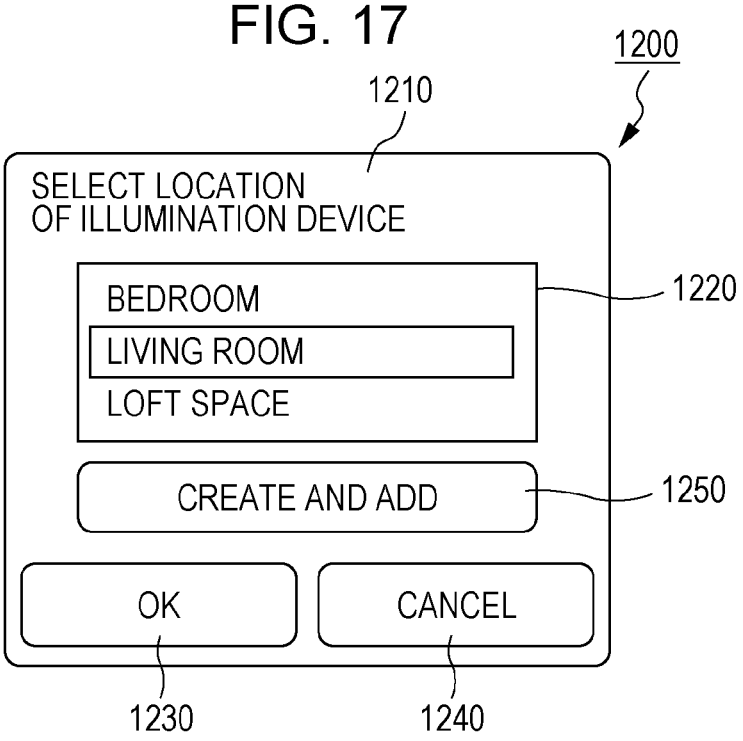
FIG. 17 is a diagram illustrating an example of an illumination-device location selection screen according to the embodiment.

A configuration for causing a user to input the location of a mobile device and acquiring the location of the mobile device will be described using FIGS. 16 and 17. FIG. 16 is a diagram illustrating a current-location selection screen 1100 according to the present embodiment. FIG. 17 is a diagram illustrating an illumination-device location selection screen 1200 according to the present embodiment.

The current-location selection screen 1100 is displayed when, for example, the current-location input button 430 is selected on the remote-control operation screen 400 or 401 illustrated in FIG. 5A or 5B.

The current-location selection screen 1100 is an example of a first input prompt screen for causing a user to input a piece of mobile-device location information. As illustrated in FIG. 16, the current-location selection screen 1100 includes a comment 1110, a list box 1120, a confirmation button 1130, a cancel button 1140, and a create-and-add button 1150.

The comment 1110 is text for presenting an operation that a user should perform. Specifically, the comment 1110 is text for prompting a user to select a piece of mobile-device location information. For example, the comment 1110, which is "Select current location", is displayed as illustrated in FIG. 16. Note that, instead of by the comment 1110, a user may also be prompted by voice to select a location.

The list box 1120 is an example of a GUI component, and is an interface for causing a user to select a piece of mobile-device location information. The list box 1120 displays one or more choices for specifying a location such as "children's room", "bedroom", and the like, and a user may select one of the one or more choices. These choices have been registered, for example, by a user in advance.

The confirmation button 1130 is an example of a GUI component, and is, for example, a push-button. The confirmation button 1130 is a button for causing a user to confirm that one of the one or more choices displayed in the list box 1120 has been selected.

In the case where the confirmation button 1130 has been selected, the choice selected in the list box 1120 is determined as a piece of mobile-device location information. That is, the display controller 130 acquires the determined piece of mobile-device location information (S200 in FIG. 11), and performs the display priority setting process for illumination devices. Thus, after the confirmation button 1130 has been selected, a remote-control operation screen including setting screens sorted in accordance with the selected piece of mobile-device location information is displayed on the display unit 120.

The cancel button 1140 is an example of a GUI component, and is, for example, a push-button. The cancel button 1140 is a button for causing a user to confirm that selection of a piece of mobile-device location information is to be terminated. In the case where the cancel button 1140 has been selected, selection of a piece of mobile-device location information is terminated, and, for example, the scene selection screen 300 is displayed on the display unit 120.

The create-and-add button 1150 is an example of a GUI component, and is, for example, a push-button. The create-and-add button 1150 is a button for adding a choice to be displayed in the list box 1120.

In the case where the create-and-add button 1150 has been selected, for example, a text box is displayed and a user may input text indicating a desired location. Note that, instead of such a text box, a voice input may also be received.

As described above, in the case where the current-location input button 430 has been selected, an example has been described in which the current-location selection screen 1100 is displayed; however, examples are not limited to this example. For example, when the input unit 110 detects the current-location input button 430 being pressed, the mobile device 100 may enter a state for receiving a voice input.

For example, an input prompt screen including a comment such as "Input current location by voice" may also be displayed on the display unit 120. Then, the mobile device 104 may receive a voice input from a user by starting the function of the microphone unit. As a result, the user may input the current location by voice.

Alternatively, when the input unit 110 detects the current-location input button 430 being pressed, the mobile device 100 may also enter a state for receiving a user's gesture input. For example, the mobile device 100 acquires, as a gesture input, a user's body motion, specifically, the motion of a portion of the user's body such as a hand, a head, or the like. Gesture inputs have been associated with respective pieces of mobile-device location information in advance. For example, an action for swinging a right hand up and down is associated with "living room" and managed by the illumination information management unit 150.

For example, when the input unit 110 detects the current-location input button 430 being pressed, the image capturing unit 140 is started up. When a user makes a certain gesture, the image capturing unit 140 receives the user's gesture input. The display controller 130 may acquire a piece of mobile-device location information in accordance with a gesture input acquired via the image capturing unit 140 and the pieces of mobile-device location managed by the illumination information management unit 150.

Note that the mobile device 100 may acquire the motion of the mobile device 100 itself as a gesture input. For example, the mobile device 100 starts up an acceleration sensor or the like and may detect the direction in which a user moves the mobile device 100. For example, in the case where directions in which the mobile device 100 is moved have been associated with respective pieces of mobile-device location information in advance, the display controller 130 may acquire a piece of mobile-device location information.

As described above, an example has been described in which a user may input the current location of the mobile device 100; however, a user may also input pieces of illumination-device location information likewise.

The illumination-device location selection screen 1200 is an example of a second input prompt screen for causing a user to input a piece of illumination-device location information. The illumination-device location selection screen 1200 is displayed when, for example, an illumination device is newly registered. Alternatively, the illumination-device location selection screen 1200 is displayed when information on the location of a registered illumination device is edited. Specifically, although not illustrated, when the input unit 110 detects, for example, an illumination-device register button being pressed, which is displayed on the display unit 120, the illumination-device location selection screen 1200 is displayed.

As illustrated in FIG. 17, the illumination-device location selection screen 1200 includes a comment 1210, a list box 1220, a confirmation button 1230, a cancel button 1240, and a create-and-add button 1250.

The comment 1210 is text for presenting an operation that a user should perform. Specifically, the comment 1210 is text for prompting a user to select a piece of illumination-device location information. For example, the comment 1210, which is "Select location of illumination device", is displayed as illustrated in FIG. 17. Note that, instead of by the comment 1210, a user may also be prompted by voice to select a location.

The list box 1220 is an example of a GUI component, and is an interface for causing a user to select a piece of illumination-device location information. The list box 1220 displays one or more choices for specifying a location such as "bedroom", "living room", and the like, and a user may select one of the one or more choices. These choices have been registered, for example, by a user in advance.

Note that the choices displayed in the list box 1220 are the same as those displayed in the list box 1120 illustrated in FIG. 16. For example, the list box 1220 (and the list box 1120) may be scrolled vertically and is configured such that all the preregistered choices are selectable.

The confirmation button 1230 is an example of a GUI component, and is, for example, a push-button. The confirmation button 1230 is a button for causing a user to confirm that one of the one or more choices displayed in the list box 1220 has been selected. In the case where the confirmation button 1230 has been selected, a choice selected in the list box 1220 is set as a piece of illumination-device location information.

The cancel button 1240 is an example of a GUI component, and is, for example, a push-button. The cancel button 1240 is a button for causing a user to confirm that selection of a piece of illumination-device location information is to be terminated. In the case where the cancel button 1240 has been selected, selection of a piece of illumination-device location information is terminated, and, for example, a registration process for an illumination device is terminated.

The create-and-add button 1250 is an example of a GUI component, and is, for example, a push-button. The create-and-add button 1250 is a button for adding a choice to be displayed in the list box 1220.

In the case where the create-and-add button 1250 has been selected, for example, a text box is displayed and a user may input text indicating a desired location. Note that, instead of such a text box, a voice input may also be received.

Note that, instead of displaying the illumination-device location selection screen 1200, the mobile device 100 may also enter a state for receiving a voice input or a gesture input. A specific process is the same as that for inputting a piece of mobile-device location information.

As described above, since a user may input a piece of illumination-device location information, a remote-control operation screen desired by the user may be displayed at a timing desired by the user. For example, even in the case where a user is in "living room" with a mobile device, the mobile device may display a remote-control operation screen corresponding to "bedroom" by receiving an input of "bedroom". As a result, the user may confirm or adjust an illumination state created by illumination devices present in the "bedroom" while in the "living room".

In addition, since a user may input a piece of illumination-device location information, an illumination device may be registered at a location desired by the user. For example, even in the case where a user is in "living room" with a mobile device, the user may register an illumination device present in "bedroom".

Figure 18A:
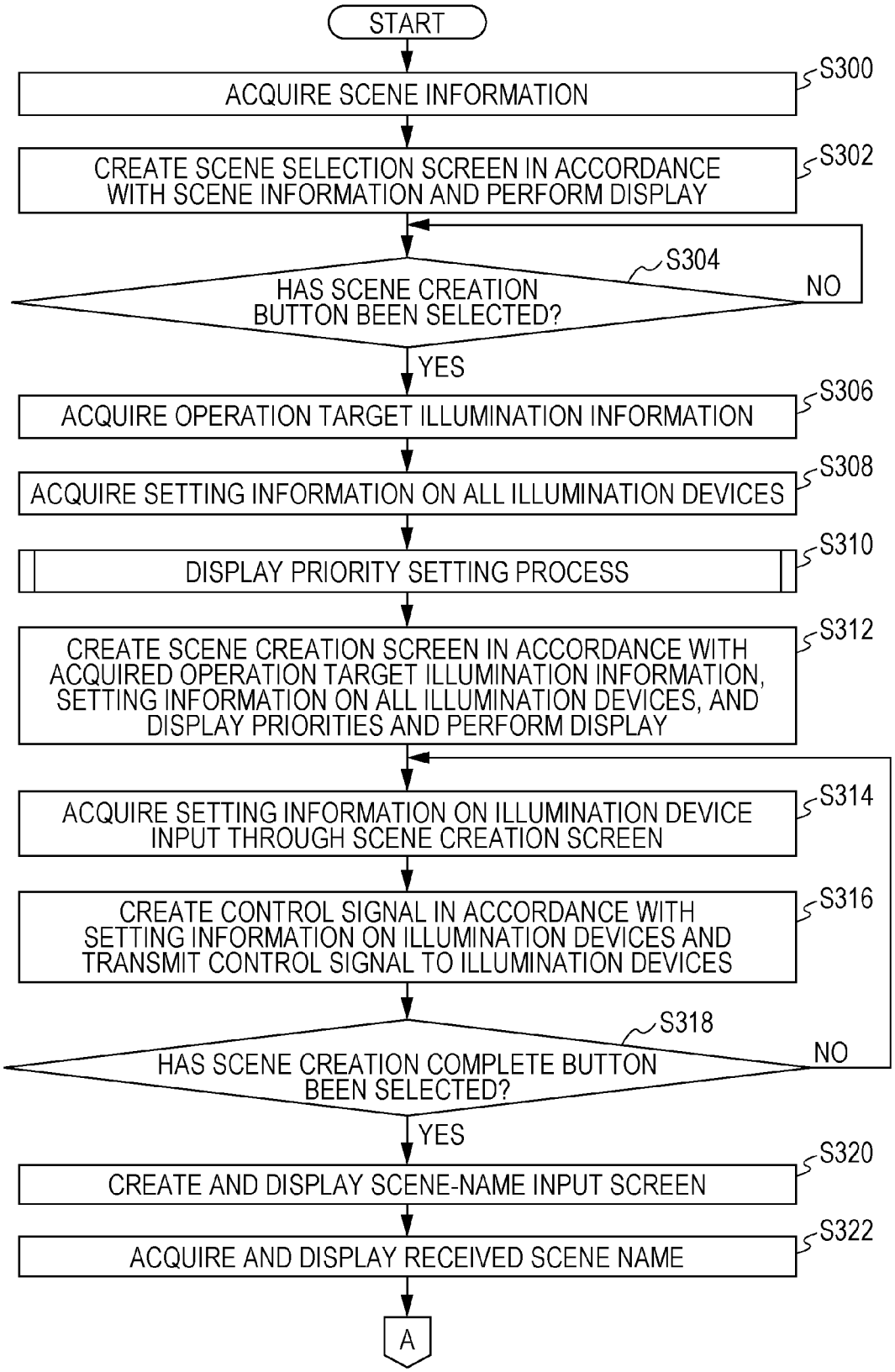
FIG. 18A is a flowchart illustrating an example of a scene creation method according to the embodiment.
Figure 18B:
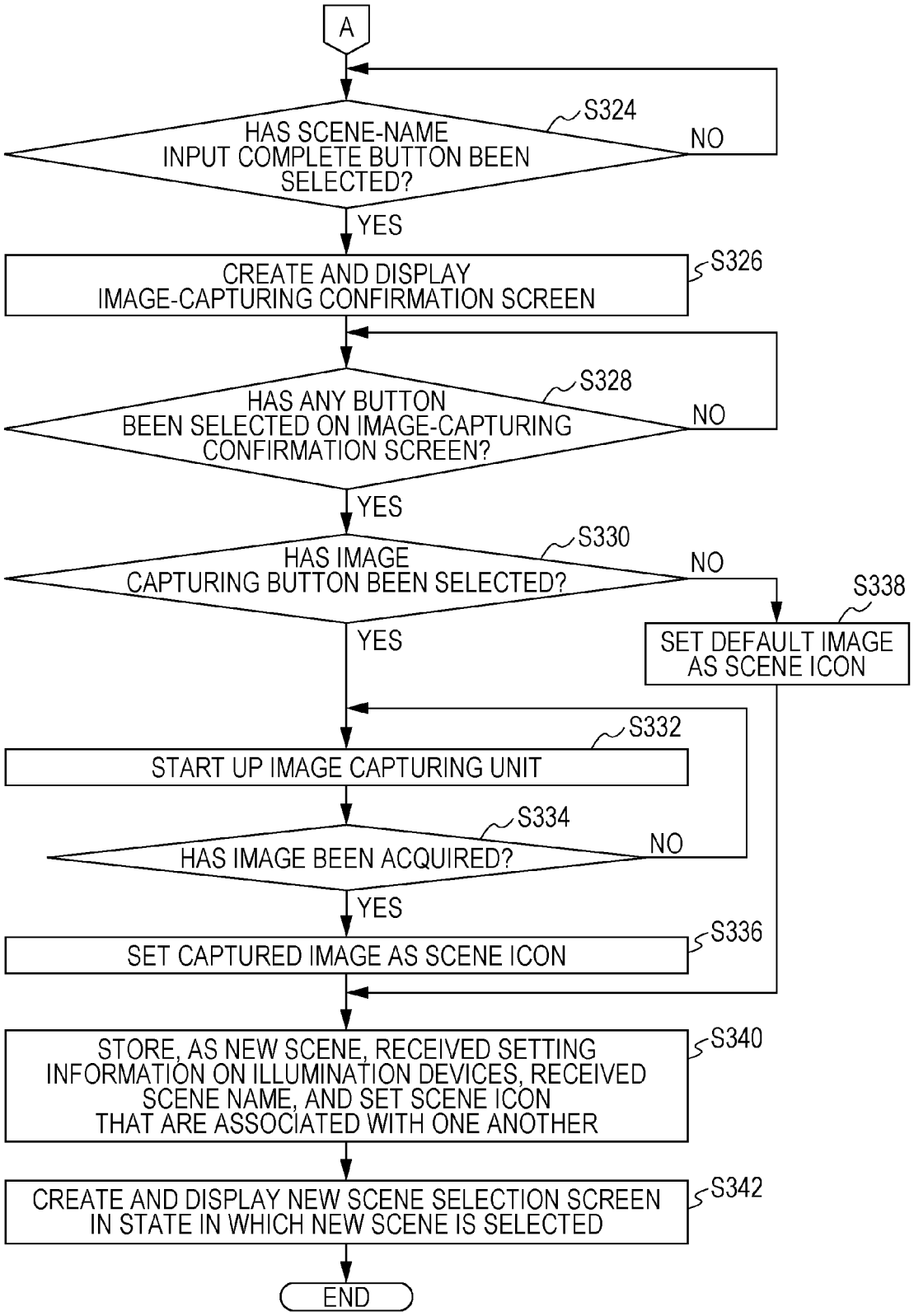
FIG. 18B is a flowchart illustrating the example of a scene creation method according to the embodiment.

Next, a scene creation method for the mobile device 100 according to the present embodiment will be described using FIGS. 18A to 19. FIGS. 18A and 18B are a flowchart illustrating an example of a scene creation method according to the present embodiment. FIGS. 19A to 19I are diagrams illustrating an example of screen transitions displayed in the scene creation method according to the present embodiment.

For example, a control method for the mobile device 100 according to the present embodiment is realized by an application software program for controlling one or more illumination devices, or the like. For example, by starting up the application software program, a scene creation method according to an embodiment is started.

First, the display controller 130 acquires scene information (S300). Specifically, the display controller 130 reads and acquires the scene information stored in the illumination information management unit 150. The scene information is, for example, information indicating one or more scenes that have already been created as illustrated in FIG. 2.

Figure 19A:
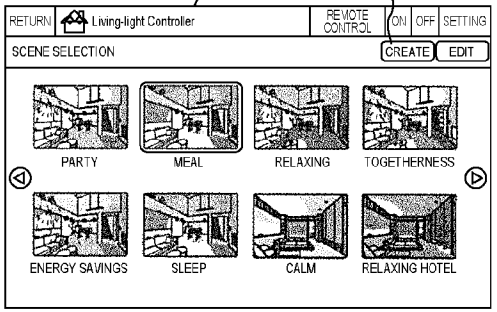
FIGS. 19A to 19I are diagrams illustrating an example of screen transitions displayed in a scene creation method according to the embodiment.

Next, the display controller 130 creates the scene selection screen 300 in accordance with the acquired scene information, and causes the display unit 120 to display the created scene selection screen 300 (S302). As a result, for example, the scene selection screen 300 is displayed on the display unit 120 as illustrated in FIG. 19A. The details of the scene selection screen 300 are as described above using FIG. 3.

Next, the display controller 130 is held on standby until a scene creation button (the creation button 330) is selected (No in S304). Here, in the case where any one of the one or more scene icons 310 has been selected, the display controller 130 adds and displays the certain frame 370 such that the certain frame 370 surrounds the selected scene icon. In addition, the illumination controller 160 creates a control signal for controlling one or more illumination devices such that a space is illuminated in an illumination state indicated by the scene corresponding to the selected scene icon 310. Then, the illumination controller 160 transmits the created control signal to the one or more illumination devices via the communication unit 170 and a network. As a result, the space is illuminated in the illumination state indicated by the selected scene.

Next, in the case where the scene creation button (the creation button 330) has been selected (Yes in S304), the display controller 130 acquires operation target illumination information (S306). Specifically, in the case where the input unit 110 detects the creation button 330 being pressed, the display controller 130 reads and acquires the operation target illumination information stored in the illumination information management unit 150. The operation target illumination information is the information indicating one or more illumination devices that have already been registered, for example, as illustrated in FIG. 4.

Next, the display controller 130 acquires setting information on all the illumination devices (S308). Specifically, the display controller 130 acquires a setting value of the brightness adjustment function (a dimming ratio), a setting value of the color adjustment function (a color temperature), and the like of each of the illumination devices from the illumination device via the communication unit 170. That is, the display controller 130 acquires all the illumination states created by the illumination devices as of this point in time.

Next, the display controller 130 performs the display priority setting process in accordance with the acquired operation target illumination information (S310). The details of the display priority setting process are similar to those illustrated in FIG. 11. As a result, display priorities are assigned to all the illumination devices included in the operation target illumination information.

Figure 19B:
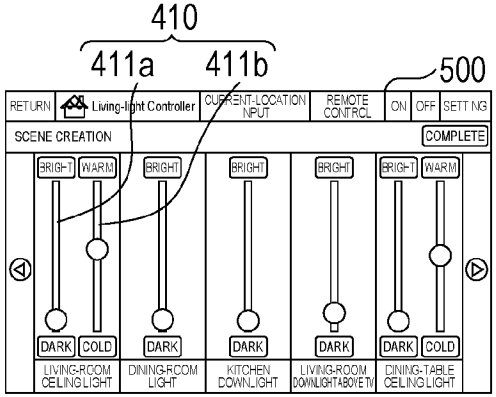

Next, the display controller 130 creates a scene creation screen in accordance with the acquired operation target illumination information, the setting information on all the illumination devices, and the display priorities, and causes the display unit 120 to display the created scene creation screen (S312). As a result, for example, in the case where a piece of mobile-device location information is information specifying "living room", the scene creation screen 500 is displayed on the display unit 120 as illustrated in FIG. 19B, the scene creation screen 500 being a screen on which the setting screens for the illumination devices present in the "living room" are displayed in a prioritized manner. The details of the scene creation screen 500 are as described above using FIG. 6A.

Note that, here, a setting value of the brightness adjustment slider 411*a* and a setting value of the color adjustment slider 411*b* of each setting screen 410 are determined in accordance with the setting information on all the illumination devices. That is, the display controller 130 creates the scene creation screen 500 such that each of the sliders is displayed using a position corresponding to the current illumination state as an initial position in accordance with the setting information on the illumination devices acquired via the communication unit 170.

Next, the display controller 130 and the illumination controller 160 acquire setting information on an illumination device input by the user through the scene creation screen 500 (S314). Since the scene creation screen 500 is displayed as illustrated in FIG. 19B, the user may set a setting value of the brightness adjustment function or the color adjustment function of each of the one or more illumination devices. The display controller 130 and the illumination controller 160 acquire, for example, a setting value indicated by the brightness adjustment slider 411*a* or the color adjustment slider 411*b* via the input unit 110, the setting value having been operated by the user.

Figure 19C:
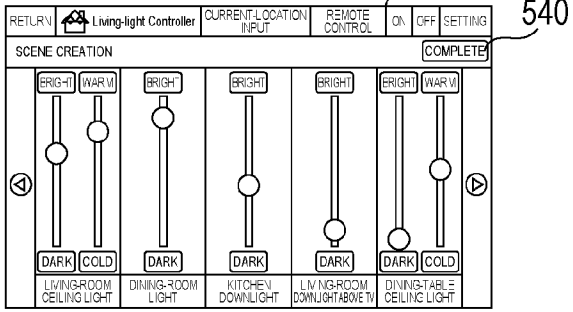

Then, the display controller 130 creates the scene creation screen 500 in accordance with setting values acquired via the input unit 110, and causes the display unit 120 to display the created scene creation screen 500. That is, the display controller 130 creates the scene creation screen 500 as needed in synchronization with the user's operation, and causes the display unit 120 to display the created scene creation screen 500. Specifically, in the case where the user has operated a slider, display of the slider is changed on the scene creation screen 500 in accordance with the user's operation. In this manner, the scene creation screen 500 obtained after the change is displayed on the display unit 120 as illustrated in FIG. 19C.

In addition, the illumination controller 160 creates a control signal for controlling the one or more illumination devices in accordance with setting information indicated by an illumination state set through the user's operation performed through the setting screens 410 (S316). Then, the illumination controller 160 transmits the created control signal to the one or more illumination devices via the communication unit 170 and a network. As a result, the illumination state created by the one or more illumination devices is changed as needed in synchronization with the user's operation.

For example, in the case where the user has operated the brightness adjustment slider 411*a* of "living-room ceiling light" among the one or more illumination devices, an actual brightness of the "living-room ceiling light" is changed in accordance with the user's operation. For example, in the case where the user has operated the brightness adjustment slider 411*a* such that a dimming ratio of "living-room ceiling light" is set to "100", the "living-room ceiling light" becomes brightest and illuminates the space.

Until a scene creation complete button (the complete button 540) is selected (No in S318), acquisition of setting information through the user's operation (S314) and control of the illumination devices (S316) are repeated.

In this manner, the illumination state created by the one or more illumination devices is changed in synchronization with the user's operation performed through the setting screens 410. Thus, the user may create a desired scene by operating the mobile device 100 while actually checking the atmosphere of the illumination state.

Figure 19D:
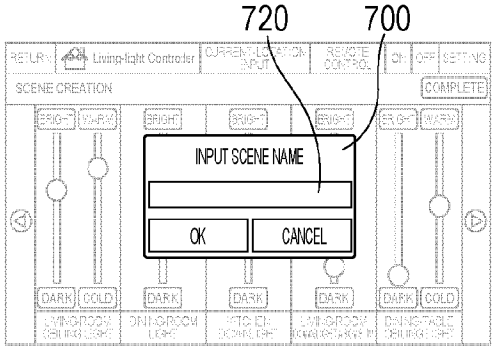

In the case where the scene creation complete button (the complete button 540) has been selected (Yes in S318), the display controller 130 creates the scene-name input screen 700 and causes the display unit 120 to display the created scene-name input screen 700 (S320). Specifically, in the case where the input unit 110 detects the complete button 540 being pressed, the display controller 130 creates the scene-name input screen 700. As a result, the scene-name input screen 700 is displayed on the display unit 120 as illustrated in FIG. 19D. The details of the scene-name input screen 700 are as described above using FIG. 7.

Here, at the point in time when the scene-name input screen 700 is displayed, nothing is input in the text box 720. That is, the text box 720, which is blank, is displayed. The user inputs a desired scene name into the text box 720.

Figure 19E:
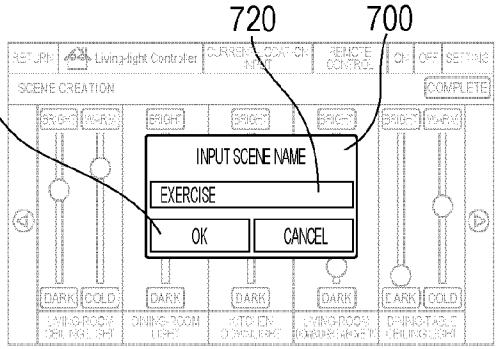

The input unit 110 acquires text (a scene name) input into the text box 720. Then, the display controller 130 displays the text acquired by the input unit 110 in the text box 720 (S322). As a result, the scene-name input screen 700 including the text box 720 is displayed on the display unit 120 as illustrated in FIG. 19E, the text box 720 displaying the text input by the user.

Figure 19F:
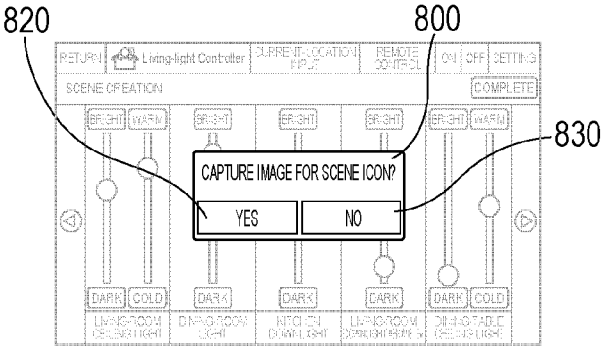

In the case where a scene-name input complete button (the confirmation button 730) has been selected (Yes in S324), the display controller 130 creates the image-capturing confirmation screen 800 of a scene icon and causes the display unit 120 to display the created image-capturing confirmation screen 800 (S326). Specifically, in the case where the input unit 110 detects the confirmation button 730 being pressed, the display controller 130 creates the image-capturing confirmation screen 800. As a result, the image-capturing confirmation screen 800 is displayed on the display unit 120 as illustrated in FIG. 19F. Note that, here, the illumination information management unit 150 manages the text input in the text box 720 at the point in time when the confirmation button 730 is selected, as a scene name of a new scene.

Note that in the case where the scene-name input complete button (the confirmation button 730) is not selected (No in S324), the display controller 130 is held on standby until the confirmation button 730 is selected.

Next, the display controller 130 is held on standby until any of the buttons on the image-capturing confirmation screen 800 is selected (No in S328). Specifically, until the input unit 110 detects either the agree button 820 or the disagree button 830 being pressed, the display controller 130 causes the display unit 120 to display the image-capturing confirmation screen 800.

In the case where any of the buttons has been selected (Yes in S328), if the selected button is an image capturing button (the agree button 820) (Yes in S330), the image capturing unit 140 is started up (S332). Specifically, in the case where the input unit 110 detects the agree button 820 being pressed, the display controller 130 starts up the image capturing unit 140.

Figure 19G:
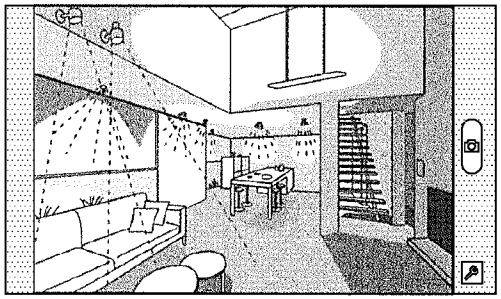

After the image capturing unit 140 is started up, as illustrated in FIG. 19G, an image (a live view image) acquired by the image sensor of the image capturing unit 140 is displayed on the display unit 120. The user may press the shutter button while looking at an image displayed on the display unit 120. The image capturing unit 140 acquires a captured image when the shutter button is pressed.

At the point in time when the image capturing unit 140 is started up, the space is illuminated in an illumination state based on the setting information on the illumination devices obtained at the point in time when the complete button 540 is selected. That is, the space is illuminated in the illumination state indicated by the new scene created by the user. Thus, by capturing an image of the space, the atmosphere of the new scene created by the user may be saved as a captured image. That is, the user may check the atmosphere of the new scene by visually checking a captured image.

In the case where a captured image has been acquired (Yes in S334), the display controller 130 sets the captured image, which has been acquired, as a scene icon (S336). Note that until a captured image is acquired (No in S334), the image capturing unit 140 is kept in a state in which image capturing is possible. That is, the image capturing unit 140 is kept in a state in which the image capturing unit 140 is started up.

In addition, in the case where the selected button on the image-capturing confirmation screen 800 is the disagree button 830 (No in S330), the display controller 130 sets a default image as the scene icon (S338).

Then, the illumination information management unit 150 store, as the new scene, the setting information on the one or more illumination devices, the scene name, which has been received, and the scene icon that are associated with one another (S340). That is, in the case where an image captured by the image capturing unit 140 has been acquired, the acquired image is managed as a scene icon. In the case where an image captured by the image capturing unit 140 has not been acquired, a default image is managed as the scene icon.

Figure 19H:
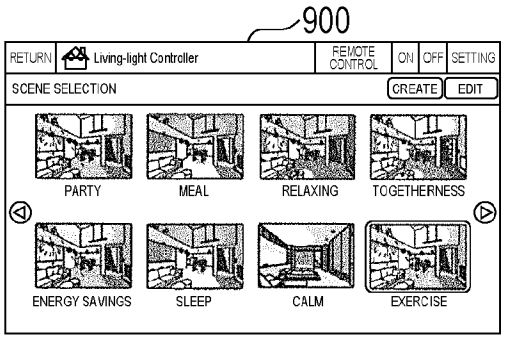
Figure 19I:
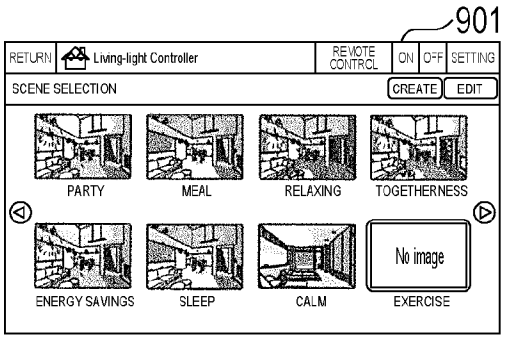

Next, the display controller 130 creates the new scene selection screen 900 or 901 in a state in which the new scene, which has been created, is selected, and causes the display unit 120 to display the new scene selection screen 900 or 901, which has been created, (S342). As a result, in the case where the captured image has been acquired, the new scene selection screen 900 is displayed on the display unit 120 as illustrated in FIG. 19H. In addition, in the case where a captured image has not been selected, the new scene selection screen 901 is displayed on the display unit 120 as illustrated in FIG. 19I.

Note that, after the new scene selection screen 900 or 901 has been displayed, processing for detecting whether or not the creation button 330 is pressed (S304) and processing thereafter are repeated.

As described above, according to the control method for the mobile device 100 according to the present embodiment, when a new scene is created, after settings of one or more illumination devices are completed setting, an image of a space illuminated by the one or more illumination devices in accordance with the settings of the one or more illumination devices is captured and the image acquired through image capturing is set as the scene icon of the new scene. That is, an image representing the atmosphere of the new scene is set as the scene icon.

Then, the image representing the atmosphere of the new scene is displayed on a scene selection screen. Thus, the user may easily check the atmosphere of a scene only by visually checking the scene icon of the scene. That is, since the scene icon is an actually captured image of the scene, the user may visually and easily check the atmosphere of the scene.

As described above, according to a new-scene creation method for the mobile device 100 according to the present embodiment, since one or more setting screens are sorted in accordance with a piece of mobile-device location information and one or more pieces of illumination-device location information and are displayed, a scene creation screen appropriate for the location where the mobile device 100 is present may be created. Thus, such a scene creation screen may allow a user to easily adjust an illumination state created by illumination devices.

Figure 20A:
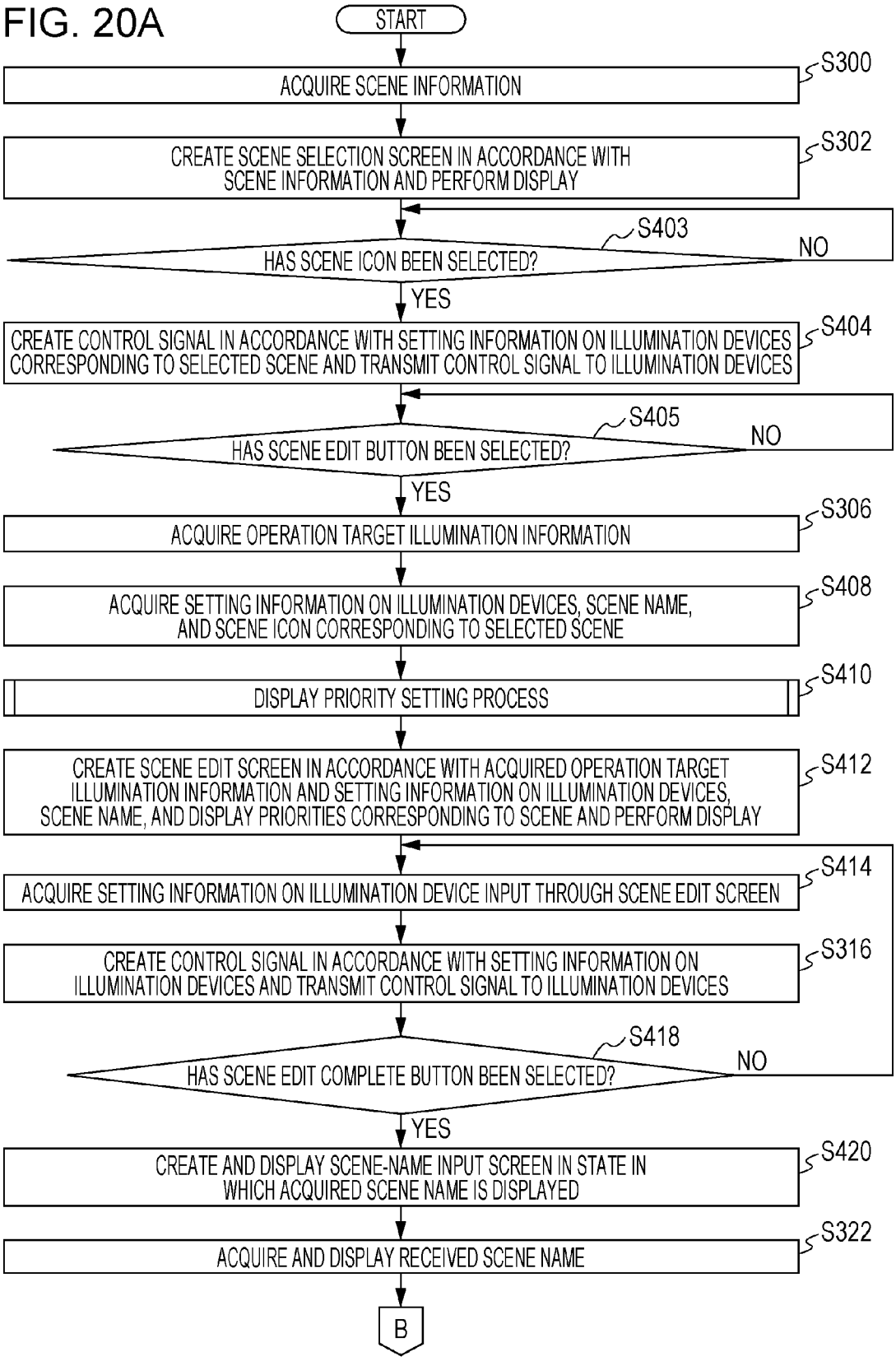
FIG. 20A is a flowchart illustrating an example of a scene edit method according to the embodiment.
Figure 20B:
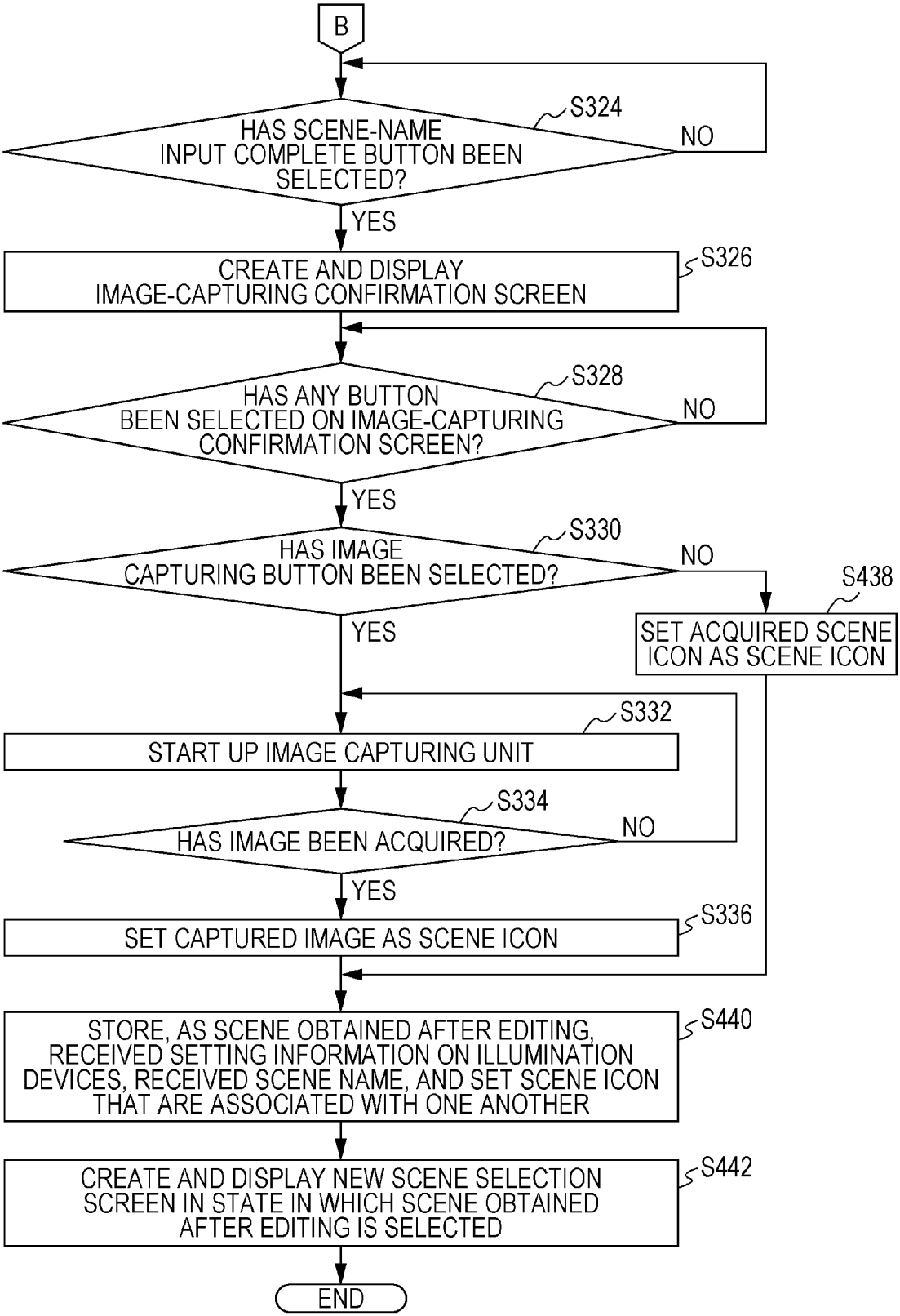
FIG. 20B is a flowchart illustrating the example of a scene edit method according to the embodiment.

Next, a scene edit method for the mobile device 100 according to the present embodiment will be described using FIGS. 20A to 21. FIGS. 20A and 20B are a flowchart illustrating an example of a scene edit method according to the present embodiment. FIGS. 21A to 21H are diagrams illustrating an example of screen transitions displayed in the scene creation method according to the present embodiment. Note that, in FIGS. 20A and 20B, pieces of processing the same as those in the scene creation method illustrated in FIGS. 18A and 18B are denoted by the same reference numerals and the description thereof may be omitted.

Figure 21A:
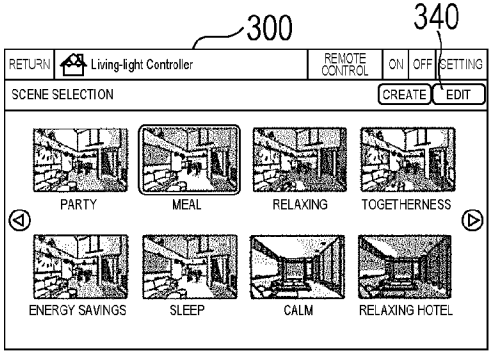
FIGS. 21 to 21H are diagrams illustrating an example of screen transitions displayed in a scene edit method according to the embodiment.

First, the display controller 130 acquires scene information (S300). Then, the display controller 130 creates the scene selection screen 300 in accordance with the acquired scene information, and causes the display unit 120 to display the created scene selection screen 300 (S302). As a result, for example, the scene selection screen 300 is displayed on the display unit 120 as illustrated in FIG. 21A. The details of the scene selection screen 300 are as described above using FIG. 3.

Next, the display controller 130 is held on standby until a scene icon 310 is selected (No in S403). In the case where any one of the one or more scene icons 310 has been selected (Yes in S403), the illumination controller 160 creates a control signal in accordance with setting information on one or more illumination devices corresponding to the selected scene, and transmits the created control signal to the one or more illumination devices (S404). That is, the illumination controller 160 creates a control signal for illuminating a space in an illumination state indicated by the scene corresponding to the selected scene icon 310. Then, the illumination controller 160 transmits the created control signal to the one or more illumination devices via the communication unit 170 and a network. As a result, the space may be illuminated in the illumination state indicated by the selected scene.

Next, the display controller 130 is held on standby until a scene edit button (the edit button 340) is selected (No in S405). Here, in the case where another scene icon 310 has been selected, the display controller 130 adds and displays the certain frame 370 such that the certain frame 370 surrounds the other scene icon 310, which has been selected. In addition, the illumination controller 160 creates a control signal for illuminating a space in an illumination state indicated by the scene corresponding to the other scene icon 310, which has been selected. Then, the illumination controller 160 transmits the created control signal to the one or more illumination devices via the communication unit 170 and a network. As a result, the space is illuminated in the illumination state indicated by the selected scene.

Next, in the case where the scene edit button (the edit button 340) has been selected (Yes in S405), the display controller 130 acquires the operation target illumination information (S306). Specifically, in the case where the input unit 110 detects the edit button 340 being pressed, the display controller 130 reads and acquires the operation target illumination information stored in the illumination information management unit 150.

Next, the display controller 130 acquires setting information on illumination devices, the scene name, and the scene icon corresponding to the selected scene (S408). Specifically, the display controller 130 reads and acquires the setting information on the illumination devices, the scene name, and the scene icon corresponding to the selected scene from the illumination information management unit 150. Note that the display controller 130 may also acquire the setting information on the illumination devices from the illumination devices via the communication unit 170.

Next, the display controller 130 performs the display priority setting process in accordance with the acquired operation target illumination information (S410). The details of the display priority setting process are similar to those illustrated in FIG. 11. As a result, display priorities are assigned to all the illumination devices included in the operation target illumination information.

Figure 21B:
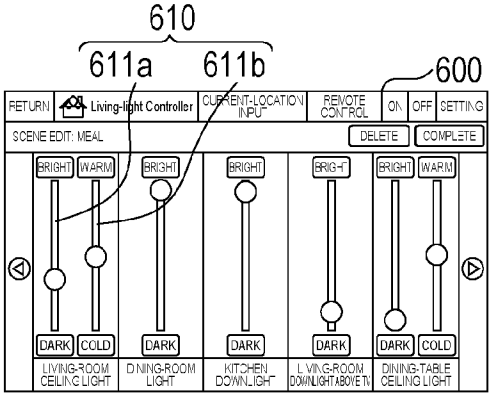

Next, the display controller 130 creates a scene edit screen in accordance with the acquired operation target illumination information and the setting information on the illumination devices, the scene name, and the display priorities corresponding to the scene, and causes the display unit 120 to display the created scene edit screen (S412). As a result, for example, in the case where a piece of mobile-device location information is information specifying "living room", the scene edit screen 600 is displayed on the display unit 120 as illustrated in FIG. 21B, the scene edit screen 600 being a screen on which the setting screens for the illumination devices present in the "living room" are displayed in a prioritized manner. The details of the scene edit screen 600 are as described above using FIG. 6B.

Here, the display controller 130 determines initial positions of the sliders included in the scene edit screen 600, in accordance with the setting information on the illumination devices corresponding to the selected scene. That is, as illustrated in FIG. 21B, at the point in time when the scene edit screen 600 is displayed, sliders are displayed whose initial positions are determined in accordance with the setting information on the illumination devices corresponding to the scene "meal".

Next, the display controller 130 and the illumination controller 160 acquire setting information on an illumination device input by the user through the scene edit screen 600 (S414). Since the scene edit screen 600 is displayed as illustrated in FIG. 21B, the user may set a setting value of the brightness adjustment function or the color adjustment function of each of the one or more illumination devices. The display controller 130 and the illumination controller 160 acquire, for example, a setting value indicated by the brightness adjustment slider 611*a* or the color adjustment slider 611*b* via the input unit 110, the setting value having been operated by the user.

Figure 21C:
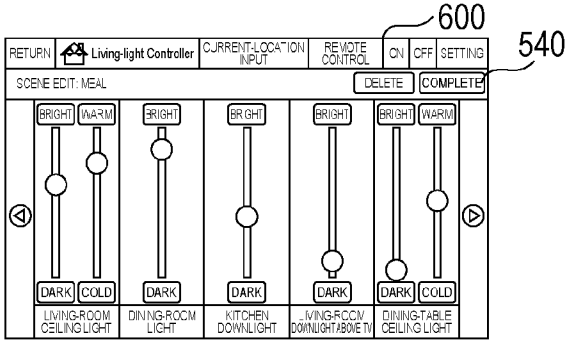

Then, the display controller 130 creates the scene edit screen 600 in accordance with setting values acquired via the input unit 110, and causes the display unit 120 to display the created scene edit screen 600. That is, the display controller 130 creates the scene edit screen 600 as needed in synchronization with the user's operation, and causes the display unit 120 to display the created scene edit screen 600. Specifically, in the case where the user has operated a slider, display of the slider is changed on the scene edit screen 600 in accordance with the user's operation. In this manner, the scene edit screen 600 obtained after the change is displayed on the display unit 120 as illustrated in FIG. 21C.

In addition, the illumination controller 160 creates a control signal for controlling the one or more illumination devices in accordance with setting information indicating an illumination state set through the user's operation performed through the setting screens 610 (S316). Then, the illumination controller 160 transmits the created control signal to the one or more illumination devices via the communication unit 170 and a network. As a result, the illumination state created by the one or more illumination devices is changed as needed in synchronization with the user's operation.

Until a scene edit complete button (the complete button 540) is selected (No in S418), acquisition of setting information through the user's operation (S414) and control of the illumination devices (S316) are repeated.

In this manner, the illumination state created by the one or more illumination devices is changed in synchronization with the user's operation performed through the setting screens 610. Thus, the user may set a desired scene by operating the mobile device 100 while actually checking the atmosphere of the illumination state.

Figure 21D:
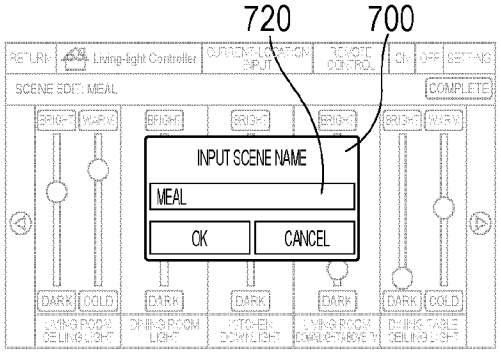

In the case where the scene edit complete button (the complete button 540) has been selected (Yes in S418), the display controller 130 creates the scene-name input screen 700 and causes the display unit 120 to display the created scene-name input screen 700 (S420). Specifically, in the case where the input unit 110 detects the complete button 540 being pressed, the display controller 130 creates the scene-name input screen 700. As a result, the scene-name input screen 700 is displayed on the display unit 120 as illustrated in FIG. 21D. The details of the scene-name input screen 700 are as described above using FIG. 7.

Here, at the point in time when the scene-name input screen 700 is displayed, the scene name corresponding to the selected scene icon 310 is displayed in the text box 720. Specifically, as illustrated in FIG. 21D, "meal" is displayed in the text box 720. The user may use the displayed scene name as it is. Alternatively, after deleting the displayed scene name, the user may input a desired scene name into the text box 720.

Figure 21E:
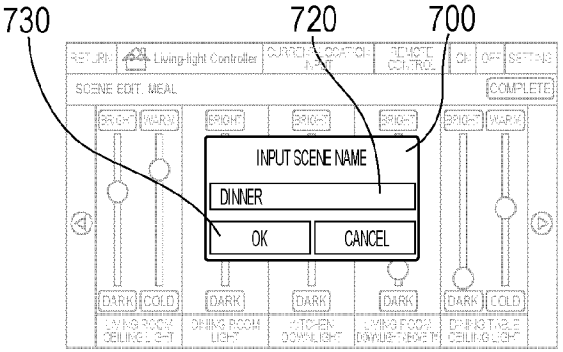

The input unit 110 acquires text input into the text box 720. Then, the display controller 130 displays the text acquired by the input unit 110 in the text box 720 (S322). As a result, the scene-name input screen 700 including the text box 720 is displayed on the display unit 120 as illustrated in FIG. 21E, the text box 720 displaying the text input by the user. Note that, in FIG. 21E, the case is illustrated where the scene name is changed from "meal" to "dinner".

Thereafter, the processing from detection processing for the confirmation button 730 of the scene-name input screen 700 (S324) to processing for setting a captured image as a scene icon (S336) is the same as that of the scene creation method illustrated in FIG. 18B.

Figure 21F:
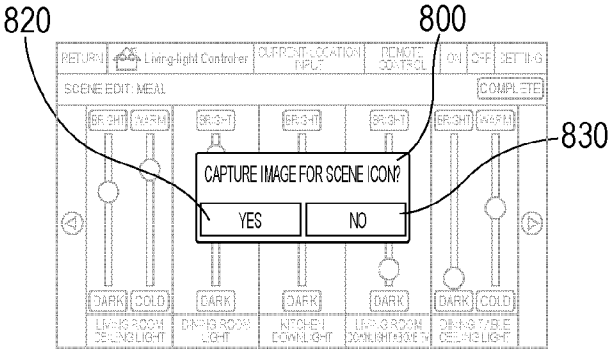
Figure 21H:
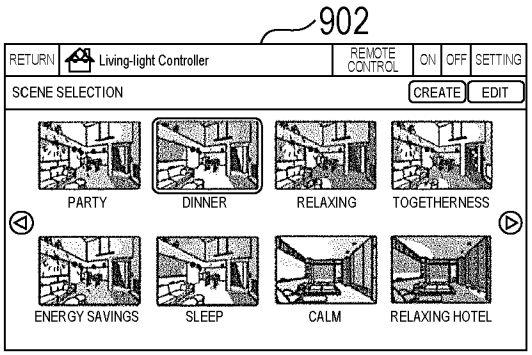
Figure 21G:
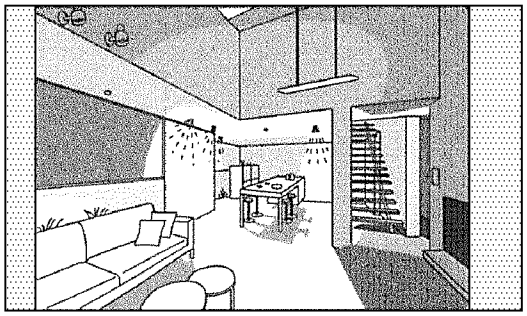

Specifically, in the case where the confirmation button 730 has been selected, the image-capturing confirmation screen 800 is displayed as illustrated in FIG. 21F. Furthermore, in the case where the agree button 820 of the image-capturing confirmation screen 800 has been selected, the image capturing unit 140 is started up and an image (a live view image) acquired by the image sensor of the image capturing unit 140 is displayed on the display unit 120 as illustrated in FIG. 21G. When the user presses the shutter button, the image capturing unit 140 acquires a captured image.

In contrast, in the case where a button selected on the image-capturing confirmation screen 800 is the disagree button 830 (No in S330), the display controller 130 simply sets the scene icon corresponding to the selected scene, that is, the scene that is being edited, as a scene icon of a scene obtained after editing (S438). Note that, here, the display controller 130 may also set a default image as the scene icon.

Then, the illumination information management unit 150 stores, as the scene obtained after editing, the setting information on the one or more illumination devices, the scene name, which has been received, and the scene icon that are associated with one another (S440). That is, in the case where an image captured by the image capturing unit 140 has been acquired, the acquired image is managed as the scene icon. In the case where an image captured by the image capturing unit 140 has not been acquired, the scene icon obtained before the scene has been edited or a default image is managed as the scene icon.

Next, the display controller 130 creates a new scene selection screen 902 in a state in which the scene obtained after editing, that is, a new scene is selected, and causes the display unit 120 to display the new scene selection screen 902, which has been created, (S442). In this manner, the display controller 130 causes the display unit 120 to display the new scene selection screen 902 including the scene icon of the new scene instead of the scene icon (an edit target scene icon) selected among the one or more scene icons 310. As a result, the new scene selection screen 902 as illustrated in FIG. 21H is displayed on the display unit 120.

Note that, after the new scene selection screen 902 has been displayed, processing for detecting whether or not a scene icon is pressed (S403) and processing thereafter are repeated.

As described above, according to a scene edit method for the mobile device 100 according to the present embodiment, since one or more setting screens are sorted in accordance with a piece of mobile-device location information and one or more pieces of illumination-device location information and are displayed, a scene edit screen appropriate for the location where the mobile device 100 is present may be created. Thus, such a scene edit screen may allow a user to easily adjust an illumination state created by illumination devices.

Note that, in the present embodiment, an example has been described in which a new scene is set by editing an existing scene. Here, the existing scene is overwritten with the new scene; however, the new scene may also be saved in addition to the existing scene. That is, both the existing scene and the new scene may also be included in the scene information. In other words, the display controller 130 may also cause the display unit 120 to display a new scene selection screen that additionally includes the scene icon of the new scene together with the one or more scene icons 310.

In addition, in S201 to S204 of FIG. 11, the mobile device 100 may also set display priorities of scenes corresponding to each room or area in accordance with the intensity of a signal received from the room or the area.

(First Modified Example)

In the above-described present embodiment, an example has been described in which a piece of mobile-device location information is information specifying the room or the area where a mobile device is present; however, a piece of mobile-device location information is not limited to such information. For example, a piece of mobile-device location information may also be information specifying the latitude, the longitude, and the floor number of the location where a mobile device is present. Here, likewise, for one or more pieces of illumination-device location information, each piece of illumination-device location information may also be information specifying the latitude, the longitude, and the floor number of the location where an illumination device corresponding to the piece of illumination-device location information is present. Specifically, the location of a mobile device and the location of an illumination device may also be specified using an indoor messaging system (IMES), which is an example of the indoor global positioning system (GPS) techniques.

Figure 22:
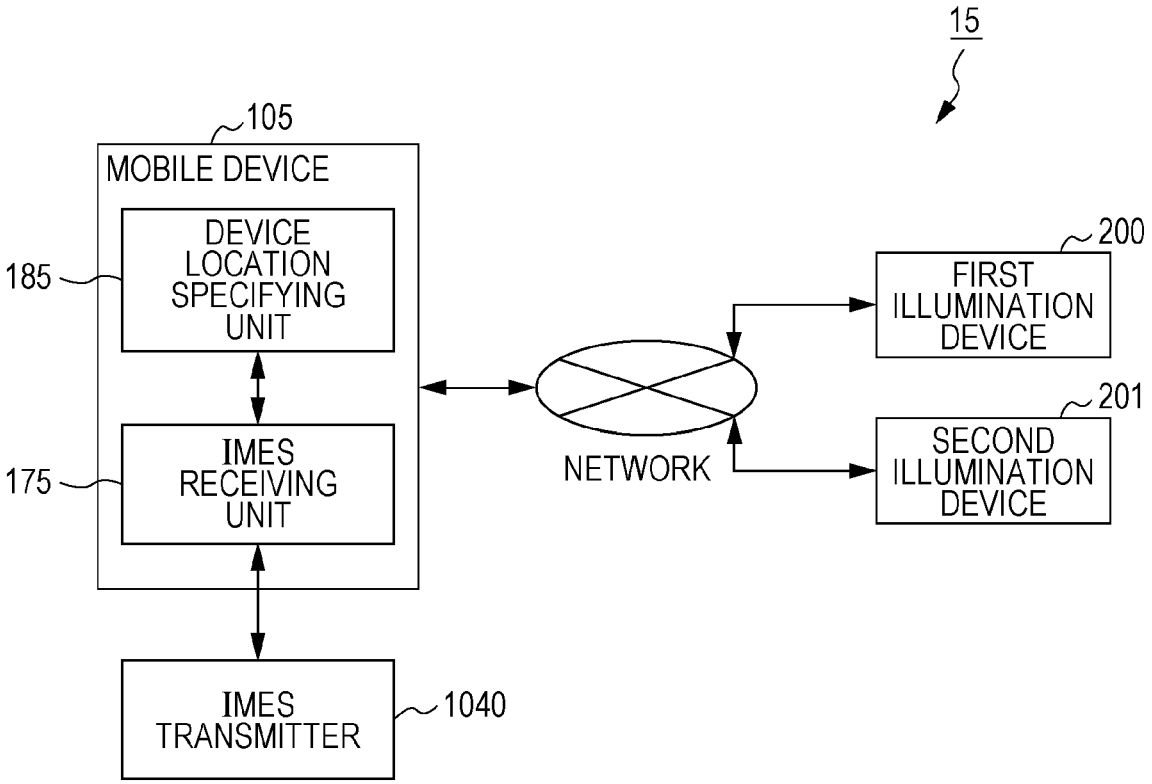
FIG. 22 is a block diagram illustrating an example of a configuration for acquiring location information on a mobile device according to a first modified example of an embodiment.
Figure 23:
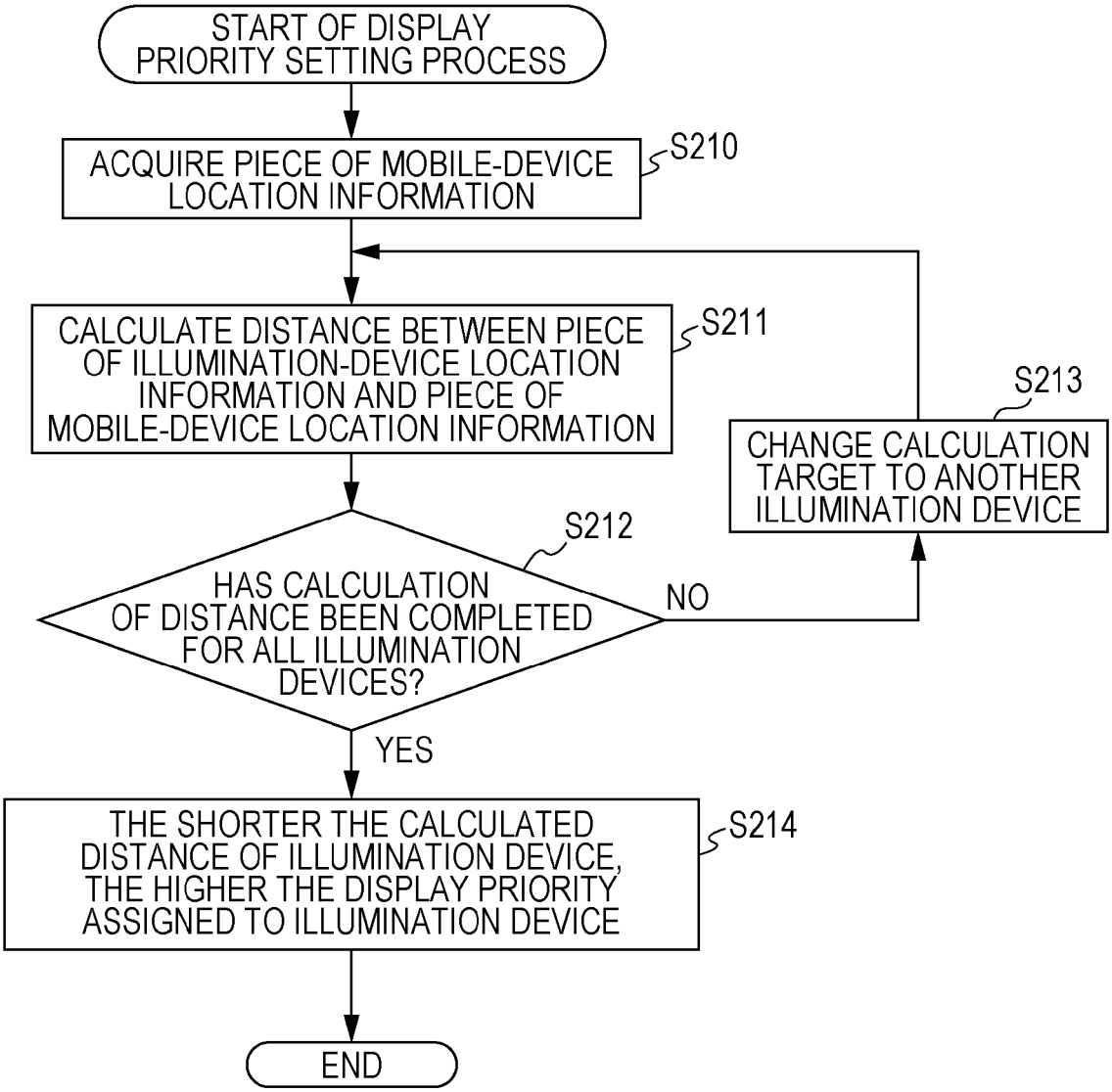
FIG. 23 is a flowchart illustrating an example of a setting method for display priorities according to the first modified example of the embodiment.

In the following, an example of an illumination system using IMES will be described using FIGS. 22 and 23. FIG. 22 is a block diagram illustrating an example of a configuration for acquiring location information on a mobile device according to a first modified example of an embodiment. FIG. 23 is a flowchart illustrating another example of a setting method for display priorities according to the first modified example of the embodiment.

An illumination system 15 illustrated in FIG. 22 is an example of the illumination system 10 illustrated in FIG. 1, and is a system using IMES to specify the location of a mobile device. The illumination system 15 includes a mobile device 105, the first illumination device 200, the second illumination device 201, and an IMES transmitter 1040.

Note that, in FIG. 22, although only one IMES transmitter 1040 is illustrated, the illumination system 15 includes a plurality of IMES transmitters 1040. The plurality of IMES transmitters 1040 are arranged in, for example, respective rooms or areas.

The IMES transmitter 1040 transmits wireless signal information including position information. Specifically, the IMES transmitter 1040 transmits wireless signal information including information indicating a latitude, a longitude, and a floor number. For example, the IMES transmitter 1040 transmits wireless signal information including information indicating the latitude, the longitude, and the floor number of the location where the IMES transmitter 1040 itself is present.

The mobile device 105 is an example of the mobile device 100 illustrated in FIG. 1, and specifies the location where the mobile device 105 itself is present using IMES. The mobile device 105 includes an IMES receiving unit 175 and a device location specifying unit 185.

The IMES receiving unit 175 may communicate with the IMES transmitter 1040. The IMES receiving unit 175 acquires wireless signal information transmitted from the IMES transmitter 1040.

The device location specifying unit 185 is an example of the device location specifying unit 180 illustrated in FIG. 1, and specifies the location where the mobile device 105 is present in accordance with information indicating a latitude, a longitude, and a floor number, the information being included in wireless signal information transmitted by the IMES transmitter 1040.

In the first modified example, as a result of use of IMES, the location of the mobile device 105 and the locations of the illumination devices may be specified by numerical values. Thus, as illustrated in FIG. 23, more advanced settings may be set for display priorities.

As illustrated in FIG. 23, first, the device location specifying unit 185 acquires a piece of mobile-device location information indicating the location where the mobile device 105 is present (S210). That is, the device location specifying unit 185 acquires information for specifying the latitude, the longitude, and the floor number of the current location of the mobile device 105 as a piece of mobile-device location information from the IMES transmitter 1040.

Next, the display controller 130 calculates the distance between a piece of illumination-device location information on one illumination device included in the operation target illumination information and the acquired piece of mobile-device location information (S211). Specifically, the display controller 130 calculates the distance between the position determined by the latitude, the longitude, and the floor number specified by the piece of illumination-device location information and the position determined by the latitude, the longitude, and the floor number specified by the piece of mobile-device location information. Note that, for example, the illumination information management unit 150 associates the calculated distance with the illumination device and temporarily manages the calculated distance.

Next, the display controller 130 determines whether or not calculation of a distance has been completed for all the illumination devices included in the operation target illumination information (S212). In the case where calculation of a distance has not been completed for all the illumination devices included in the operation target illumination information (No in S212), the display controller 130 changes a calculation target to another illumination device for which a distance has not been calculated (S213) and a distance is calculated (S211).

In the case where calculation of a distance has been completed for all the illumination devices included in the operation target illumination information (Yes in S212), the shorter the calculated distance of the illumination device, the higher the display priority assigned by the display controller 130 to the illumination device (S214). As a result, the display controller 130 may sort one or more setting screens corresponding to the one or more illumination devices in ascending order of distance to the position determined by the latitude, the longitude, and the floor number specified by the piece of mobile-device location information, and cause the display unit 120 to display the setting screens.

As described above, according to the control method for a mobile device according to the first modified example, the location where the mobile device 105 is present may be specified by numerical values. Thus, the setting screens for the one or more illumination devices may be sorted with high accuracy. Thus, the control method for a mobile device according to the first modified example may allow a user to easily adjust an illumination state created by illumination devices. In addition, since a piece of mobile-device location information may be automatically and precisely acquired using IMES, an operational burden may be reduced and the convenience of operation for users may be improved.

(Second Modified Example)

In the above-described present embodiment, an example has been described in which a piece of mobile-device location information is automatically acquired and pieces of illumination-device location information are set in accordance with the acquired mobile-device location information; however, the pieces of illumination-device location information are not limited to such information. The pieces of illumination-device location information may also be pieces of information indicating the locations where communication devices are present that communicate with the illumination devices.

For example, in the case where the mobile device 100 transmits a control signal for controlling one or more illumination devices via one or more communication devices, each of the one or more illumination devices belongs to any one of the one or more communication devices. Here, one or more pieces of illumination-device location information are one or more pieces of communication-device location information indicating one or more locations where respective one or more communication devices are present to which the one or more illumination devices corresponding to the one or more pieces of illumination-device location information belong. That is, the mobile device 100 acquires, from one or more communication devices, a piece of communication-device location information as a piece of illumination-device location information and a piece of mobile-device location information.

In the following, specific examples of a configuration for acquiring a piece of communication-device location information as a piece of illumination-device location information and a piece of mobile-device location information will be described using FIGS. 24 to 28. FIGS. 24 to 28 are block diagrams illustrating an example of a configuration for acquiring a piece of communication-device location information according to a second modified example of the embodiment.

Note that FIGS. 24 to 28 illustrate configurations for automatically acquiring a piece of communication-device location information using different means. The mobile device 100 according to the second modified example may use, for example, any one of the means illustrated in FIGS. 24 to 28, or may also use a means different from the means illustrated in FIGS. 24 to 28.

First, the case where a wireless LAN function is used will be described using FIG. 24.

Figure 24:
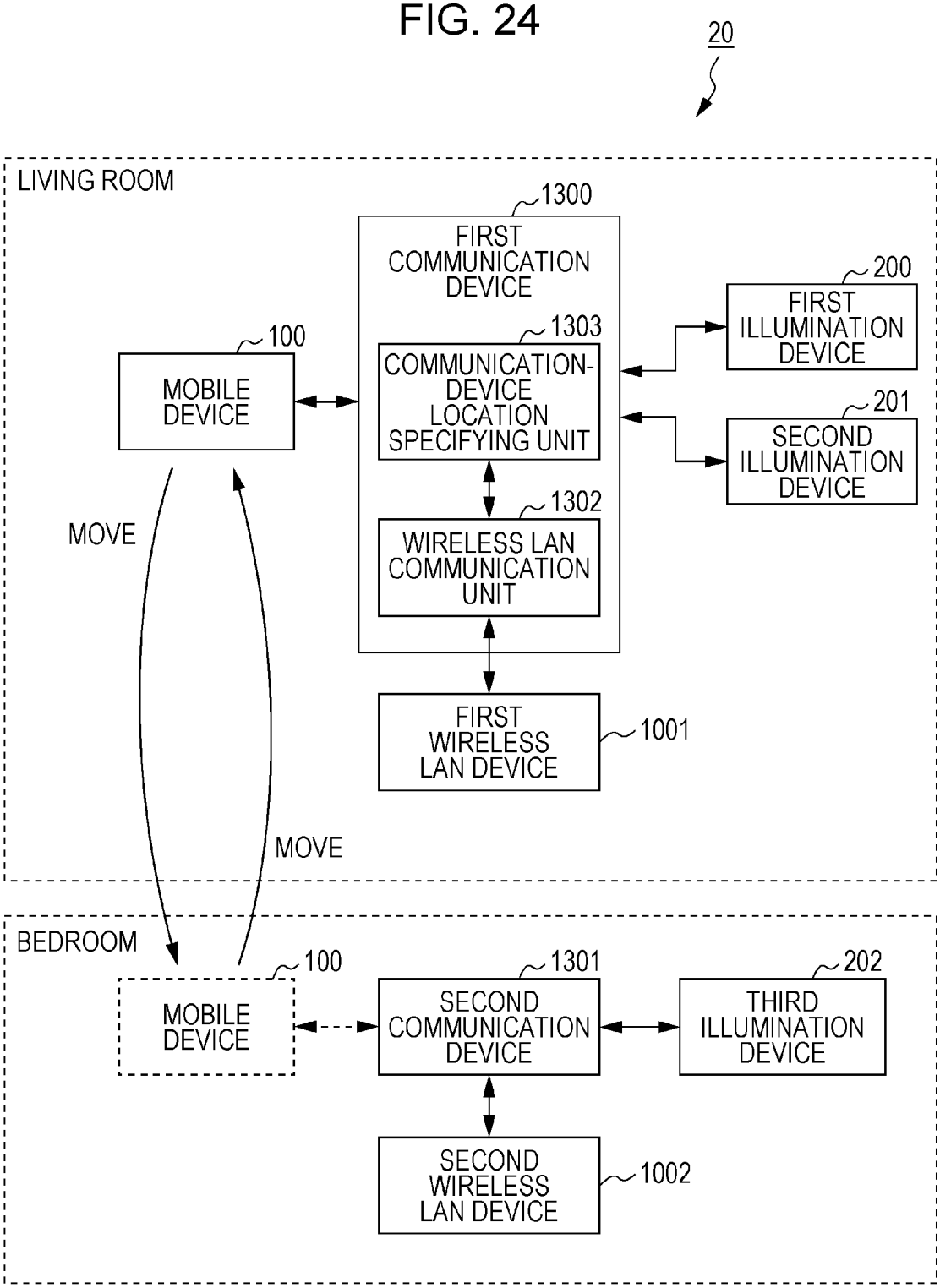
FIG. 24 is a diagram illustrating an example of a configuration for acquiring a piece of communication-device location information according to a second modified example of the embodiment.

An illumination system 20 illustrated in FIG. 24 is an example of the illumination system 10 illustrated in FIG. 1, and includes the mobile device 100, the first illumination device 200, the second illumination device 201, a third illumination device 202, a first wireless LAN device 1001, a second wireless LAN device 1002, a first communication device 1300, and a second communication device 1301. The first illumination device 200 and the second illumination device 201 belong to the first communication device 1300, and the third illumination device 202 belongs to the second communication device 1301.

The first wireless LAN device 1001 and the second wireless LAN device 1002 perform communication based on the wireless LAN standard. A unique identifier, for example, an SSID is set for the first wireless LAN device 1001 and the second wireless LAN device 1002. That is, the SSID of the first wireless LAN device 1001 differs from the SSID of the second wireless LAN device 1002. The first wireless LAN device 1001 periodically transmits wireless signal information including the SSID set therefor. The second wireless LAN device 1002 periodically transmits wireless signal information including the SSID set therefor.

The first communication device 1300 may communicate with the mobile device 100, the first illumination device 200, and the second illumination device 201. The first communication device 1300 receives a control signal transmitted from the mobile device 100, and transmits the control signal to the first illumination device 200 and the second illumination device 201. Here, the first communication device 1300 may also change the control signal to commands that individual illumination devices may execute.

As illustrated in FIG. 24, the first communication device 1300 includes a wireless LAN communication unit 1302 and a communication-device location specifying unit 1303.

The wireless LAN communication unit 1302 may communicate with the first wireless LAN device 1001. The wireless LAN communication unit 1302 acquires wireless signal information transmitted from the first wireless LAN device 1001.

The communication-device location specifying unit 1303 acquires a piece of communication-device location information by specifying the location where the first communication device 1300 is present in accordance with the identifier unique to the first wireless LAN device 1001 and included in wireless signal information transmitted by the first wireless LAN device 1001. For example, the communication-device location specifying unit 1303 specifies the location where the first communication device 1300 is present using the SSID included in wireless signal information received by the wireless LAN communication unit 1302.

For example, the location where the first wireless LAN device 1001 is present is registered in advance in association with the SSID in the first wireless LAN device 1001 or the first communication device 1300. As a result, the communication-device location specifying unit 1303 specifies the location where the first communication device 1300 is present by acquiring the SSID.

The second communication device 1301 may communicate with the mobile device 100 and the third illumination device 202. Specifically, the second communication device 1301 receives a control signal transmitted from the mobile device 100, and transmits the control signal to the third illumination device 202. Here, the second communication device 1301 may also change the control signal to commands that individual illumination devices may execute. Note that, although not illustrated, similarly to the first communication device 1300, the second communication device 1301 includes the wireless LAN communication unit 1302 and the communication-device location specifying unit 1303. The second communication device 1301 may communicate with the second wireless LAN device 1002. The first communication device 1300 and the second communication device 1301 are, for example, a bridge, a router, or the like.

Here, as illustrated in FIG. 24, the first illumination device 200, the second illumination device 201, the first wireless LAN device 1001, and the first communication device 1300 are present in "living room", and the third illumination device 202, the second wireless LAN device 1002, and the second communication device 1301 are present in "bedroom". That is, for every room or area, one wireless LAN device, one communication device, and one or more illumination devices belonging to the communication device are arranged.

For example, in the case where a user is in the "living room" with the mobile device 100, the mobile device 100 acquires a piece of communication-device location information as a piece of mobile-device location information from the first communication device 1300 by communicating with the first communication device 1300. In contrast, in the case where the user is in the "bedroom" with the mobile device 100, the mobile device 100 acquires a piece of communication-device location information as a piece of mobile-device location information from the second communication device 1301 by communicating with the second communication device 1301. In the case where the user has moved with the mobile device 100 to a different room, a piece of communication-device location information may be acquired by communicating with a communication device in the different room.

As a result, the mobile device 100 may specify the location where the mobile device 100 itself is present.

In addition, a piece of communication-device location information indicates the location where an illumination device is present. Thus, by acquiring a piece of communication-device location information from a communication device, the mobile device 100 may automatically acquire pieces of illumination-device location information indicating the locations where illumination devices belonging to the communication device are present. For example, when an illumination device is registered, a piece of illumination-device location information indicating the location where the illumination device is present may be acquired by selecting a communication device to which the illumination device belongs and acquiring a piece of communication-device location information from the selected communication device.

Note that the mobile device 100 may also communicate with the first illumination device 200 and the second illumination device 201 via the first wireless LAN device 1001 and the wireless LAN communication unit 1302. That is, the communication unit 170 of the mobile device 100 may perform wireless LAN communication, and may also transmit a control signal to the first illumination device 200 and the second illumination device 201 via the first wireless LAN device 1001 and the first communication device 1300.

In addition, similarly to the mobile device 101 illustrated in FIG. 12, the mobile device 100 may include the device location specifying unit 181 and also automatically specify the location of the mobile device 100 by communicating with the first wireless LAN device 1001 or the second wireless LAN device 1002.

Next, the case where a BLUETOOTH communication function is used will be described using FIG. 25.

Figure 25:
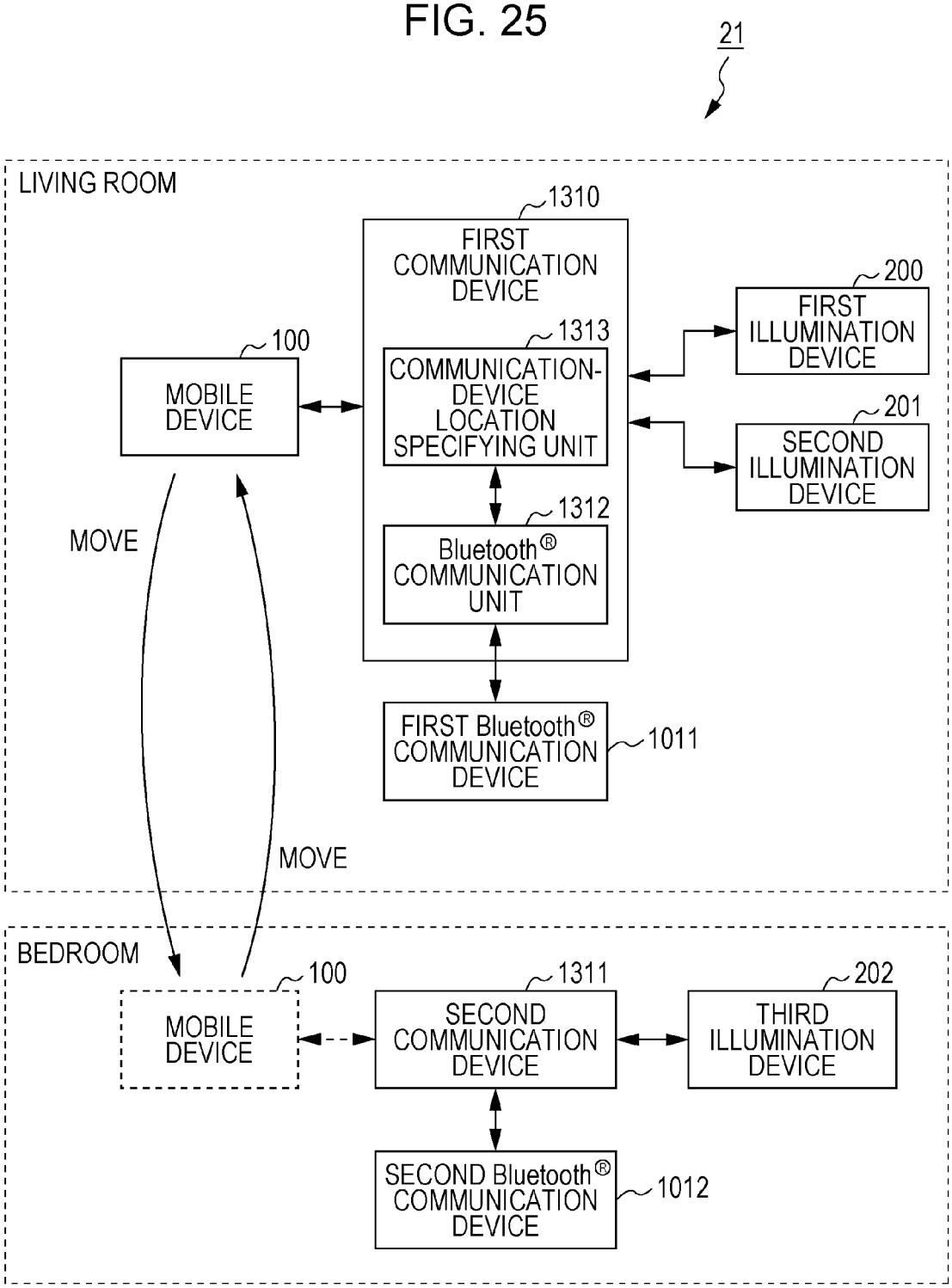
FIG. 25 is a diagram illustrating another example of a configuration for acquiring a piece of communication-device location information according to the second modified example of the embodiment.

An illumination system 21 illustrated in FIG. 25 is an example of the illumination system 10 illustrated in FIG. 1.

The illumination system 21 differs from the illumination system 20 illustrated in FIG. 24 in that the illumination system 21 includes a first BLUETOOTH communication device 1011, a second BLUETOOTH communication device 1012, a first communication device 1310, and a second communication device 1311 instead of the first wireless LAN device 1001, the second wireless LAN device 1002, the first communication device 1300, and the second communication device 1301.

The first BLUETOOTH communication device 1011 and the second BLUETOOTH communication device 1012 perform communication based on the BLUETOOTH standard. A unique identifier is set for the first BLUETOOTH communication device 1011 and the second BLUETOOTH communication device 1012. The first BLUETOOTH communication device 1011 periodically transmits wireless signal information including the identifier unique to the first BLUETOOTH communication device 1011. The second BLUETOOTH communication device 1012 periodically transmits wireless signal information including the identifier unique to the second BLUETOOTH communication device 1012.

Similarly to the first communication device 1300 illustrated in FIG. 24, the first communication device 1310 may communicate with the mobile device 100, the first illumination device 200, and the second illumination device 201. As illustrated in FIG. 25, the first communication device 1310 includes a BLUETOOTH communication unit 1312 and a communication-device location specifying unit 1313. In addition, similarly to the second communication device 1301 illustrated in FIG. 24, the second communication device 1311 may communicate with the mobile device 100 and the third illumination device 202. The first communication device 1310 and the second communication device 1311 are, for example, a bridge, a router, or the like.

The BLUETOOTH communication unit 1312 may communicate with the first BLUETOOTH communication device 1011. The BLUETOOTH communication unit 1312 acquires wireless signal information transmitted from the first BLUETOOTH communication device 1011.

The communication-device location specifying unit 1313 acquires a piece of communication-device location information by specifying the location where the first communication device 1310 is present in accordance with the identifier unique to the first BLUETOOTH communication device 1011 and included in wireless signal information transmitted by the first BLUETOOTH communication device 1011. For example, the communication-device location specifying unit 1313 specifies the location where the first communication device 1310 is present using the identifier included in wireless signal information received by the BLUETOOTH communication unit 1312.

For example, the location where the first BLUETOOTH communication device 1011 is present is registered in advance in association with the identifier in the first BLUETOOTH communication device 1011 or the first communication device 1310. As a result, the communication-device location specifying unit 1313 specifies the location where the first communication device 1310 is present by acquiring the identifier.

Here, as illustrated in FIG. 25, the first illumination device 200, the second illumination device 201, the first BLUETOOTH communication device 1011, and the first communication device 1310 are present in "living room", and the third illumination device 202, the second BLUETOOTH communication device 1012, and the second communication device 1311 are present in "bedroom". That is, for every room or area, one BLUETOOTH communication device, one communication device, and one or more illumination devices belonging to the communication device are arranged.

For example, in the case where a user is in the "living room" with the mobile device 100, the mobile device 100 acquires a piece of communication-device location information as a piece of mobile-device location information from the first communication device 1310 by communicating with the first communication device 1310. In contrast, in the case where the user has moved to the "bedroom" with the mobile device 100, the mobile device 100 acquires a piece of communication-device location information as a piece of mobile-device location information from the second communication device 1311 by communicating with the second communication device 1311.

As a result, the mobile device 100 may specify the location where the mobile device 100 itself is present. In addition, a piece of communication-device location information indicates the location where an illumination device is present. Thus, by acquiring a piece of communication-device location information from a communication device, the mobile device 100 may automatically acquire pieces of illumination-device location information indicating the locations where illumination devices belonging to the communication device are present.

Note that the mobile device 100 may also communicate with the first illumination device 200 and the second illumination device 201 via the first BLUETOOTH communication device 1011 and the BLUETOOTH communication unit 1312. That is, the communication unit 170 of the mobile device 100 may perform BLUETOOTH communication, and may also transmit a control signal to the first illumination device 200 and the second illumination device 201 via the first BLUETOOTH communication device 1011 and the first communication device 1310.

In addition, similarly to the mobile device 102 illustrated in FIG. 13, the mobile device 100 may include the device location specifying unit 182 and also automatically specify the location of the mobile device 100 by communicating with the first BLUETOOTH communication device 1011 or the second BLUETOOTH communication device 1012.

Next, the case where a visible light communication function is used will be described using FIG. 26.

Figure 26:
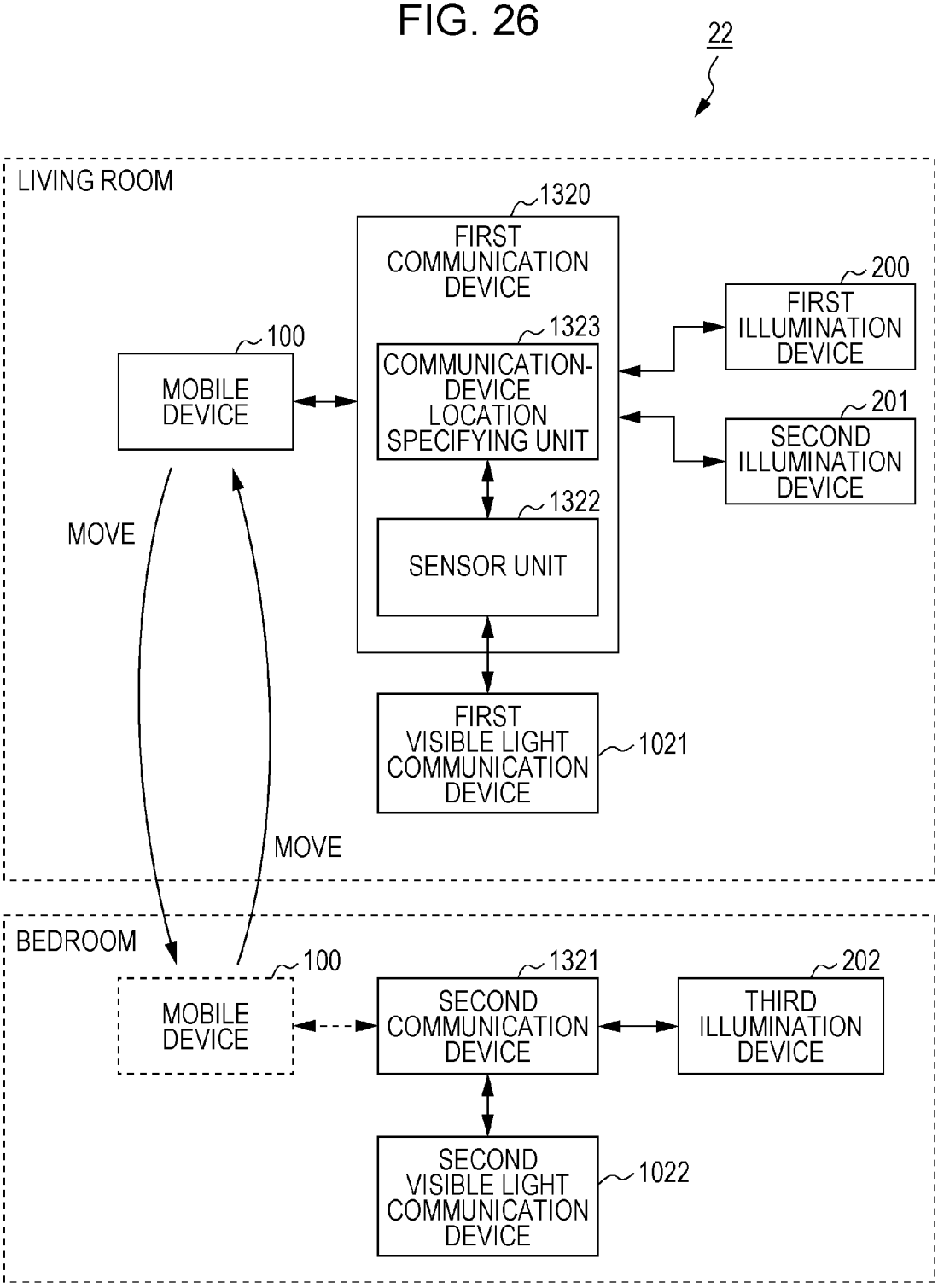
FIG. 26 is a diagram illustrating another example of a configuration for acquiring a piece of communication-device location information according to the second modified example of the embodiment.

An illumination system 22 illustrated in FIG. 26 is an example of the illumination system 10 illustrated in FIG. 1. The illumination system 22 differs from the illumination system 20 illustrated in FIG. 24 in that the illumination system 22 includes a first visible light communication device 1021, a second visible light communication device 1022, a first communication device 1320, and a second communication device 1321 instead of the first wireless LAN device 1001, the second wireless LAN device 1002, the first communication device 1300, and the second communication device 1301.

The first visible light communication device 1021 and the second visible light communication device 1022 perform communication using a visible-frequency electromagnetic wave. A unique identifier is set for the first visible light communication device 1021 and the second visible light communication device 1022. The first visible light communication device 1021 periodically transmits an electromagnetic wave including the identifier unique to the first visible light communication device 1021. The second visible light communication device 1022 periodically transmits an electromagnetic wave including the identifier unique to the second visible light communication device 1022.

Note that the first visible light communication device 1021 may also be any one of the first illumination device 200 and the second illumination device 201. Likewise, the second visible light communication device 1022 may also be the third illumination device 202. That is, the first visible light communication device 1021 and the second visible light communication device 1022 may also be one of illumination devices controlled by the mobile device 100.

Similarly to the first communication device 1300 illustrated in FIG. 24, the first communication device 1320 may communicate with the mobile device 100, the first illumination device 200, and the second illumination device 201. As illustrated in FIG. 26, the first communication device 1320 includes a sensor unit 1322 and a communication-device location specifying unit 1323. In addition, similarly to the second communication device 1301 illustrated in FIG. 24, the second communication device 1321 may communicate with the mobile device 100 and the third illumination device 202. The first communication device 1320 and the second communication device 1321 are, for example, a bridge, a router, or the like.

The sensor unit 1322 receives a visible-frequency electromagnetic wave. Specifically, the sensor unit 1322 receives an electromagnetic wave transmitted from the first visible light communication device 1021.

The communication-device location specifying unit 1323 acquires a piece of communication-device location information by specifying the location where the first communication device 1320 is present in accordance with the identifier unique to the first visible light communication device 1021 and included in an electromagnetic wave transmitted by the first visible light communication device 1021. For example, the communication-device location specifying unit 1323 specifies the location where the first communication device 1320 is present using the identifier included in an electromagnetic wave received by the sensor unit 1322.

For example, the location where the first visible light communication device 1021 is present is registered in advance in association with the identifier in the first visible light communication device 1021 or the first communication device 1320. As a result, the communication-device location specifying unit 1323 specifies the location where the first communication device 1320 is present by acquiring the identifier.

Here, as illustrated in FIG. 26, the first illumination device 200, the second illumination device 201, the first visible light communication device 1021, and the first communication device 1320 are present in "living room", and the third illumination device 202, the second visible light communication device 1022, and the second communication device 1321 are present in "bedroom". That is, for every room or area, one visible light communication device, one communication device, and one or more illumination devices belonging to the communication device are arranged.

For example, in the case where a user is in the "living room" with the mobile device 100, the mobile device 100 acquires a piece of communication-device location information as a piece of mobile-device location information from the first communication device 1320 by communicating with the first communication device 1320. In contrast, in the case where the user has moved to the "bedroom" with the mobile device 100, the mobile device 100 acquires a piece of communication-device location information as a piece of mobile-device location information from the second communication device 1321 by communicating with the second communication device 1321.

As a result, the mobile device 100 may specify the location where the mobile device 100 itself is present. In addition, a piece of communication-device location information indicates the location where an illumination device is present. Thus, by acquiring a piece of communication-device location information from a communication device, the mobile device 100 may automatically acquire pieces of illumination-device location information indicating the locations where illumination devices belonging to the communication device are present.

Note that, similarly to the mobile device 103 illustrated in FIG. 14, the mobile device 100 may include the device location specifying unit 183 and also automatically specify the location of the mobile device 100 by communicating with the first visible light communication device 1021 or the second visible light communication device 1022.

Next, the case where an ultrasonic wave is used will be described using FIG. 27.

Figure 27:
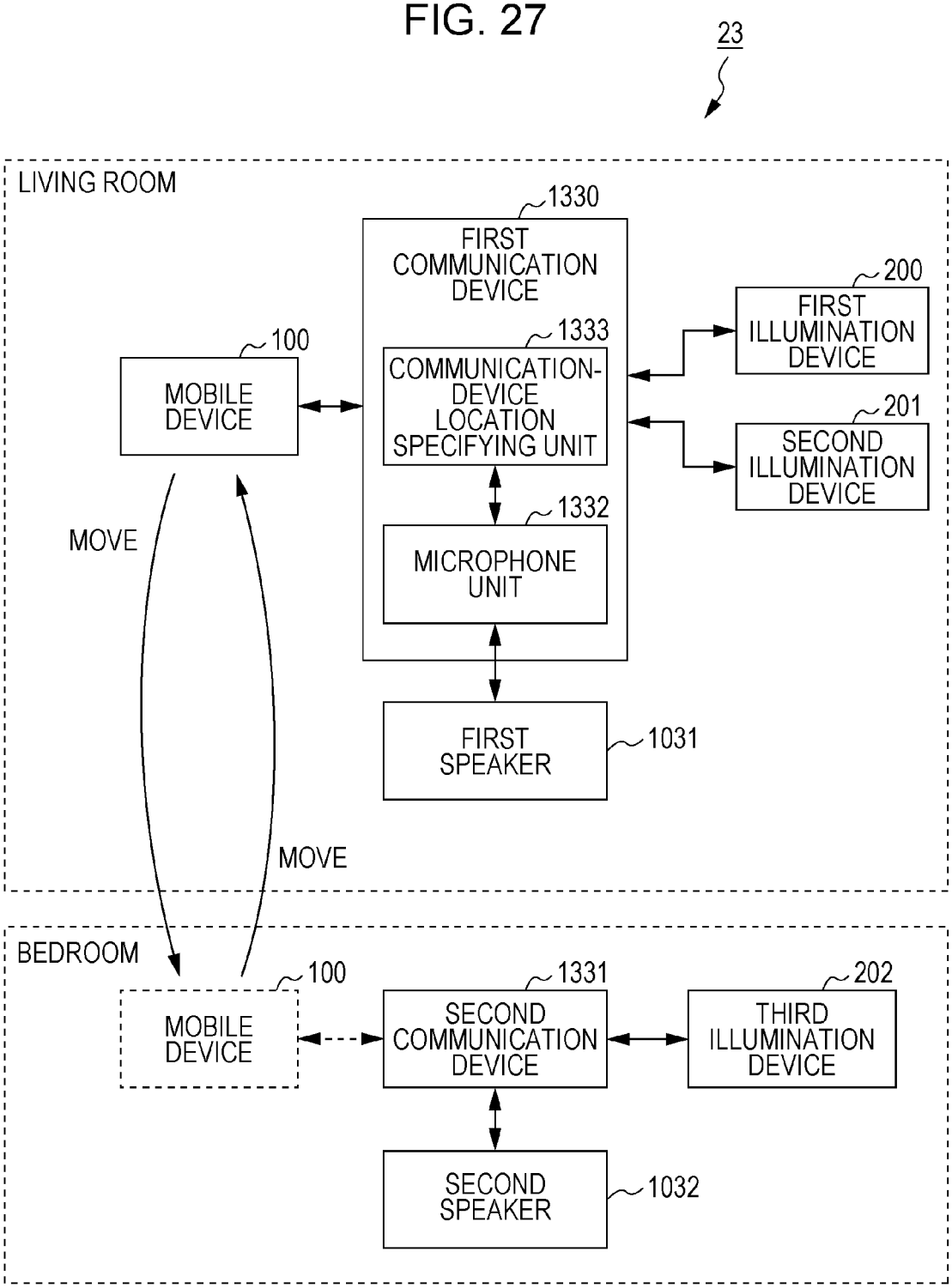
FIG. 27 is a diagram illustrating another example of a configuration for acquiring a piece of communication-device location information according to the second modified example of the embodiment.

An illumination system 23 illustrated in FIG. 27 is an example of the illumination system 10 illustrated in FIG. 1. The illumination system 23 differs from the illumination system 20 illustrated in FIG. 24 in that the illumination system 23 includes a first speaker 1031, a second speaker 1032, a first communication device 1330, and a second communication device 1331 instead of the first wireless LAN device 1001, the second wireless LAN device 1002, the first communication device 1300, and the second communication device 1301.

The first speaker 1031 and the second speaker 1032 perform communication using an ultrasonic wave. A unique identifier is set for the first speaker 1031 and the second speaker 1032. The first speaker 1031 periodically transmits an ultrasonic wave including the identifier unique to the first speaker 1031. The second speaker 1032 periodically transmits an ultrasonic wave including the identifier unique to the second speaker 1032.

Similarly to the first communication device 1300 illustrated in FIG. 24, the first communication device 1330 may communicate with the mobile device 100, the first illumination device 200, and the second illumination device 201. As illustrated in FIG. 27, the first communication device 1330 includes a microphone unit 1332 and a communication-device location specifying unit 1333. In addition, similarly to the second communication device 1301 illustrated in FIG. 24, the second communication device 1331 may communicate with the mobile device 100 and the third illumination device 202. The first communication device 1330 and the second communication device 1331 are, for example, a bridge, a router, or the like.

The microphone unit 1332 receives an ultrasonic wave. Specifically, the microphone unit 1332 receives an ultrasonic wave transmitted from the first speaker 1031.

The communication-device location specifying unit 1333 acquires a piece of communication-device location information by specifying the location where the first communication device 1330 is present in accordance with the identifier unique to the first speaker 1031 and included in an ultrasonic wave transmitted by the first speaker 1031. For example, the communication-device location specifying unit 1333 specifies the location where the first communication device 1330 is present using the identifier included in an ultrasonic wave received by the microphone unit 1332.

For example, the location where the first speaker 1031 is present is registered in advance in association with the identifier in the first speaker 1031 or the first communication device 1330. As a result, the communication-device location specifying unit 1333 specifies the location where the first communication device 1330 is present by acquiring the identifier.

Here, as illustrated in FIG. 27, the first illumination device 200, the second illumination device 201, the first speaker 1031, and the first communication device 1330 are present in "living room", and the third illumination device 202, the second speaker 1032, and the second communication device 1331 are present in "bedroom". That is, for every room or area, one speaker, one communication device, and one or more illumination devices belonging to the communication device are arranged.

For example, in the case where a user is in the "living room" with the mobile device 100, the mobile device 100 acquires a piece of communication-device location information as a piece of mobile-device location information from the first communication device 1330 by communicating with the first communication device 1330. In contrast, in the case where the user has moved to the "bedroom" with the mobile device 100, the mobile device 100 acquires a piece of communication-device location information as a piece of mobile-device location information from the second communication device 1331 by communicating with the second communication device 1331.

As a result, the mobile device 100 may specify the location where the mobile device 100 itself is present. In addition, a piece of communication-device location information indicates the location where an illumination device is present. Thus, by acquiring a piece of communication-device location information from a communication device, the mobile device 100 may automatically acquire pieces of illumination-device location information indicating the locations where illumination devices belonging to the communication device are present.

Note that, similarly to the mobile device 104 illustrated in FIG. 15, the mobile device 100 may include the device location specifying unit 184 and also automatically specify the location of the mobile device 100 by communicating with the first speaker 1031 or the second speaker 1032.

Next, the case where IMES is used will be described using FIG. 28.

Figure 28:
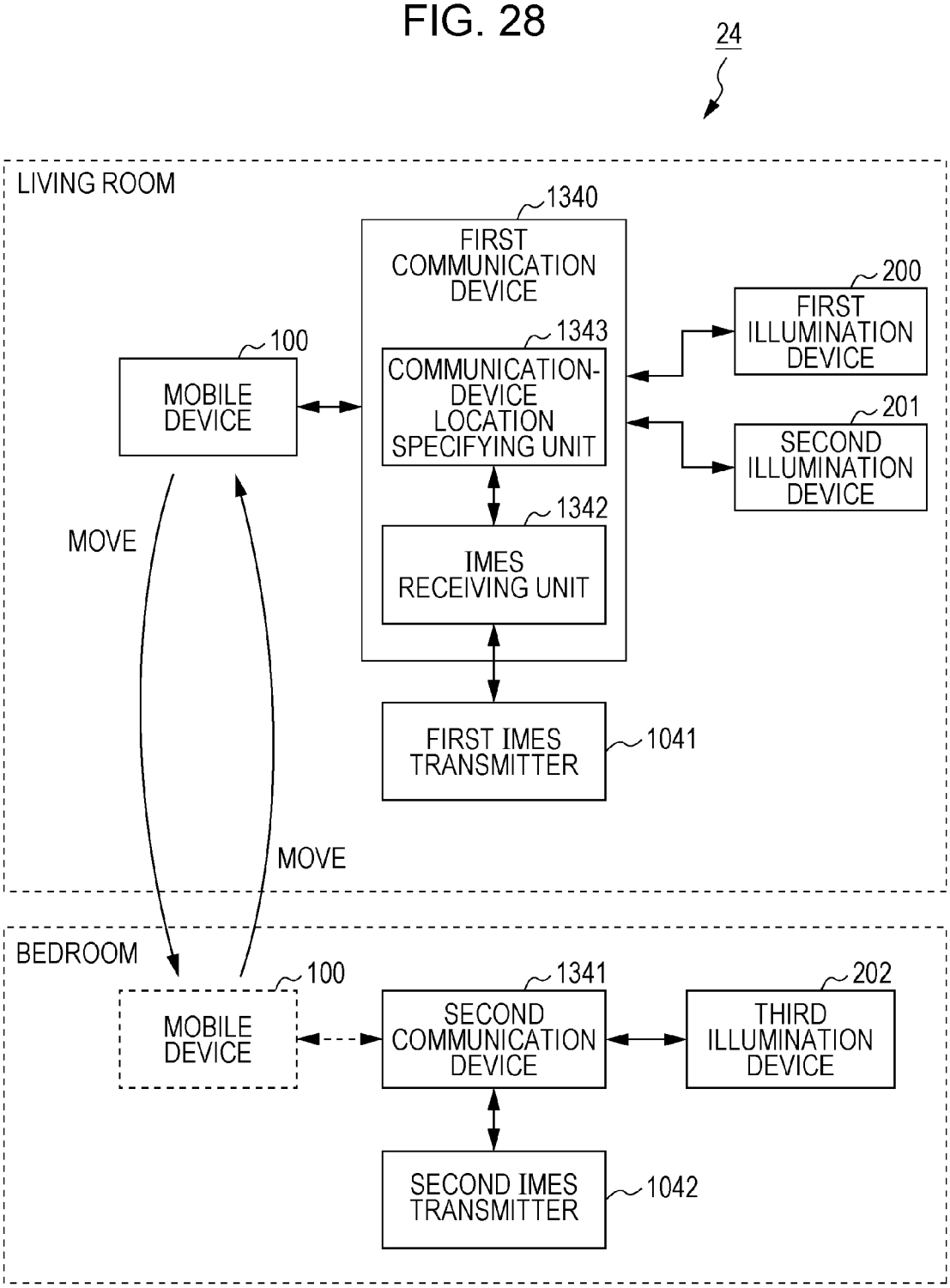
FIG. 28 is a diagram illustrating another example of a configuration for acquiring a piece of communication-device location information according to the second modified example of the embodiment.

An illumination system 24 illustrated in FIG. 28 is an example of the illumination system 10 illustrated in FIG. 1. The illumination system 24 differs from the illumination system 20 illustrated in FIG. 24 in that the illumination system 24 includes a first IMES transmitter 1041, a second IMES transmitter 1042, a first communication device 1340, and a second communication device 1341 instead of the first wireless LAN device 1001, the second wireless LAN device 1002, the first communication device 1300, and the second communication device 1301.

The first IMES transmitter 1041 and the second IMES transmitter 1042 transmit wireless signal information including position information. Specifically, the first IMES transmitter 1041 transmits wireless signal information including information indicating a latitude, a longitude, and a floor number indicating the location where the first IMES transmitter 1041 is present and the second IMES transmitter 1042 transmits wireless signal information including information indicating a latitude, a longitude, and a floor number indicating the location where the second IMES transmitter 1042 is present.

Similarly to the first communication device 1300 illustrated in FIG. 24, the first communication device 1340 may communicate with the mobile device 100, the first illumination device 200, and the second illumination device 201. As illustrated in FIG. 28, the first communication device 1340 includes an IMES receiving unit 1342 and a communication-device location specifying unit 1343. In addition, similarly to the second communication device 1301 illustrated in FIG. 24, the second communication device 1341 may communicate with the mobile device 100 and the third illumination device 202. The first communication device 1340 and the second communication device 1341 are, for example, a bridge, a router, or the like.

The IMES receiving unit 1342 may communicate with the first IMES transmitter 1041. The IMES receiving unit 1342 acquires wireless signal information transmitted from the first IMES transmitter 1041.

The communication-device location specifying unit 1343 acquires a piece of communication-device location information by specifying the location where the first communication device 1340 is present in accordance with information indicating a latitude, a longitude, and a floor number included in wireless signal information transmitted by the first IMES transmitter 1041.

Here, as illustrated in FIG. 28, the first illumination device 200, the second illumination device 201, the first IMES transmitter 1041, and the first communication device 1340 are present in "living room", and the third illumination device 202, the second IMES transmitter 1042, and the second communication device 1341 are present in "bedroom". That is, for every room or area, one IMES transmitter, one communication device, and one or more illumination devices belonging to the communication device are arranged.

For example, in the case where a user is in the "living room" with the mobile device 100, the mobile device 100 acquires a piece of communication-device location information as a piece of mobile-device location information from the first communication device 1340 by communicating with the first communication device 1340. In contrast, in the case where the user has moved to the "bedroom" with the mobile device 100, the mobile device 100 acquires a piece of communication-device location information as a piece of mobile-device location information from the second communication device 1341 by communicating with the second communication device 1341.

As a result, the mobile device 100 may specify the location where the mobile device 100 itself is present. In addition, a piece of communication-device location information indicates the location where an illumination device is present. Thus, by acquiring a piece of communication-device location information from a communication device, the mobile device 100 may automatically acquire pieces of illumination-device location information indicating the locations where illumination devices belonging to the communication device are present.

In addition, similarly to the mobile device 105 illustrated in FIG. 22, the mobile device 100 may include the device location specifying unit 185 and also automatically specify the location of the mobile device 100 by communicating with the first IMES transmitter 1041 or the second IMES transmitter 1042.

As described above, the mobile devices and communication devices illustrated in FIGS. 24 to 28 may automatically acquire a piece of communication-device location information. In contrast to this, a piece of communication-device location information may also be acquired in accordance with a user's command.

Figure 29:
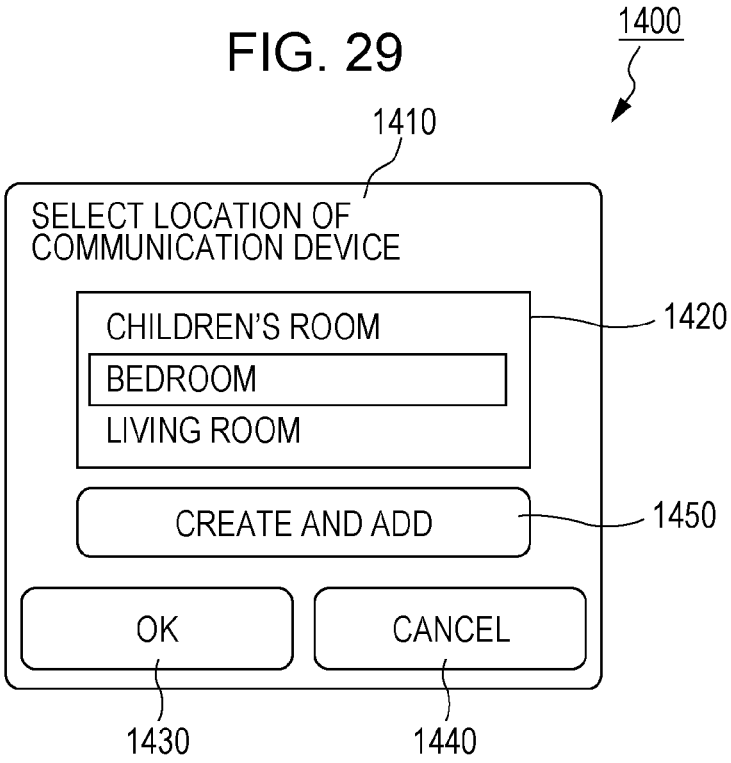
FIG. 29 is a diagram illustrating an example of a communication-device location selection screen according to the second modified example of the embodiment.

In the following, a configuration for acquiring the location of a communication device by causing a user to input the location of the communication device will be described using FIG. 29. FIG. 29 is a diagram illustrating a communication-device location selection screen 1400 according to the second modified example of the embodiment.

The communication-device location selection screen 1400 is an example of a third input prompt screen for causing a user to input a piece of communication-device location information. The communication-device location selection screen 1400 is displayed when, for example, a communication device and an illumination device are newly registered. Alternatively, the communication-device location selection screen 1400 is displayed when information on the location of a registered communication device is edited. Specifically, although not illustrated, when the input unit 110 detects, for example, a communication-device register button displayed on the display unit 120 being pressed, the communication-device location selection screen 1400 is displayed.

As illustrated in FIG. 29, the communication-device location selection screen 1400 includes a comment 1410, a list box 1420, a confirmation button 1430, a cancel button 1440, and a create-and-add button 1450.

The comment 1410 is text for presenting an operation that a user should perform. Specifically, the comment 1410 is text for prompting a user to select a piece of communication-device location information. For example, the comment 1410, which is "Select location of communication device", is displayed as illustrated in FIG. 29. Note that, instead of by the comment 1410, a user may also be prompted by voice to select a location.

The list box 1420 is an example of a GUI component, and is an interface for causing a user to select a piece of communication-device location information. The list box 1420 displays one or more choices for specifying a location such as "bedroom", "living room", and the like, and a user may select one of the one or more choices. These choices have been registered, for example, by a user in advance.

Note that the choices displayed in the list box 1420 are the same as those displayed in the list box 1120 or 1220 illustrated in FIG. 16 or 17. For example, the list box 1420 may be scrolled vertically and is configured such that all the preregistered choices are selectable.

The confirmation button 1430 is an example of a GUI component, and is, for example, a push-button. The confirmation button 1430 is a button for causing a user to confirm that one of the one or more choices displayed in the list box 1420 has been selected. In the case where the confirmation button 1430 has been selected, the choice selected in the list box 1420 is set as a piece of communication-device location information.

The cancel button 1440 is an example of a GUI component, and is, for example, a push-button. The cancel button 1440 is a button for causing a user to confirm that selection of a piece of communication-device location information is to be terminated. In the case where the cancel button 1440 has been selected, selection of a piece of communication-device location information is terminated, and, for example, a registration process for an illumination device is terminated.

The create-and-add button 1450 is an example of a GUI component, and is, for example, a push-button. The create-and-add button 1450 is a button for adding a choice to be displayed in the list box 1420.

In the case where the create-and-add button 1450 has been selected, for example, a text box is displayed and a user may input text indicating a desired location. Note that, instead of such a text box, a voice input may also be received.

Note that, instead of displaying the communication-device location selection screen 1400, the mobile device 100 may also enter a state for receiving a voice input or a gesture input. A specific process is the same as that for inputting a piece of mobile-device location information.

As described above, according to the control method for a mobile device according to the second modified example, since a user may input a piece of communication-device location information, registration of a communication device may be performed at a location desired by the user. For example, even in the case where a user is in "living room" with a mobile device, the user may register a communication device present in "bedroom".

(Third Modified Example)

Figure 30:
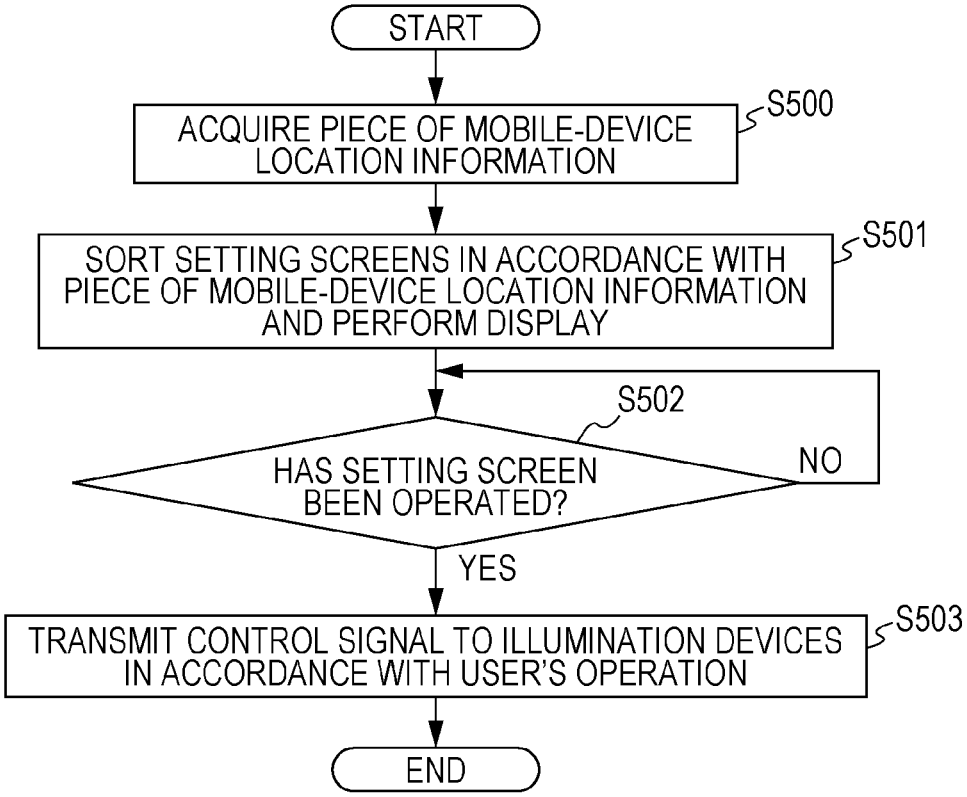
FIG. 30 is a flowchart illustrating an example of a scene setting method according to a third modified example of the embodiment.

In the above-described embodiment, details of the control method for the mobile device 100 has been described. However, for example, scenes do not have to be created or edited. In other words, setting screens for predetermined one or more illumination devices have only to be sorted in accordance with a piece of mobile-device location information and to be displayed. Specifically, the mobile device 100 may also be controlled in accordance with a flowchart illustrated in FIG. 30. Note that FIG. 30 is a flowchart illustrating an example of an illumination-state adjustment method according to a third modified example of the embodiment.

First, the display controller 130 acquires a piece of mobile-device location information indicating the location where the mobile device 100 is present using the device location specifying unit 180 (S500). Specifically, the device location specifying unit 180 acquires information specifying the room or area where the mobile device 100 is present as a piece of mobile-device location information and outputs the piece of mobile-device location information to the display controller 130.

Next, the display controller 130 sorts one or more setting screens 410 corresponding to respective one or more illumination devices and causes the display unit 120 to display the one or more setting screens 410 that have been sorted, in accordance with the piece of mobile-device location information and one or more pieces of illumination-device location information using the illumination information management unit 150 (S501), the illumination information management unit 150 storing one or more pieces of information on one or more illumination devices and one or more pieces of illumination-device location information indicating one or more locations where respective one or more illumination devices are present, the one or more pieces of information being associated with the one or more pieces of illumination-device location information. Specifically, the display controller 130 assigns display priorities to illumination devices in accordance with FIG. 11 or 23, and the setting screens corresponding to illumination devices whose assigned display priorities are high are displayed in a prioritized manner.

Next, in the case where one or more setting screens 410 have been operated by a user (Yes in S502), the illumination controller 160 transmits a control signal for controlling one or more illumination devices to the one or more illumination devices, in accordance with setting information indicating an illumination state set through the user's operation performed through the setting screens 410 (S503).

Note that in the case where the setting screens 410 are not operated (No in S502), the display controller 130 is held on standby until the setting screens 410 are operated.

As described above, according to the control method for the mobile device 100 according to the third modified example, one or more setting screens are sorted in accordance with a piece of mobile-device location information and displayed. As a result, since a remote-control operation screen corresponding to the location where the mobile device 100 is present may be displayed in a prioritized manner, the control method for the mobile device 100 according to the third modified example may allow a user to easily adjust an illumination state created by illumination devices.

(Fourth Modified Example)

In the above-described embodiments, the example has been described in which the mobile device 100 includes the display controller 130, the illumination information management unit 150, and the illumination controller 160; however, examples are not limited to this example. For example, a server connected to the mobile device 100 via a network may also include the display controller 130, the illumination information management unit 150, and the illumination controller 160. That is, a mobile device may also be a device that displays a screen and captures an image in accordance with a command transmitted from the server via the network.

Figure 31:
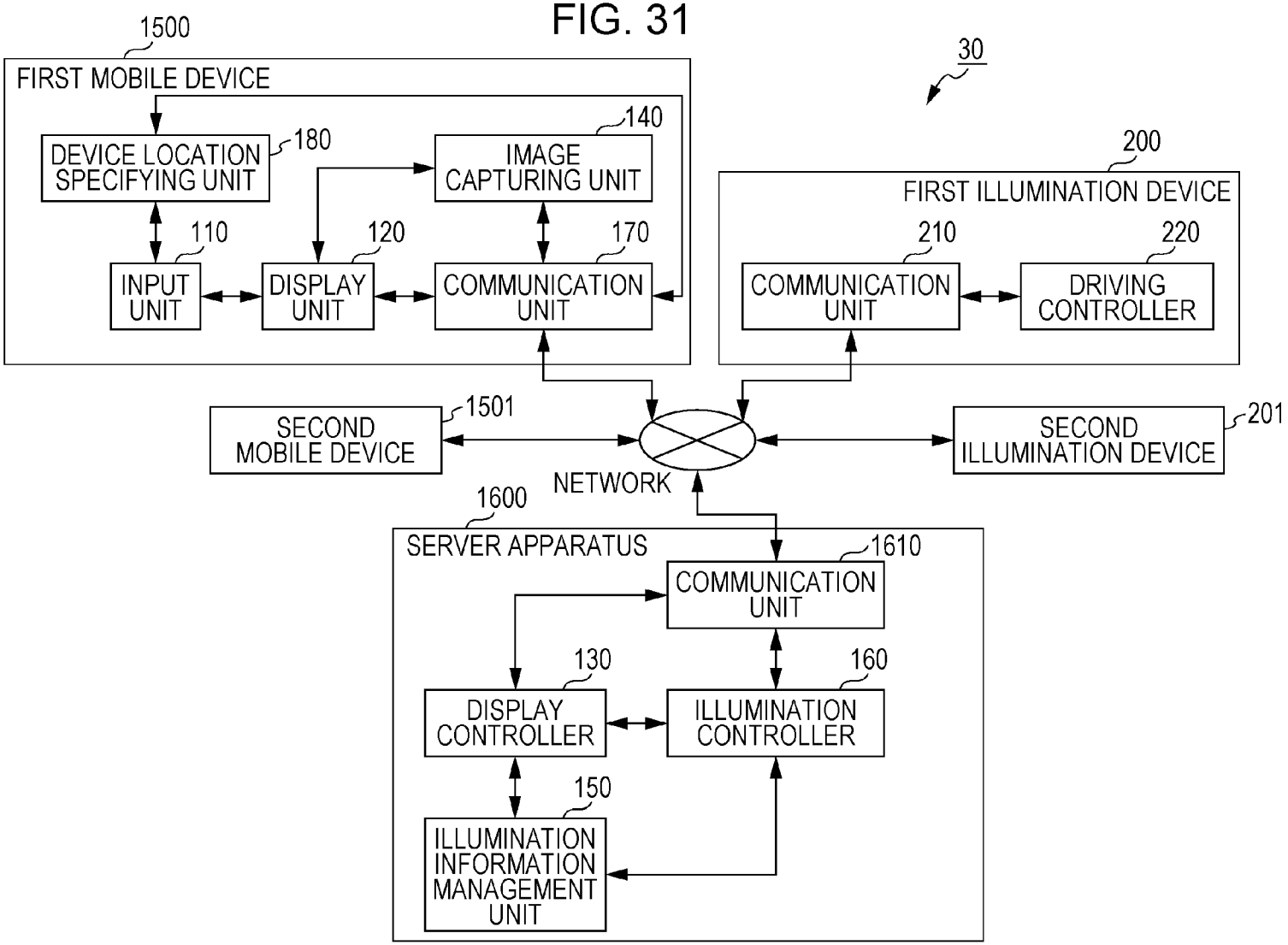
FIG. 31 is a block diagram illustrating an example of an illumination system according to a fourth modified example of the embodiment.

FIG. 31 is a block diagram illustrating an illumination system 30 according to a fourth modified example of the embodiment. As illustrated in FIG. 31, the illumination system 30 includes a first mobile device 1500, a second mobile device 1501, the first illumination device 200, the second illumination device 201, and a server apparatus 1600.

The first mobile device 1500 is an example of a device that controls one or more illumination devices that illuminate one or more spaces. Specifically, the first mobile device 1500 controls one or more illumination devices (in an example illustrated in FIG. 31, the first illumination device 200 and the second illumination device 201) via the server apparatus 1600.

As illustrated in FIG. 31, the first mobile device 1500 includes the input unit 110, the display unit 120, the image capturing unit 140, the communication unit 170, and the device location specifying unit 180.

Each processing unit performs processing in accordance with a command transmitted from the server apparatus 1600. For example, the display unit 120 displays a screen created by the display controller 130 of the server apparatus 1600 and acquired via the communication unit 170. In addition, the image capturing unit 140 transmits an image acquired through image capturing to the server apparatus 1600 via the communication unit 170. In addition, the input unit 110 transmits a user's operation input, to the server apparatus 1600 via the communication unit 170. In addition, the device location specifying unit 180 transmits an acquired piece of mobile-device location information to the server apparatus 1600 via the communication unit 170.

Similarly to the first mobile device 1500, the second mobile device 1501 is an example of a device that controls one or more illumination devices that illuminate one or more spaces. That is, the first illumination device 200 and the second illumination device 201 may be controlled by each of the first mobile device 1500 and the second mobile device 1501. In other words, one or more illumination devices may be controlled by one or more mobile devices individually. Note that, although not illustrated, similarly to the first mobile device 1500, the second mobile device 1501 includes the input unit 110, the display unit 120, the image capturing unit 140, the communication unit 170, and the device location specifying unit 180.

The server apparatus 1600 is a server that controls a mobile device that controls one or more illumination devices that illuminate a space. Specifically, the server apparatus 1600 controls the first mobile device 1500 and the second mobile device 1501.

As illustrated in FIG. 31, the server apparatus 1600 includes a communication unit 1610, the display controller 130, the illumination information management unit 150, and the illumination controller 160.

The communication unit 1610 transmits a control signal created by the illumination controller 160 to the one or more illumination devices connected via the network. In addition, the communication unit 1610 transmits information indicating a screen created by the display controller 130 to the first mobile device 1500 or the second mobile device 1501, the information being information for displaying the screen on the display unit 120. In addition, the communication unit 1610 receives a user's operation input acquired via the input unit 110 and the display unit 120 from the first mobile device 1500 or the second mobile device 1501. In addition, the communication unit 1610 receives an image acquired by the image capturing unit 140 from the first mobile device 1500 or the second mobile device 1501. In addition, the communication unit 1610 receives a piece of mobile-device location information acquired by the device location specifying unit 180, from the first mobile device 1500 or the second mobile device 1501.

For example, the communication unit 1610 is a communication interface such as a wireless local-area network (LAN) module, a BLUETOOTH module, a near field communication (NFC) module, or the like. Note that the communication unit 1610 may also be a LAN terminal for wired communication.

For example, suppose the case where the first mobile device 1500 creates a first scene and the second mobile device 1501 creates a second scene. Specifically, the first mobile device 1500 and the second mobile device 1501 create the first scene and the second scene, respectively, by communicating with the server apparatus 1600. Here, the illumination information management unit 150 of the server apparatus 1600 manages scene information including the first scene and the second scene.

The display controller 130 creates a scene selection screen in accordance with the scene information managed by the illumination information management unit 150, and thus a scene icon of the first scene and a scene icon of the second scene are displayed on the scene selection screen. As a result, any of the first mobile device 1500 and the second mobile device 1501 may select the first scene and the second scene.

Here, in the case where the first mobile device 1500 and the second mobile device 1501 are present in different locations, a remote-control operation screen displayed on the first mobile device 1500 is different from that displayed on the second mobile device 1501. For example, in the case where a piece of mobile-device location information received from the first mobile device 1500 is information specifying "living room", the server apparatus 1600 causes the display unit 120 of the first mobile device 1500 to display the remote-control operation screen 400 illustrated in FIG. 5A. In addition, in the case where a piece of mobile-device location information received from the second mobile device 1501 is information specifying "bedroom", the server apparatus 1600 causes the display unit 120 of the second mobile device 1501 to display the remote-control operation screen 401 illustrated in FIG. 5B.

As described above, the server apparatus 1600 controls one or more mobile devices and one or more illumination devices, and as a result, the convenience of operation for users may be improved. For example, even though a user has created a scene using any of one or more mobile devices, the user may select a scene from any of the one or more mobile devices.

Note that, here, the first mobile device 1500 and the second mobile device 1501 may also include the display controller 130 and the illumination controller 160, and the server apparatus 1600 may include the illumination information management unit 150. That is, the server apparatus 1600 may manage scene information and operation target illumination information collectively, and the first mobile device 1500 and the second mobile device 1501 may also create a control signal and transmit the control signal to one or more illumination devices.

(Others)

The control method for a mobile device according to the present disclosure has been described above in accordance with the above-described embodiments and the modified examples; however, the present disclosure is not limited to the above-described embodiments and the modified examples.

In addition, one or more setting screens may also be selectively sorted. For example, in the case where illumination devices have been registered the number of which is greater than or equal to the maximum number of illumination devices that may be displayed on one screen, the number of illumination devices displayed on one screen does not have to be the maximum number.

For example, in the above-described embodiment, since the number of illumination devices present in "living room" is greater than or equal to the maximum number of illumination devices that may be displayed on one screen, setting screens 410 for five illumination devices present in the "living room" are displayed as illustrated in FIG. 5A. In contrast to this, for example, in the case where the number of illumination devices present in the "living room" is three, only setting screens for the three illumination devices present in the "living room" may also be displayed on a remote-control operation screen. Here, for example, in the case where one of the scroll buttons 420 has been selected, setting screens for illumination devices that are not present in the "living room" may also be displayed.

In this manner, only a setting screen for an illumination device may also be displayed whose piece of illumination-device location information matches a piece of mobile-device location information. Then, a setting screen may also be displayed whose piece of illumination-device location information does not match a piece of mobile-device location information, after screen scrolling.

Here, in the case where a piece of mobile-device location information and a piece of illumination-device location information are information specifying a latitude, a longitude, and a floor number, when the distance between the piece of mobile-device location information and the piece of illumination-device location information is smaller than a certain threshold, it may be considered that the piece of mobile-device location information matches the piece of illumination-device location information. Likewise, when the distance between the piece of mobile-device location information and the piece of illumination-device location information is greater than a certain threshold, it may also be considered that the piece of mobile-device location information does not match the piece of illumination-device location information.

In addition, in the above-described embodiments, examples have been described in which a plurality of setting screens are sorted; however, examples are not limited to these examples. For example, sorting may also be performed for only one setting screen.

For example, in the case where there is only one setting screen, when a piece of mobile-device location information matches a piece of illumination-device location information, the setting screen is displayed. When a piece of mobile-device location information does not match a piece of illumination-device location information, the setting screen does not have to be displayed. Here, when a piece of mobile-device location information does not match a piece of illumination-device location information, the setting screen may also be displayed after screen scrolling.

In addition, in the above-described embodiments, examples have been described in which setting screens are sorted two-dimensionally; however, setting screens may also be sorted three-dimensionally.

In addition, in the above-described embodiments, examples have been described in which a scene icon is a captured image or a default image; however, examples are not limited to these examples. For example, a scene icon may also be text corresponding to a scene name.

In addition, in the above-described embodiments, examples have been described in which buttons are push-buttons; however, examples are not limited to these examples. For example, a button may also be a GUI component such as a radio button, a check box, a drop-down list box, or a list box.

Note that, in the above-described embodiments, structural elements may also be configured by dedicated hardware devices or may also be realized by executing software programs appropriate for the respective structural elements. Each structural element may also be realized by reading a software program recorded in a recording medium such as a hard disk or a semiconductor memory and executing the software program using a program execution unit such as a CPU or a processor. Here, a software program that realizes a mobile device of each of the above-described embodiments is, for example, the following program.

That is, the program is a control program for a mobile device that controls one or more illumination devices. The mobile device includes a display unit and a computer. The control program causing the computer to execute a process, the process including acquiring a piece of mobile-device location information indicating a location where the mobile device is present, sorting one or more setting screens corresponding to the respective one or more illumination devices in accordance with the piece of mobile-device location information and one or more pieces of illumination-device location information using a memory in which the one or more illumination devices and the one or more pieces of illumination-device location information indicating one or more locations where the respective one or more illumination devices are present are associated with each other and stored, causing the display unit to display the sorted setting screens, and transmitting a control signal for controlling the one or more illumination devices in accordance with setting information indicating an illumination state set through a user's operation performed through the setting screens, to the one or more illumination devices.

The present disclosure may be used in a control method for a mobile device having a camera function, and may be used in, for example, a smartphone, a mobile phone, a tablet device, a PDA, and the like.

What is claimed is:

1. A control method for a mobile device that controls one or more illumination devices, the mobile device including a display, a computer, and a memory, the control method causing the computer of the mobile device to perform operations comprising:

acquiring a piece of mobile-device location information indicating a location where the mobile device is present;

sorting one or more setting screens corresponding to the respective one or more illumination devices using information stored in the memory, the information indicating correspondences between the one or more illumination devices and one or more pieces of illumination-device location information indicating one or more locations where the respective one or more illumination devices are present;

displaying the sorted one or more setting screens on the display; and transmitting a control signal for controlling the one or more illumination devices in accordance with setting information indicating an illumination state set through an input operation performed through the setting screens, to the one or more illumination devices, wherein the one or more setting screens includes a slider to adjust brightness of corresponding illumination devices, wherein a piece of mobile-device location information identifies information specifying a room or an area where the mobile device is present, wherein each of the illumination-device location information identifies information specifying a room or an area where a corresponding one of the one or more illumination devices is present, wherein, in the displaying the one or more setting screens, the one or more setting screens are sorted according to a priority, based on location, from the illumination-device location information and displayed in a row, wherein one or more first illumination device setting screens corresponding to one or more first illumination-devices of the one or more illumination devices that corresponds to a first illumination device location information that matches the room or the area identified by the mobile-device location information is displayed on a first area of the row, and wherein the first area begins at a left portion of the row and sequentially occupies parts of the row.

2. The control method for a mobile device according to claim 1, further comprising:

displaying a scene selection screen including one or more scene icons and a scene setting button on the display, the one or more scene icons corresponding to one or more scenes indicating one or more illumination states created by the one or more illumination devices;

transmitting, to the one or more illumination devices, the control signal for controlling the one or more illumination devices so as to provide illumination, in a case where a scene icon has been selected among the one or more scene icons, in an illumination state indicated by a scene corresponding to the selected scene icon;

sorting the one or more setting screens in a case where the scene setting button has been selected;

displaying the sorted one or more setting screens together with a setting complete button on the display; and storing the setting information obtained when the setting complete button is selected, as setting information on a new scene, in the memory.

3. The control method for a mobile device according to claim 1, further comprising:

displaying a location input button on the display; and displaying, in a case where the location input button has been selected, a first input screen on the display for causing a user to input the piece of mobile-device location information.

4. The control method for a mobile device according to claim 1, further comprising:

displaying a second input screen on the display for causing a user to input the one or more pieces of illumination-device location information.

5. The control method for a mobile device according to claim 1, wherein the mobile-device location information is information specifying a latitude, a longitude, and a floor number of the location where the mobile device is present, and each of the illumination-device location information is information specifying a latitude, a longitude, and a floor number of a location where a corresponding one of the one or more illumination devices is present.

6. The control method for a mobile device according to claim 5, wherein one or more setting screens corresponding to the one or more pieces of illumination-device location information are sorted in ascending order of one or more distances from the mobile device to one or more positions determined by one or more latitudes, longitudes, and floor numbers specified by the one or more pieces of illumination-device location information, and the sorted one or more setting screens are displayed on the display.

7. The control method for a mobile device according to claim 1, wherein the mobile device is capable of communicating with a wireless LAN device, and the piece of mobile-device location information is acquired by specifying the location where the mobile device is present in accordance with an identifier unique to the wireless LAN device and included in wireless signal information transmitted by the wireless LAN device.

8. The control method for a mobile device according to claim 1, wherein the mobile device is capable of communicating with a BLUETOOTH communication device, and the piece of mobile-device location information is acquired by specifying the location where the mobile device is present in accordance with an identifier unique to the BLUETOOTH communication device and included in wireless signal information transmitted by the BLUETOOTH communication device.

9. The control method for a mobile device according to claim 1, wherein the mobile device further includes a sensor that receives a visible-frequency electromagnetic wave, and the piece of mobile-device location information is acquired by specifying the location where the mobile device is present in accordance with an identifier unique to a visible light communication device that transmits a visible-frequency electromagnetic wave and included in a visible-frequency electromagnetic wave received by the sensor.

10. The control method for a mobile device according to claim 1, wherein the mobile device further includes a microphone that receives an ultrasonic wave, and the piece of mobile-device location information is acquired by specifying the location where the mobile device is present in accordance with an identifier unique to a speaker that transmits an ultrasonic wave and included in an ultrasonic wave received by the microphone.

11. The control method for a mobile device according to claim 1, wherein the mobile device further includes an indoor messaging system receiver, and the piece of mobile-device location information is acquired by specifying the location where the mobile device is present in accordance with information indicating a latitude, a longitude, and a floor number included in wireless signal information received by the indoor messaging system receiver, the wireless signal information being transmitted by an indoor messaging system transmitter that communicates with the mobile device.

12. The control method for a mobile device according to claim 1, wherein the control signal is transmitted via one or more communication devices, each of the one or more illumination devices belongs to any one of the one or more communication devices, and the one or more pieces of illumination-device location information are one or more pieces of communication-device location information indicating one or more locations where respective one or more communication devices are present to which the one or more illumination devices corresponding to the one or more pieces of illumination-device location information belong.

13. The control method for a mobile device according to claim 12, wherein each of the one or more pieces of communication-device location information is a piece of information acquired by a communication device corresponding to the piece of communication-device location information.

14. The control method for a mobile device according to claim 13, wherein each of the one or more communication devices is capable of communicating with a wireless LAN device corresponding to the communication device, and the communication device acquires the piece of communication-device location information by specifying a location where the communication device is present in accordance with an identifier unique to the wireless LAN device and included in wireless signal information transmitted by the wireless LAN device.

15. The control method for a mobile device according to claim 13, wherein each of the one or more communication devices is capable of communicating with a BLUETOOTH communication device corresponding to the communication device, and the communication device acquires the piece of communication-device location information by specifying a location where the communication device is present in accordance with an identifier unique to the BLUETOOTH communication device and included in wireless signal information transmitted by the BLUETOOTH communication device.

16. The control method for a mobile device according to claim 13, wherein each of the one or more communication devices includes a sensor that receives a visible-frequency electromagnetic wave transmitted from a visible light communication device corresponding to the communication device, and the communication device acquires the piece of communication-device location information by specifying a location where the communication device is present in accordance with an identifier unique to the visible light communication device and included in an electromagnetic wave received by the sensor.

17. The control method for a mobile device according to claim 13, wherein each of the one or more communication devices includes a microphone that receives an ultrasonic wave transmitted from a speaker corresponding to the communication device, and the communication device acquires the piece of communication-device location information by specifying a location where the communication device is present in accordance with an identifier unique to the speaker and included in an ultrasonic wave received by the microphone.

18. The control method for a mobile device according to claim 13, wherein each of the one or more communication devices includes an indoor messaging system receiver, and the communication device acquires the piece of communication-device location information by specifying a location where the communication device is present in accordance with information indicating a latitude, a longitude, and a floor number included in wireless signal information received by the indoor messaging system receiver, the wireless signal information being transmitted by an indoor messaging system transmitter that communicates with the communication device.

19. The control method for a mobile device according to claim 12, further comprising:

displaying a third input screen on the display for causing a user to input the one or more pieces of communication-device location information.

20. A non-transitory computer readable medium storing a control program for a mobile device that controls one or more illumination devices, the mobile device including a display, a computer, and a memory, the control program causing the computer to execute operations, the operations comprising:

acquiring a piece of mobile-device location information indicating a location where the mobile device is present;

sorting one or more setting screens corresponding to the respective one or more illumination devices using information stored in the memory, the information indicating correspondences between the one or more illumination devices and one or more pieces of illumination-device location information indicating one or more locations where the respective one or more illumination devices are present;

displaying the sorted setting screens on the display; and transmitting a control signal for controlling the one or more illumination devices in accordance with setting information indicating an illumination state set through an input operation performed through the setting screens, to the one or more illumination devices, wherein the one or more setting screens includes a slider to adjust brightness of corresponding illumination devices, wherein a piece of mobile-device location information identifies information specifying a room or an area where the mobile device is present, wherein each of the illumination-device location information identifies information specifying a room or an area where a corresponding one of the one or more illumination devices is present, wherein, in the displaying the one or more setting screens, the one or more setting screens are sorted according to a priority, based on location, from the illumination-device location information and displayed in a row, wherein one or more first illumination device setting screens corresponding to one or more first illumination-devices of the one or more illumination devices that corresponds to a first illumination device location information that matches the room or the area identified by the mobile-device location information is displayed on a first area of the row, and wherein the first area begins at a left portion of the row and sequentially occupies parts of the row.

* * * * *